US010583577B2

(12) United States Patent
Hall et al.

(10) Patent No.: US 10,583,577 B2
(45) **Date of Patent: *Mar. 10, 2020**

(54) POWER OPERATED ROTARY KNIFE WITH NOTCHED ROTARY KNIFE BLADE AND TRIM GUIDE

(71) Applicant: BETTCHER INDUSTRIES, INC., Birmingham, OH (US)

(72) Inventors: Joel L. Hall, Cleveland, OH (US); Terrence A. Pagano, North Royalton, OH (US); Kevin V. Stump, Wellington, OH (US); Austen J. Gray, Wellington, OH (US); Rosario E. Palmiero, North Royalton, OH (US)

(73) Assignee: Bettcher Industries, Inc., Birmingham, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/628,637

(22) Filed: Jun. 20, 2017

(65) Prior Publication Data

US 2017/0282393 A1 Oct. 5, 2017
US 2018/0117782 A9 May 3, 2018

Related U.S. Application Data

(63) Continuation-in-part of application No. 15/216,120, filed on Jul. 21, 2016, now Pat. No. 10,343,296.
(Continued)

(51) Int. Cl.
*B26B 25/00* (2006.01)
*B26B 29/06* (2006.01)
*B26D 7/18* (2006.01)

(52) U.S. Cl.
CPC ..... *B26B 25/002* (2013.01); *B26B 29/06* (2013.01); *B26D 7/1863* (2013.01)

(58) Field of Classification Search
CPC ..... B26B 25/06; B26B 25/02; B26B 25/002; B26B 25/1863
See application file for complete search history.

(56) References Cited

U.S. PATENT DOCUMENTS 2,281,531 A 4/1942 Casner
2,720,696 A 10/1955 Wadsworth
(Continued)

FOREIGN PATENT DOCUMENTS

EP 0816026 A1 1/1998
EP 2168730 A1 3/2010
WO WO 00/15024 3/2000

OTHER PUBLICATIONS

Extended European Search Report dated Dec. 3, 2018 for European Application No. 16831110.8, filed Jan. 25, 2018. European Application No. 16831110.8 is a regional phase application of PCT International Application No. PCT/US 2016/043,484, filed Jul. 22, 2016. PCT International Application No. PCT/US 2016/043,484 claims priority from U.S. Appl. No. 15/216,120, filed Jul. 21, 2016. The present application claims priority from U.S. Appl. No. 15/216,120. (7 pages).
(Continued)

*Primary Examiner* — Stephen Choi
*Assistant Examiner* — Fernando A Ayala
(74) *Attorney, Agent, or Firm* — Tarolli, Sundheim, Covell & Tummino LLP

(57) ABSTRACT

A power operated rotary knife assembly including a power operated rotary knife having an annular rotary knife blade, a trim guide, and a drive mechanism for driving the rotary knife blade about an axis of rotation. The assembly also includes a portable power unit, a vacuum assembly and a flexible shaft drive transmission coupled between the power operated rotary knife and the portable power unit. The portable power unit includes a drive motor assembly pro-
(Continued)

viding a rotational power source which is operatively coupled to the drive mechanism through the flexible drive transmission to rotate the rotary knife blade. The portable power unit also includes a blower assembly providing vacuum pressure at an inlet duct side, the vacuum assembly being in fluid communication with the inlet duct side to generate a vacuum pressure condition in a region of a cutting opening defined by the rotary knife blade and the trim guide.

25 Claims, 48 Drawing Sheets

Related U.S. Application Data

(60) Provisional application No. 62/196,973, filed on Jul. 25, 2015.

(56) References Cited

U.S. PATENT DOCUMENTS

| | | | | |
|---|---|---|---|---|
| 2,740,198 | A | 4/1956 | Edgett | |
| 2,883,746 | A | 4/1959 | Gilsi | |
| 3,077,664 | A | 2/1963 | Murawski | |
| 4,439,924 | A | 4/1984 | Bettcher | |
| 4,637,140 | A | 1/1987 | Bettcher | |
| 4,854,046 | A | 8/1989 | Decker et al. | |
| 4,858,321 | A | 8/1989 | McCullough | |
| 4,987,681 | A | 1/1991 | Sepke | |
| 5,020,226 | A | 6/1991 | Chabbert | |
| 5,404,644 | A | 4/1995 | Needham et al. | |
| 5,445,561 | A * | 8/1995 | Elmer | A22B 5/163 30/347 |
| 5,588,289 | A * | 12/1996 | Wilson | A01G 3/0535 30/124 |
| 5,692,307 | A | 12/1997 | Whited et al. | |
| 5,940,972 | A | 8/1999 | Bads et al. | |
| 6,013,079 | A | 1/2000 | Salam | |
| 6,354,949 | B1 | 3/2002 | Baris et al. | |
| 6,413,157 | B1 | 7/2002 | Marton | |
| 6,662,452 | B2 | 12/2003 | Whited | |
| 6,665,943 | B1 | 12/2003 | Sloane et al. | |
| 6,751,872 | B1 | 6/2004 | Whited et al. | |
| 6,769,184 | B1 | 8/2004 | Whited | |
| 6,857,191 | B2 | 2/2005 | Whited | |
| 6,978,548 | B2 | 12/2005 | Whited et al. | |
| 7,152,323 | B1 | 12/2006 | Lin | |
| 7,207,114 | B2 | 4/2007 | Rosu et al. | |
| 7,458,161 | B2 | 12/2008 | Wilson | |
| D618,253 | S | 6/2010 | Wilson et al. | |
| D630,480 | S | 1/2011 | Wilson | |
| 8,240,055 | B2 * | 8/2012 | Gooding | B23D 45/16 30/276 |
| 8,448,340 | B2 | 5/2013 | Whited | |
| 8,661,692 | B2 | 3/2014 | Whited et al. | |
| 8,726,524 | B2 | 5/2014 | Whited et al. | |
| 8,745,881 | B2 | 6/2014 | Thompson et al. | |
| 8,756,819 | B2 | 6/2014 | Whited et al. | |
| 8,968,107 | B2 | 3/2015 | Rapp et al. | |
| 9,265,263 | B2 | 2/2016 | Whited et al. | |
| 9,452,541 | B2 | 9/2016 | Mascari et al. | |
| 9,579,810 | B2 | 2/2017 | Mascari | |
| 9,592,076 | B2 | 3/2017 | Esarey et al. | |
| 2003/0084576 | A1 | 5/2003 | Whited et al. | |
| 2004/0088864 | A1 * | 5/2004 | Whited | B26B 25/002 30/123 |
| 2004/0211067 | A1 | 10/2004 | Whited et al. | |
| 2008/0098605 | A1 * | 5/2008 | Whited | B26B 25/002 30/276 |
| 2008/0110026 | A1 * | 5/2008 | Marcoe | A01G 20/43 30/124 |
| 2010/0101097 | A1 | 4/2010 | Thien | |
| 2011/0072669 | A1 | 3/2011 | Morisugi et al. | |
| 2013/0025138 | A1 | 1/2013 | Whited et al. | |
| 2013/0104404 | A1 | 5/2013 | Levsen | |
| 2013/0174424 | A1 * | 7/2013 | Whited | A22B 5/165 30/276 |
| 2013/0219726 | A1 | 8/2013 | Rosu et al. | |
| 2014/0074120 | A1 | 3/2014 | Esarey et al. | |
| 2014/0250697 | A1 | 9/2014 | Steele et al. | |
| 2017/0210024 | A1 | 7/2017 | Mascari | |

OTHER PUBLICATIONS

PCT International Search Report and Written Opinion of the International Searching Authority dated Jul. 22, 2016 for PCT International Application No. PCT/US2016/043484, filed Jun. 22, 2016. PCT International Application No. PCT/US2016/043484 claims priority from U.S. Appl. No. 15/216,120, filed Jul. 21, 2016. The present application (U.S. Appl. No. 15/628,637) is a continuation-in-part of and claims priority from U.S. Appl. No. 15/216,120. (13 pages).

User Manual for Garden Groom VERSA TRIM Collecting Trimmer (Model No. GG30), publication date Jun. 15, 2009. (10 pages).

User Manual for Garden Groom PRO Safety Hedge Trimmer (Model No. GG21), upon information and belief, publication date is at least as early as Jul. 24, 2014. (6 pages).

User Manual for Garden Groom GARDEN BARBER Cordless Collecting Hedge and Shrub Trimmer (Model No. GG41), upon information and belief, publication date is at least as early as Jul. 24, 2014. (6 pages).

* cited by examiner

POWER OPERATED ROTARY KNIFE WITH NOTCHED ROTARY KNIFE BLADE AND TRIM GUIDE

CROSS REFERENCE TO RELATED APPLICATIONS

The present application is a continuation-in-part application co-pending U.S. Non-Provisional application Ser. No. 15/216,120, filed Jul. 21, 2016 entitled Power Operated Rotary Knife With Notched Rotary Knife Blade and Trim Guide, published as Pub. No. US 2017/0021514 A1, publication date Jan. 26, 2017. The present application claims priority to the above-identified, co-pending U.S. Non-Provisional application Ser. No. 15/216,120 and U.S. Provisional Patent Application Ser. No. 62/196,973, filed Jul. 25, 2015 entitled Power Operated Rotary Knife With Notched Rotary Knife Blade and Trim Guide. The above-identified U.S. Non-Provisional application Ser. No. 15/216,120, Pub. No. US 2017/0021514 A1, and U.S. Provisional Patent Application Ser. No. 62/196,973 are fully incorporated herein by reference in their respective entireties for any and all purposes.

TECHNICAL FIELD

The present disclosure relates to a power operated rotary knife including a notched annular rotary knife blade and a notched annular trim guide, the notched trim guide directing elements to be cut into position for cutting between recessed, sharpened regions or cutting portions of the rotary knife blade against recessed shearing portions of the notched trim guide.

BACKGROUND

Power operated rotary knives are widely used in meat processing facilities for meat cutting and trimming operations. Power operated rotary knives also have application in a variety of other industries where cutting and/or trimming operations need to be performed quickly and with less effort than would be the case if traditional manual cutting or trimming tools were used, e.g., long knives, scissors, nippers, etc. By way of example, power operated rotary knives may be effectively utilized for such diverse tasks as taxidermy; cutting and trimming of elastomeric or urethane foam for a variety of applications including vehicle seats; and tissue removal or debriding in connection with medical/surgical procedures and/or tissue recovery from a body of a human or animal donor.

Power operated rotary knives typically include a head assembly and an elongated handle assembly releasably affixed to the head assembly. The handle assembly extends along a longitudinal axis and includes a hand piece having a gripping surface to be grasped by an operator or user to manipulate the power operated rotary knife. The handle assembly may include a central core or other attachment structure to releasably attach the handle assembly to the head assembly.

The head assembly includes an annular blade housing and an annular rotary knife blade supported for rotation by the blade housing. The annular rotary blade of conventional power operated rotary knives is typically rotated by a drive assembly which include a flexible shaft drive assembly extending through an opening in the handle assembly. The shaft drive assembly engages and rotates a drive train, such as, for example, a pinion gear supported by the head assembly. The flexible shaft drive assembly includes a stationary outer sheath and a rotatable interior drive shaft which is driven by an electric motor. Gear teeth of the pinion gear engage mating gear teeth formed on an upper surface of the rotary knife blade. Alternately, a pneumatic motor disposed in a throughbore of the handle assembly may be used to drive the pinion gear supported by the head assembly which, in turn, rotates the rotary knife blade.

Upon rotation of the pinion gear by the drive shaft of the flexible shaft drive assembly, the annular rotary blade rotates within the blade housing at a high RPM, on the order of 500-1500 RPM, depending on the structure and characteristics of the drive assembly including the motor, the shaft drive assembly, and a diameter and the number of gear teeth formed on the rotary knife blade. Conventional power operated rotary knives are disclosed in U.S. Pat. No. 6,354,949 to Baris et al., U.S. Pat. No. 6,751,872 to Whited et al., U.S. Pat. No. 6,769,184 to Whited, and U.S. Pat. No. 6,978,548 to Whited et al., all of which are assigned to the assignee of the present invention and all of which are incorporated herein in their respective entireties by reference.

SUMMARY

In one aspect, the present disclosure relates to a power operated rotary knife comprising: an annular rotary knife blade supported for rotation about a central axis of rotation in a direction of rotation and rotating with respect to a trim guide, the knife blade including an annular body including an inner wall and an outer wall and an upper end and a lower end, the annular body of the rotary knife blade including a bearing surface for rotational support of the rotary knife blade and a driven gear for rotationally driving the rotary knife blade, the rotary knife blade further including a blade section extending from the lower end of the annular body, the blade section including a blade frustoconical wall extending between an upper end of the blade section and a lower end of the blade section, the lower end of the blade section spaced radially inwardly from and axially below the upper end, a plurality of circumferentially spaced apart notches extending from the lower end of the blade section into the blade frustoconical wall, each of the plurality of notches including an opening at the lower end and a central open portion defined by a peripheral wall, the peripheral wall including a cutting portion, the cutting portion of each of the plurality of circumferentially spaced apart notches defining a cutting edge of the rotary knife blade; and a trim guide including a base and a guide section extending radially inwardly and axially downwardly from the base, the guide section extending axially below and being adjacent to the blade section of the rotary knife blade and including a guide frustoconical wall extending between an upper end of the guide section and a lower end of the guide section, the lower end of the guide section spaced radially inwardly from the upper end, a plurality of circumferentially spaced apart notches extending from the lower end into the guide frustoconical wall, each of the plurality of notches including as opening at the lower end and a central open portion defined by a peripheral wall, the peripheral wall including a shearing portion, the shearing portion in overlapping axial alignment with the cutting portions of the plurality of notches of the blade section of the rotary knife blade as the rotary blade rotates about the central axis of rotation.

In another aspect, the present disclosure relates to a combination of an annular rotary knife blade and a trim guide for a power operated rotary knife, the combination comprising: the annular rotary knife blade supported for rotation about a central axis of rotation in a direction of rotation and rotating with respect to the trim guide, the knife blade including an annular body including an inner wall and an outer wall and an upper end and a lower end, the annular body of the rotary knife blade including a bearing surface for rotational support of the rotary knife blade and a driven gear for rotationally driving the rotary knife blade, the rotary knife blade further including a blade section extending from the lower end of the annular body, the blade section including a blade frustoconical wall extending between an upper end of the blade section and a lower end of the blade section, the lower end of the blade section spaced radially inwardly from and axially below the upper end, a plurality of circumferentially spaced apart notches extending from the lower end of the blade section into the blade frustoconical wall, each of the plurality of notches including an opening at the lower end and a central open portion defined by a peripheral wall, the peripheral wall including an arcuate cutting portion, the arcuate cutting portion of each of the plurality of circumferentially spaced apart notches defining a cutting edge of the rotary knife blade; and the trim guide including a base and a guide section extending radially inwardly and axially downwardly from the base, the guide section extending axially below and being adjacent to the blade section of the rotary knife blade and including a guide frustoconical wall extending between an upper end of the guide section and a lower end of the guide section, the lower end of the guide section spaced radially inwardly from the upper end, a plurality of circumferentially spaced apart notches extending from the lower end into the guide frustoconical wall, each of the plurality of notches including as opening at the lower end and a central open portion defined by a peripheral wall, the peripheral wall including a shearing portion, the shearing portion in overlapping axial alignment with the cutting portions of the plurality of notches of the blade section of the rotary knife blade as the rotary blade rotates about the central axis of rotation.

In another aspect, the present disclosure relates to a power operated rotary knife assembly comprising: a) a hand-held power operated rotary knife including a head assembly and an elongated handle assembly extending from the head assembly along a longitudinal axis, the head assembly including: i) an annular rotary knife blade supported for rotation about a central axis of rotation in a direction of rotation, the annular rotary knife blade including a blade section including a central opening and a plurality of circumferentially spaced apart notches extending from a lower end of the blade section, each of the plurality of notches including an opening at the lower end and a central open portion defined by a peripheral wall, the peripheral wall including a cutting portion, the cutting portion of each of the plurality of circumferentially spaced apart notches defining a cutting edge of the rotary knife blade; ii) a trim guide including a central opening and a plurality of circumferentially spaced apart notches extending from a lower end of the trim guide, each of the plurality of notches including an opening at the lower end and a central open portion defined by a peripheral wall, the peripheral wall including a shearing portion, the shearing portions in overlapping axial alignment with the cutting portions of the plurality of notches of the blade section of the annular rotary knife blade as the annular rotary blade rotates about the central axis of rotation, overlapping central openings the annular rotary knife blade and the trim guide defining a central cutting opening of the head assembly; and iii) a frame body supporting a drive mechanism including a gear member engaging and rotating the annular rotary knife blade; b) a portable power unit including a drive motor assembly and a blower assembly, the drive motor assembly including a driveshaft assembly rotating about a driveshaft central axis of rotation, the blower assembly including a fan and a duct, the fan coupled to and rotated by the driveshaft assembly, the duct including an inlet duct side on one side of the fan and an outlet duct side on an opposite side of the fan, the inlet duct side including an interior region, rotation of the fan causing a vacuum pressure condition within the interior region of the inlet duct side; c) a flexible shaft drive transmission including a rotating flex shaft assembly operatively coupled between the driveshaft assembly of the portable power unit and the drive mechanism of the head assembly of the power operated rotary knife, rotation of the driveshaft assembly about the driveshaft central axis of rotation causing rotation of the flex shaft assembly and rotation of the gear member of the drive mechanism to rotate the annular rotary knife blade; and d) a vacuum assembly including a vacuum hose coupled between the head assembly and the inlet duct side of the duct of the blower assembly, an interior region of the hose in fluid communication with the interior region of the inlet duct side, the vacuum pressure condition within the interior region of the inlet duct side causing a vacuum pressure condition within an interior region of the vacuum hose and a vacuum condition in a region of the central cutting opening of the head assembly.

BRIEF DESCRIPTION OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which.

DETAILED DESCRIPTION

Figure 1:
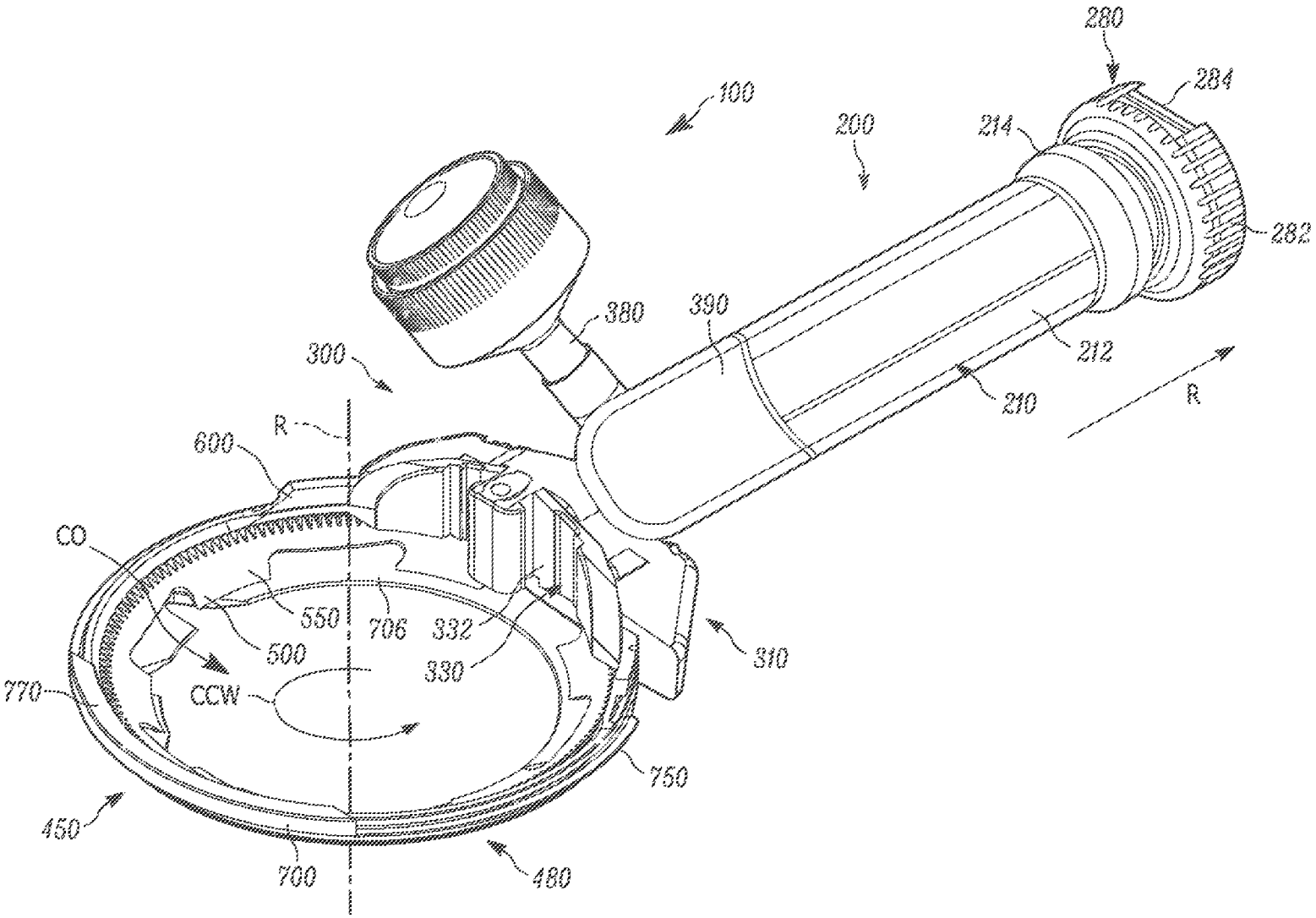
FIG. 1 is a schematic top front perspective view of a first exemplary embodiment of a power operated rotary knife of the present disclosure including a handle assembly, a head assembly, including a notched annular rotary knife blade, a blade housing and a notched trim guide.
Figure 2:
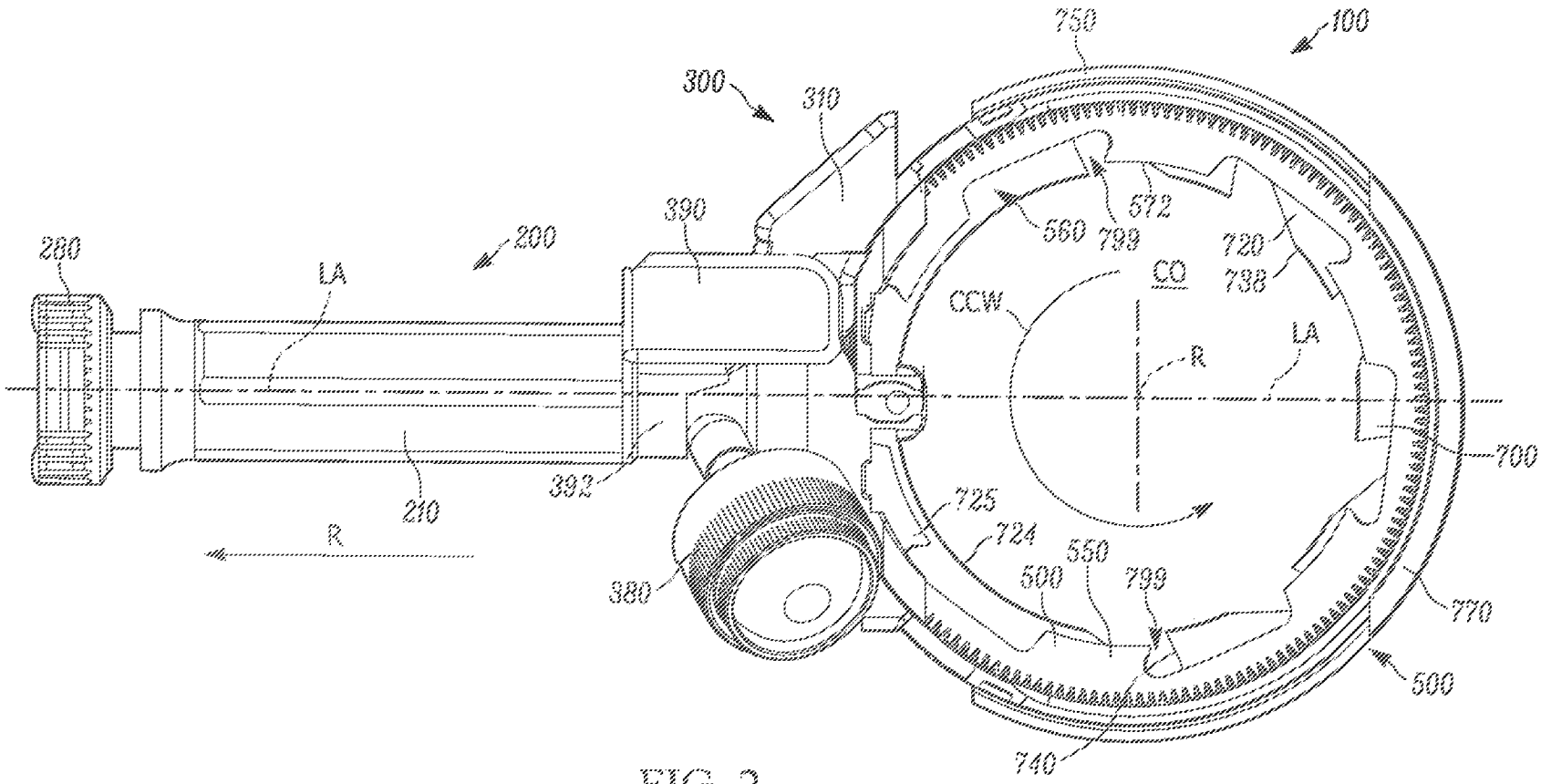
FIG. 2 is a schematic top plan view of the power operated rotary knife of FIG. 1.
Figure 3:
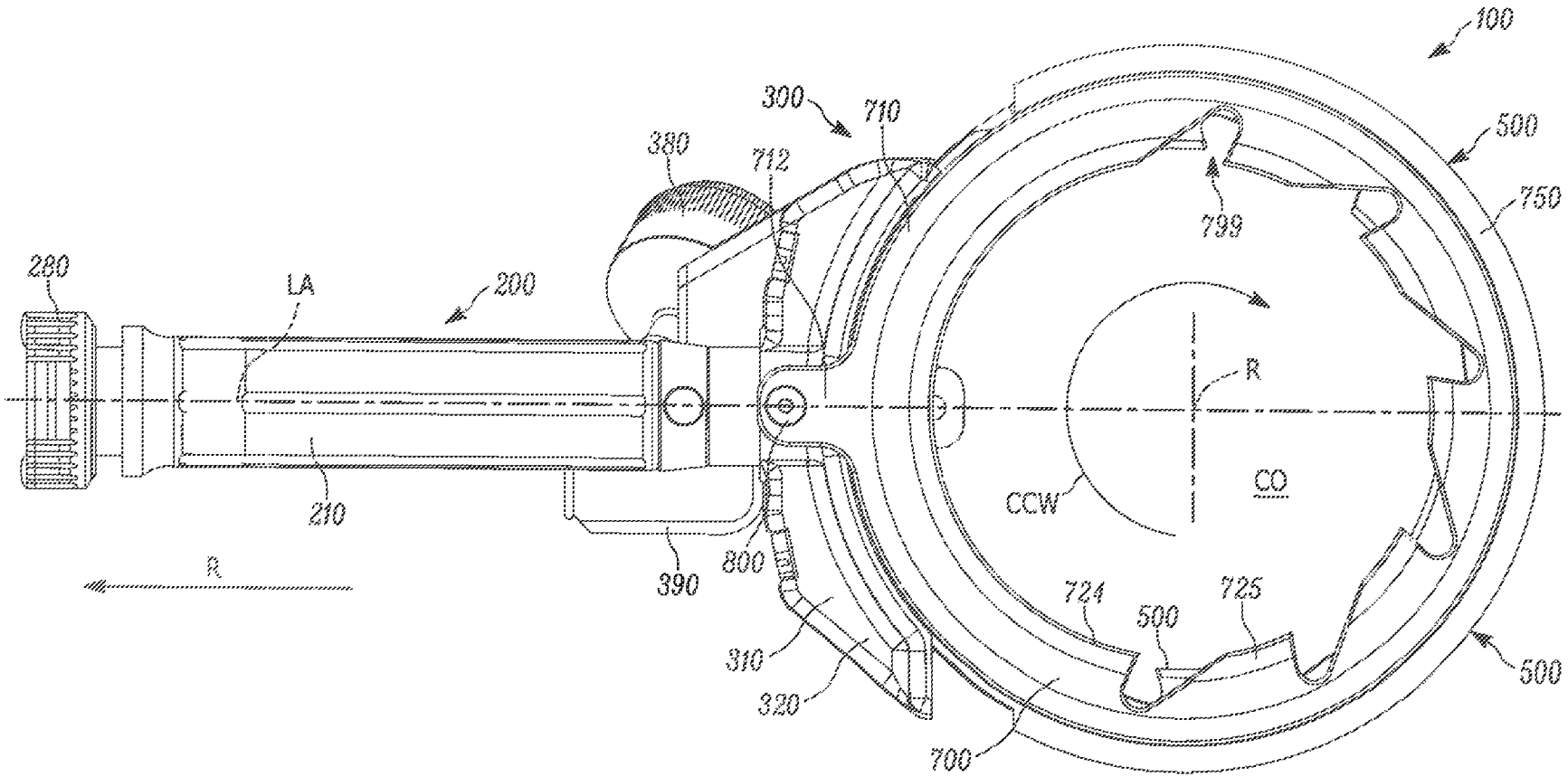
FIG. 3 is a schematic bottom plan view of the power operated rotary knife of FIG. 1.

The present disclosure relates to a power operated rotary knife, in one exemplary embodiment, shown generally at 100, in FIGS. 1-3, including a head assembly 300 having a rotating, notched annular rotary knife blade 500 (FIGS. 10-13) and a coacting stationary, notched trim guide 700 (FIGS. 14-17). The rotary knife blade 500 is supported by a stationary blade housing 600 (FIGS. 18 and 19) for rotation about a central axis of rotation R of the blade 500. The blade housing 600 is positioned between the rotary knife blade 500 and the trim guide 700. Each of the rotary knife 500, the blade housing 600 and the trim guide 700 are annular, defining central open regions. When the rotary knife blade 500, the blade housing 600 and the trim guide are assembled and attached to a frame body 310 of the head assembly 300, as described below, the central open regions of a combination 450 of the blade 500, blade housing 600 and trim guide 700 define a central cutting opening CO (best seen in the top plan view of FIGS. 2 and 7) of the power operated rotary knife 100. Cutting and trimming take place with the central cutting opening CO. The central cutting opening CO is actually defined by a combination 480 of the blade 500 and the trim guide 700. As can be seen in the top plan view of FIG. 7, the bottom plan view of FIG. 8 and the sectional view of FIG. 9 which depicts the blade/blade housing/trim guide assembled combination 450, no portion of the blade housing 600 extends radially inwardly far enough to define any portion of the central cutting opening CO. Thus, the central cutting opening CO is defined by intersecting central open regions of the assembled combination 480 of the rotary knife blade 500 and trim guide 700.

The notched annular knife blade 500 and coacting notched trim guide 700 are useful for a number of tasks, including trimming/pruning of plants and, specifically, trimming/pruning foliage, branches, stems, stalks, runners, etc. of plants, including nursery stock and production plants in an efficient and effective manner, by utilizing the advantage of a power driven, rapidly rotating rotary knife blade for cutting purposes. Among the plant suitable for trimming and pruning by the power operated knife 100 of the present disclosure include strawberry plants or bushes, which require periodic pruning and trimming of the plants, including trimming of runners (stems sent out by a plant to establish new plants, crowns, etc.) to maximize fruit production.

Pruning of strawberry plants by hand using conventional hand tools such as pruning shears, snips, scissors, etc. or having employees use their hands for pruning is both labor intensive and time consuming. Additionally, constant hand manipulations required for operating pruning shears and the like are both tiring for the employee and result in repetitive stress to the employee's hand. While attempts at using power operated or power driven tools to replace hand pruning operations, such as, for example, the use of power driven string trimmers to prune strawberry plants, have met with limited success because strawberry plants are delicate and the plant and its root structure may be easily damaged by the action of a rapidly rotating plastic line of a string trimmer. Additionally, many commercial growers utilize plastic mats or sheets between strawberry plant rows to inhibit weed growth and protect strawberry plant roots. The whipping action of a rotating plastic line upon inadvertent contact with plastic mat or sheet can displace or damage the mat or sheet thereby undesirably exposing the plant roots and/or damaging the plant roots.

The power operated rotary knife 100 of the present disclosure utilizes the advantage of a rapidly rotating rotary knife blade 500 and the stationary trim guide 700 to facilitate effective and efficient trimming or cutting of plant foliage/branches/stems/stalks/runners and the like, etc. (hereinafter interchangeably and generally/collectively referred to as "branch" and/or "branches" and/or "foliage" and/or "foliage material" and/or "material" and/or "materials" throughout this description). Depending on the gearing of a drive mechanism 400 and the rotational speed of a drive motor of the drive mechanism 400 of the power operated rotary knife 100, a diameter of the rotary knife blade 500 and the gearing characteristics of the driven gear 520 of the blade 500 and other factors, the rotation speed of the blade 500 may be on the order of 500-1500 RPM. The rotary knife blade 500 is supported for rotation about a central axis of rotation R by a blade housing 600 and, when looking at the rotary knife blade 500 and the rotary knife 100 from above (the top plan view shown in FIG. 2) rotates in a counterclockwise direction of rotation CCW (as seen in FIG. 2).

Figure 11:
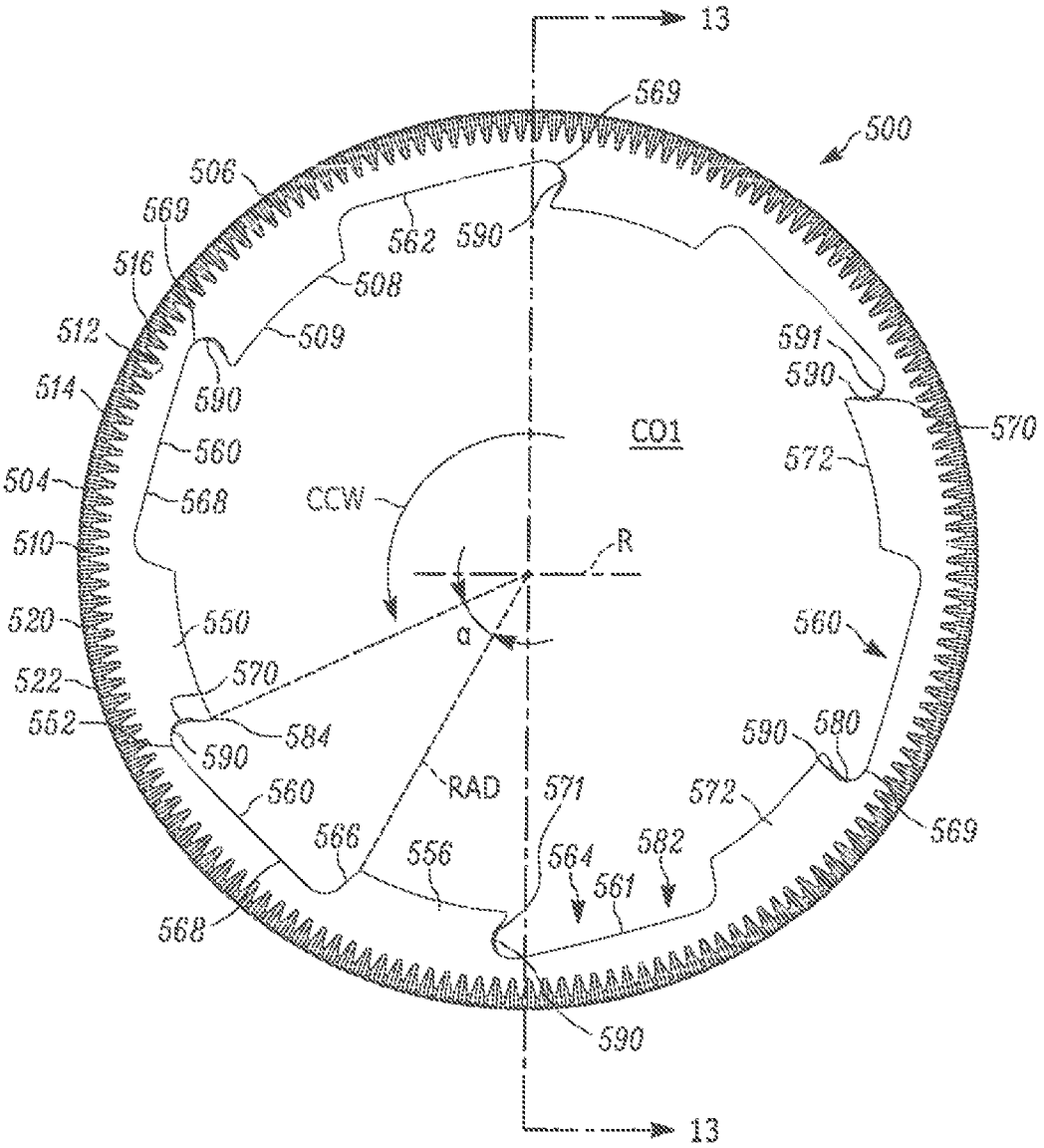
FIG. 11 is a schematic top plan view of the notched annular rotary knife blade of the head assembly of the power operated rotary knife of FIG. 1.
Figure 12:
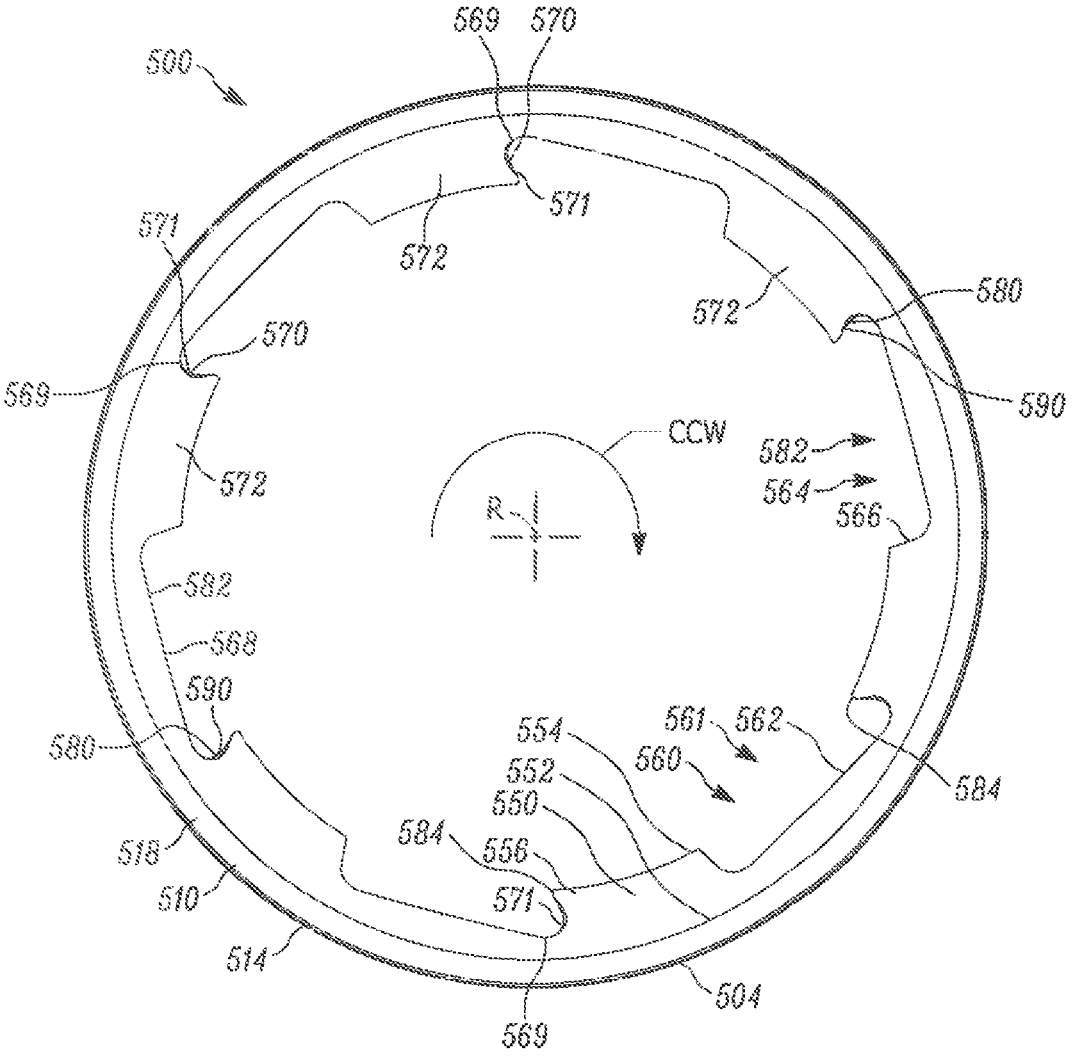
FIG. 12 is a schematic bottom plan view of the notched annular rotary knife blade of the head assembly of the power operated rotary knife of FIG. 1.
Figure 13:
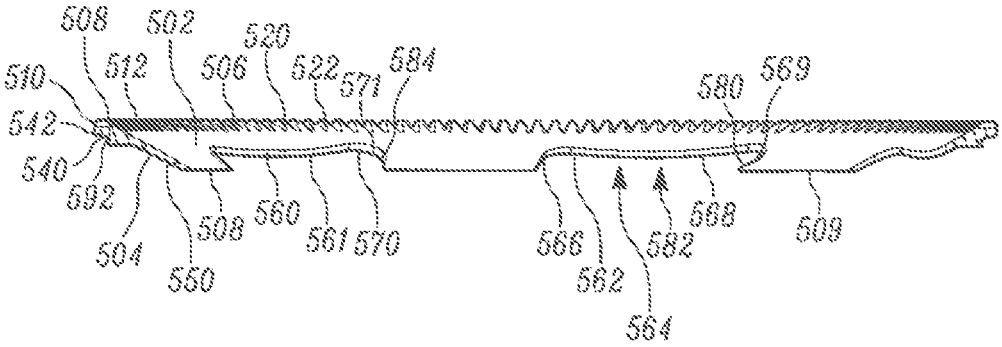
FIG. 13 is a schematic section view of the notched annular rotary knife blade of the head assembly of the power operated rotary knife of FIG. 1, as seen from a plane indicated by the line 13-13 in FIG. 11.
Figure 13A:
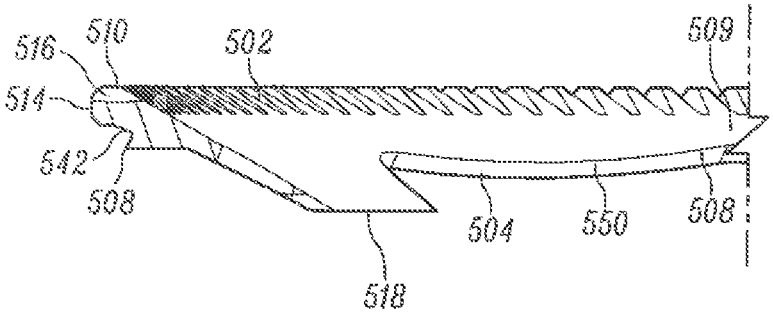
FIG. 13A is a schematic section view of an end portion of the notched annular rotary knife blade depicted in the section view of FIG. 13.
Figure 14:
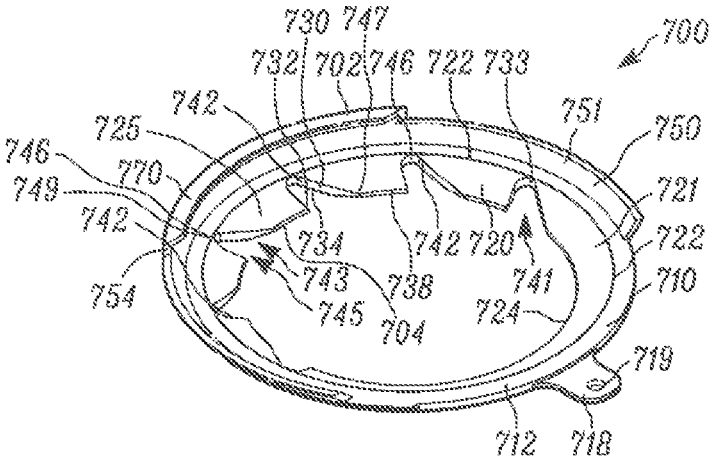
FIG. 14 is a schematic top, front perspective view of the notched trim guide of the head assembly of the power operated rotary knife of FIG. 1.
Figure 15:
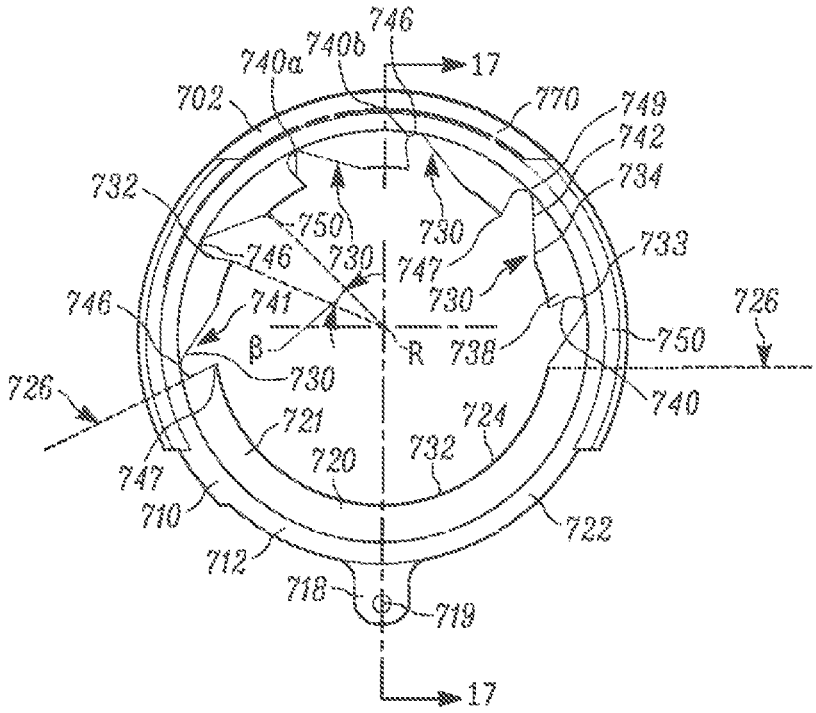
FIG. 15 is a schematic top plan view of the notched trim guide of the head assembly of the power operated rotary knife of FIG. 1.

The rotary knife blade 500 includes a blade section 550 that extends axially downwardly and radially inwardly from an annular body 510 of the blade 500. The blade section 550 extends between an upper end 552 and a lower end 554 and has a generally frustoconical shape. The lower end 554 of the blade section 550 defines a lower end 518 of the rotary knife blade 500. The blade section 550 includes a plurality of notches or notched regions 560 extending inwardly from a bottom or lower end 508 of the blade 500, that is, the lower end 554 of the blade section 550. Each of the plurality of notches 560 defines a recessed, arcuate cutting region or portion 580 of the rotary knife blade 500. Taken together, the recessed, arcuate cutting portions 580 defined by the plurality of notches 560 define a cutting edge 590 of the blade section 550. The plurality of notches 560 extend inwardly from a bottom end 554 of the blade section 550 of the rotary knife blade 500. The notches 560 include interior cutting regions which are recessed from the bottom end 554 of the blade section 550. For each of the plurality of notches 560, the arcuate cutting portion 580 of the notch 560 is disposed at a trailing end 570 of the notch 560 with respect to the direction of rotation CCW of the blade 500. In one exemplary embodiment of the rotary knife blade 500 of the present disclosure, the plurality of notches 560 are disposed in an evenly circumferentially spaced arrangement in the blade section 550 of the knife 500, as best seen in FIG. 11, and the number of notches 560 is six.

The coacting trim guide 700 includes a planar base 710 and a guide section 720 extending axially downwardly and radially inwardly from the base 710. The trim guide 700 is positioned and configured such that the guide section 720 extends below and is adjacent to the blade section 550 of the blade 500, substantially conforming to the generally frusto-conical shape of the blade section 550. The guide section 720 includes an upper end 722 and a lower end 724. The lower end 724 of the guide section 720 defines a lower end 704 of the trim guide 700. The guide section 720 includes a plurality of notches or notched regions 730 extending inwardly from a bottom or lower end 724 of the guide section 720, that is, the lower end 704 of the trim guide 700. Each of the plurality of notches 730 defines a recessed, shearing regions or portions 740 of the trim guide 700. For each of the plurality of notches 730, the shearing portion 740 of the notch 730 is disposed at a leading end of the notch 730 with respect to the direction of rotation CCW of the blade 550. The shearing portions 740 of the guide section notches 730 are in overlapping axial alignment with the arcuate cutting portions 580 of the blade section notches 560 as the rotary knife blade rotates about the central axis of rotation R. Stated another way, the stationary shearing portions 740 and the rotating cutting portions 580 create a shearing or scissors-like cutting action because they are in overlapping axial alignment as the rotary knife blade 100 rotates about its central axis of rotation R.

An extending distal portion 725 of the guide section 720 of the trim guide 700 extends axially below and radially inwardly of the lower end 504 of the rotary knife blade 500 to function as a guard to protect the blade 500 from inadvertent contact with the plastic mat or sheeting used between rows of plants or around the base of a plant to inhibit weed growth and/or protect plant roots. Additionally, the extending distal portion 725 of the guide section 720 advantageously functions to direct a branch or branches into an interior region 745 of one of the plurality of notches 730 as the knife 100 is moved by the operator in a direction orthogonal to the axis of rotation R of the rotary knife blade 500 to cut or trim a branch or branches. That is, the operator moves the knife 100 to position a branch or branches to be cut or trimmed within the central cutting opening CO defined by the rotary knife blade, blade housing, and trim guide combination 450. The operator then moves the knife 100 in a direction generally orthogonal to the blade axis of rotation R such that the branches are urged against the lower end 724 of the trim guide 700 and slide along a lower end 724 of the guide section 720 and move into the interior region 745 of one of the plurality of notches 730 of the guide section 720. Typically, the movement of the knife 100 is in the direction of the operator, that is, the operator pull the knife in a rearward or proximal direction RW (FIG. 1) toward himself or herself as the plurality of notches 730 are position toward a forward portion 726 of the guide section 720. Since the distal portion 725 extends beyond the lower end 504 of the blade, the uncut branch or branches can slide along a lower end 724 of the guide section 720 and move into the interior region 745 of one of the plurality of notches 730 of the guide section 720 as the operator pull the knife 100 toward himself or herself.

The trim guide 700 also includes a guard section 750 comprising a peripheral rib 751 which extends axially above and radially outwardly from the base 710. As can best be seen in FIG. 15, the rib 751 extends around most, but not all of the total annulus defined by the trim guide 700. Additionally, the guard section 550 includes a vertical extension 754 extending axially upwardly from an upper end 751*a* of the rib 751 and a lip 770 extending axially upwardly and radially inwardly from an upper end 754*a* of the vertical extension 754. The vertical extension 754 and the lip 770 subtend an angle less than an angle subtended by the rib 751. Both the rib 751, the vertical extension 754 and the lip 770 of the guard section 750 function as guards to protect the blade 500 from inadvertent contact with plastic mats, portions of plants that are not to be trimmed or cut, and the like.

Figure 16:
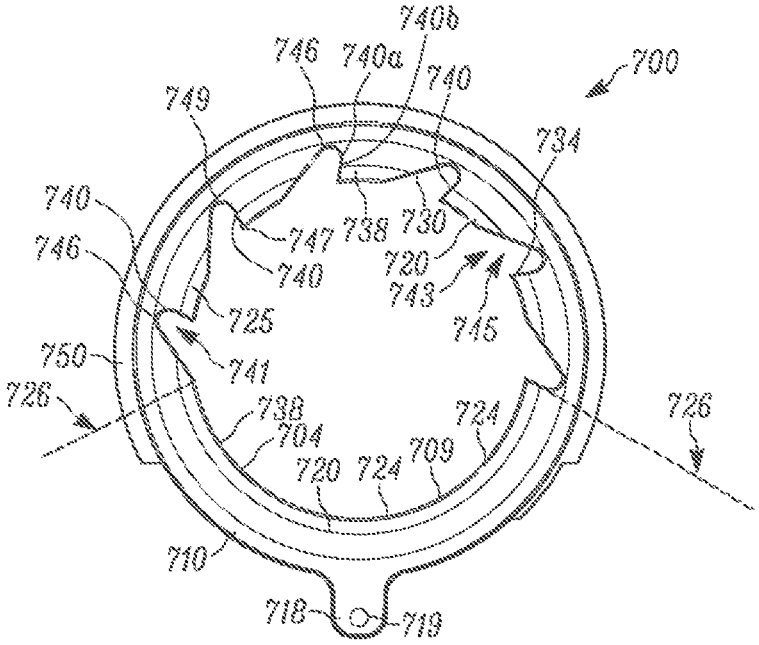
FIG. 16 is a schematic bottom plan view of the notched trim guide of the head assembly of the power operated rotary knife of FIG. 1.
Figure 17:
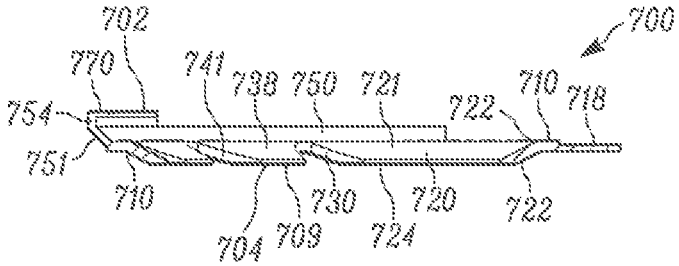
FIG. 17 is a schematic section view of the notched trim guide of the head assembly of the power operated rotary knife of FIG. 1, as seen from a plane indicated by the line 17-17 in FIG. 15.

In one exemplary embodiment of the trim guide 700 of the present disclosure, the plurality of notches 730 are disposed in a front or distal portion 726 of the guide section 720 of the trim guide 700, as can best be seen in FIG. 16, and the number of notches 730 is six, evenly spaced apart subtending just over 180 degrees of the total annulus defined by the trim guide 700.

The notches 730 of the trim guide 700 function to direct the plant branches to be cut into recessed shearing portions 740 defined by each of the plurality of notches 730 of the trim guide 700 wherein the recessed arcuate cutting portions 580 of the plurality of notches 560 of the rotary knife blade 500 cut the branches by shearing action as the blade 500 rotates with respect to the stationary trim guide700. To cut or trim a branch, the power operated rotary knife 100 is positioned with respect to a plant branch to be cut or trimmed such that the branch extends through the cutting opening CO defined by the power operated rotary knife 100, the operator then moves the knife 100 in a direction such that the branch is moved within the cutting opening CO and urged against the front or distal portion 725 of the guide section 720 of the trim guide 700. Depending on the position of the branch within the cutting opening CO, the movement of the rotary knife 100 by the operator will move the branch into one of the plurality of notches 730 of the trim guide guide section 720. A cutting portion 580 of the rotary knife blade 500 will impact the branch within the interior region 745 of the notch 730, cutting the branch by a shearing action between the shearing portion 740 of the trim guide notch 730 at the leading end 732 of the notch 730 and the cutting portion 580 of the blade section notch 560 at the trailing end 570 of the notch 560.

While the shearing action of the power operated rotary knife 100 has been described above with respect to trimming, pruning, cutting of plants and, specifically, strawberry plants, one of skill in the art will recognize that the power operated rotary knife 100 of the present disclosure can be advantageously used for any trimming/pruning/cutting task where a shearing-type cutting action between a rapidly rotating rotary knife blade 500 having, recessed sharpened, cutting portions 580, against a stationary trim guide 700, having recessing shearing portions 740, that functions to guide elements to be cut or trimmed into position for cutting by the recessed, sharpened cutting portions 580 of the rotary knife blade 500. In one exemplary embodiment of the power operated rotary knife 100 of the present disclosure, an outer diameter of the rotary knife blade 500 is approximately 5.09 in. and the blade configuration is a so-called flat blade configuration meaning the blade has a shallow blade cutting profile, as opposed to, for example, a hook blade configuration or a straight blade configuration. As would be understood by one of skill in the art, the configuration and size of the rotary knife blade 500 may vary depending on the elements/branches to be cut, trimmed or pruned. The present disclosure contemplates the use of alternate blade sizes and configurations and corresponding different diameters/sizes and configurations for the trim guide 700 in the power operated rotary knife 100.

Handle Assembly 200

The power operated rotary knife 100 of the present disclosure includes the head assembly 300 having an elongated handle assembly releasably affixed thereto. As can best be seen in FIGS. 1-3, the handle assembly 200 extends along a longitudinal axis LA. The handle assembly 200 includes a hand piece 210 defining an exterior gripping surface 212 adapted to be gripped by an operator of the power operated knife 100 when wielding and manipulating the knife 100. The hand piece 210 includes the central throughbore defined by an inner surface 224 of the hand piece 210. The handle assembly throughbore is coaxial with the longitudinal axis LA and is aligned with a throughbore of a throughbore 312 of a frame or frame housing/body 310 of the head assembly.

The handle assembly 200 further includes a drive shaft latching assembly 280. The shaft drive latching assembly 280 releasably secures a flexible shaft drive assembly (not shown) of the drive mechanism 400 to the handle assembly 200 such that motive power may be applied to drive a drive or gear train 402 disposed in the throughbore 312 of the frame 310 and thereby rotate the rotary knife blade 300. In one exemplary embodiment, the gear train 402 comprises a pinion gear 404 which is rotated by the flexible shaft drive assembly and, in turn, rotates the rotary knife blade 500. The shaft drive latching assembly 280 includes a latching knob 282 secured to a proximal end 214 of the hand piece 210 and a latching member 284 for releasably securing a coupling of the shaft drive assembly to the handle assembly 200.

The latching knob 282 of the drive shaft latching assembly 280 threads onto a threaded end section (not shown) of the frame tube (not shown) extending from the frame body 310. When the latching knob 282 is threaded onto the threaded proximal end section of the frame tube, the hand piece 210 is thereby sandwiched and secured to the rearward annular boss 350 of the frame body 310.

Head Assembly 300

Figure 4:
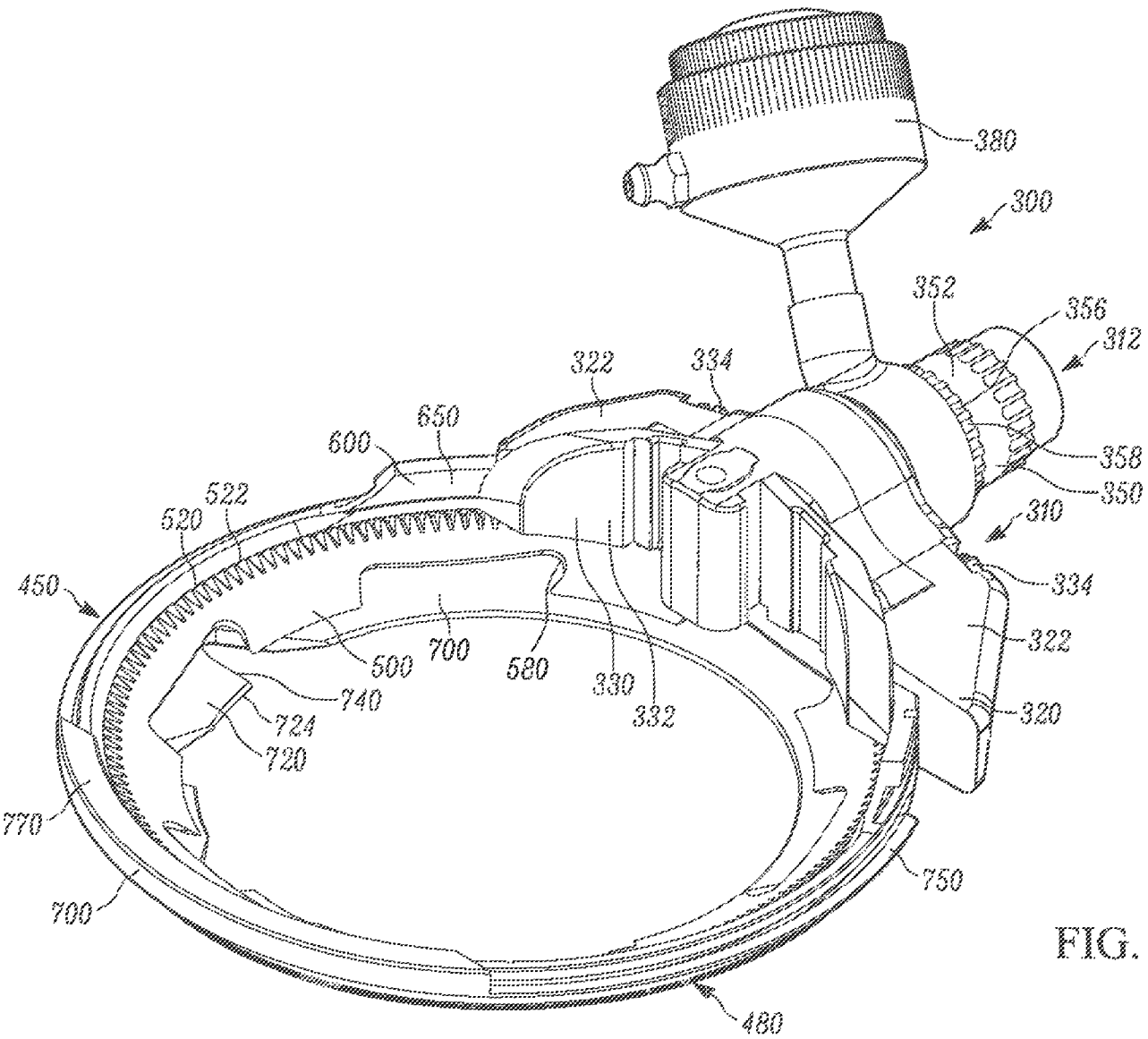
FIG. 4 is a schematic top, front perspective view of the head assembly of the power operated rotary knife of FIG. 1, including a frame, the notched annular rotary knife blade, a blade housing, and the notched trim guide and with a pivoting thumbpiece assembly removed for clarity.
Figure 5:
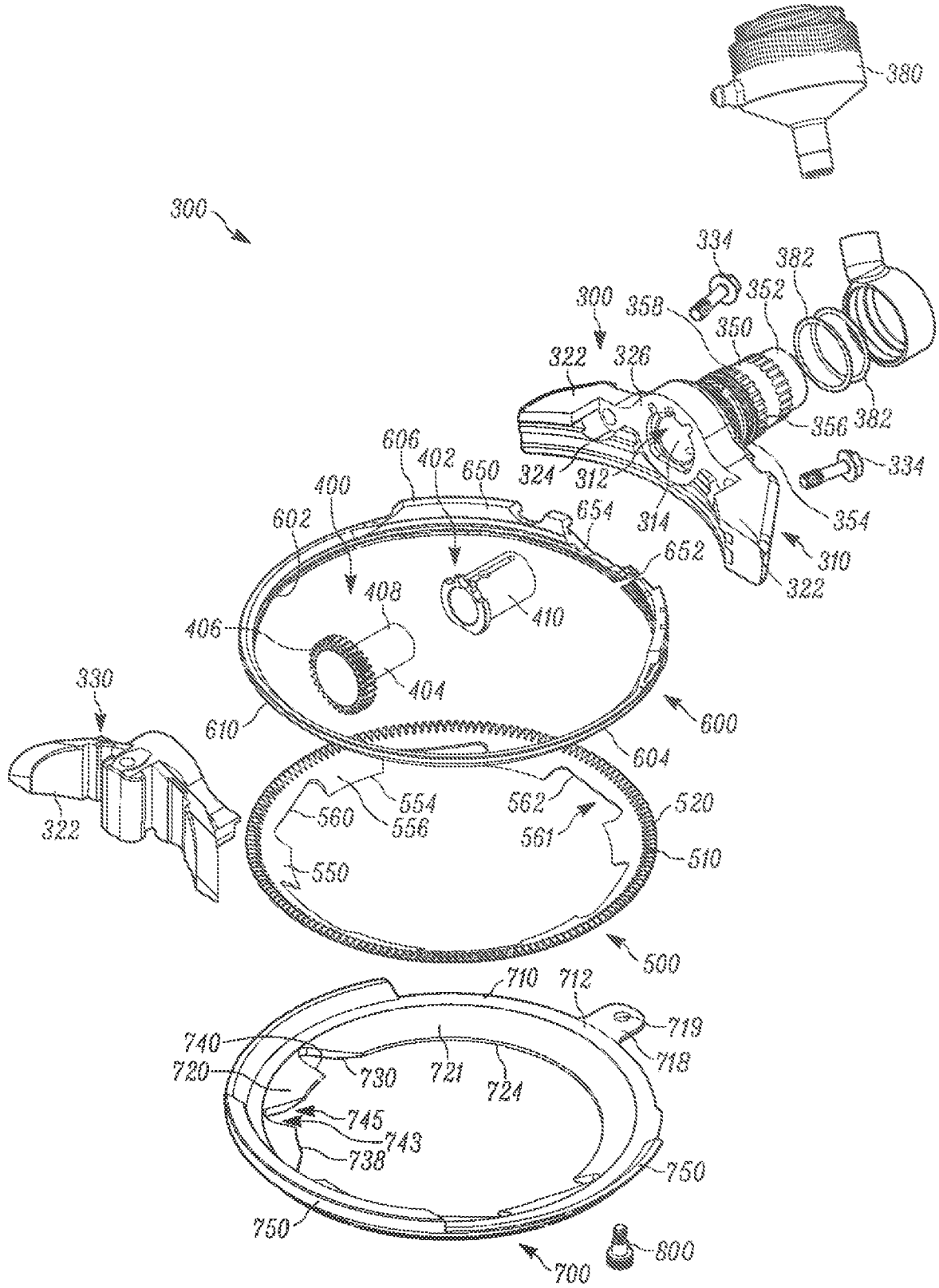
FIG. 5 is a schematic exploded top, front perspective view of the head assembly of FIG. 4.
Figure 6:
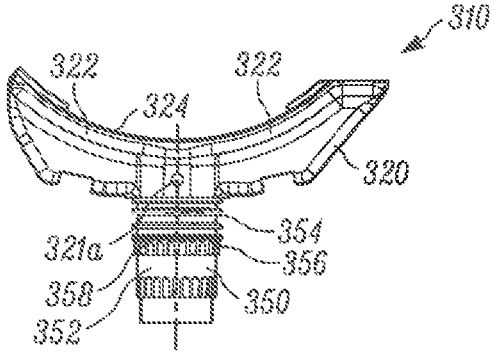
FIG. 6 is a schematic bottom plan view of the frame of the head assembly of FIG. 4.
Figure 7:
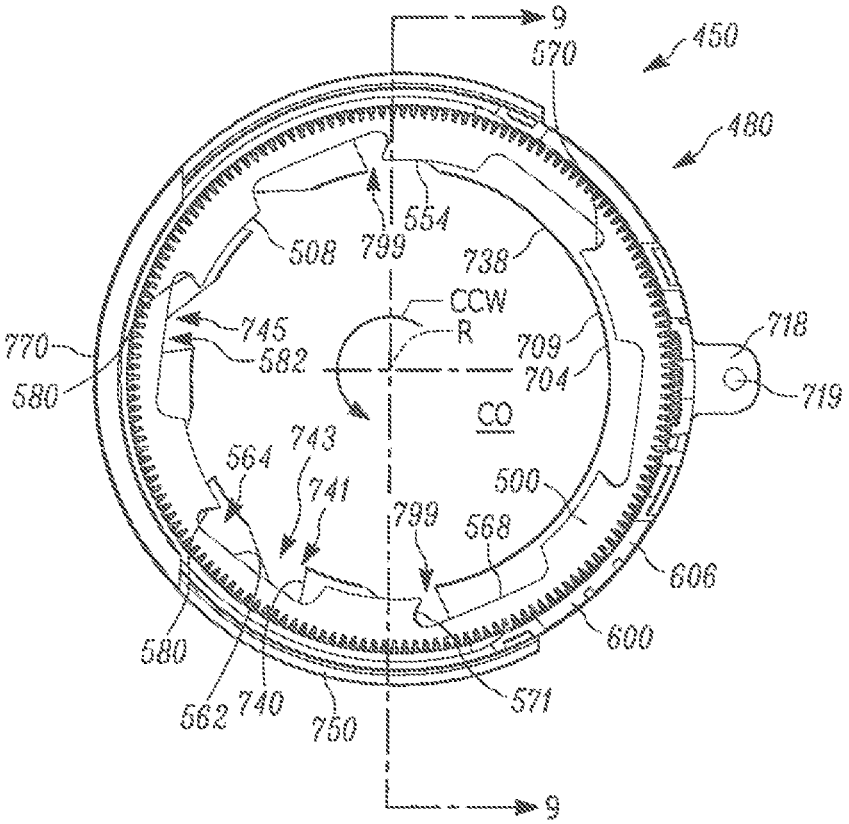
FIG. 7 is a schematic top plan view of a combination of the notched annular rotary knife blade, the blade housing, and the notched trim guide of the head assembly of the power operated rotary knife of FIG. 1.
Figure 8:
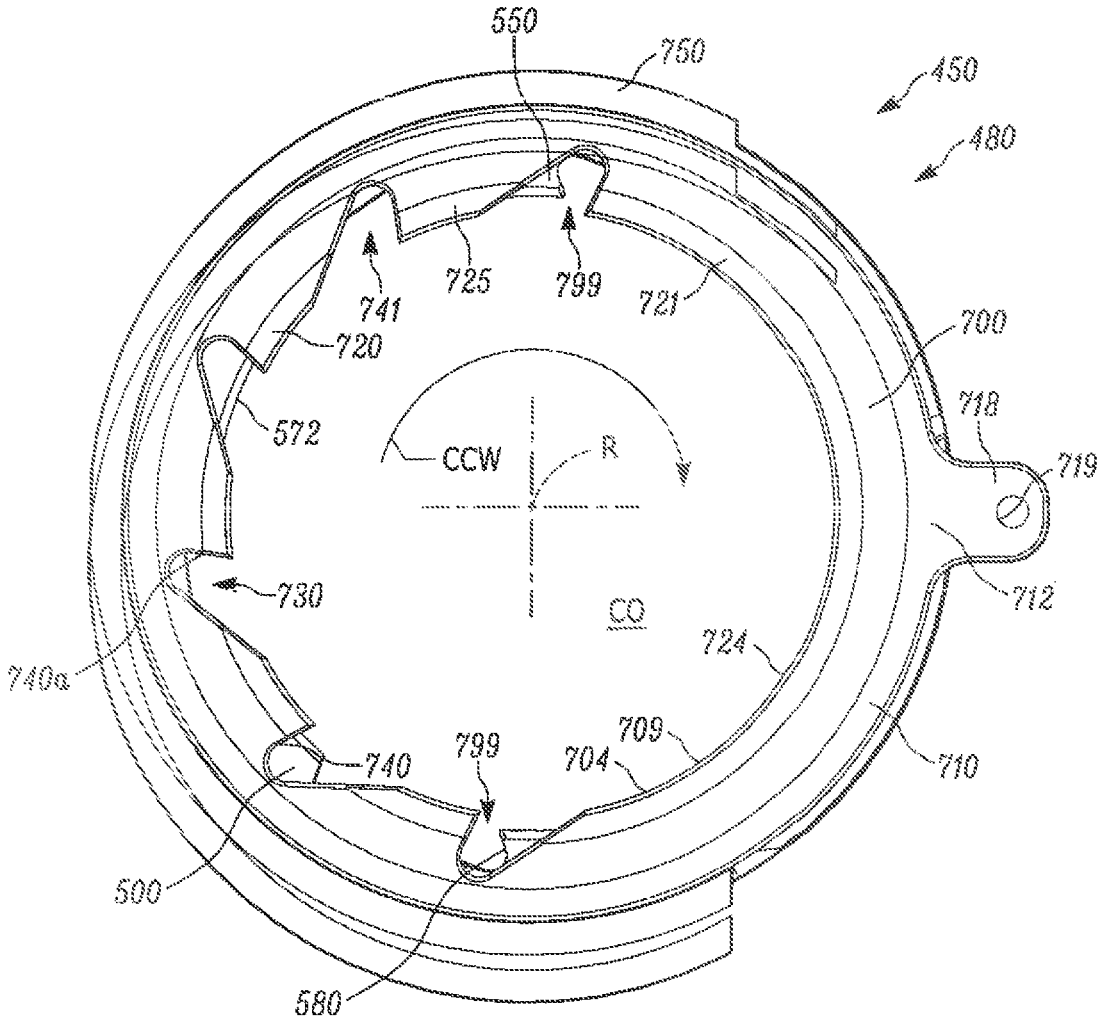
FIG. 8 is a schematic bottom plan view of the combination of the notched annular rotary knife blade, the blade housing, and the notched trim guide of the head assembly of the power operated rotary knife of FIG. 1.

The power operated rotary knife 100 includes a handle assembly 200 and the head assembly 300 releasably affixed to the handle assembly 200. As can best be seen in FIGS. 4-6, the head assembly 300 includes the frame housing or frame 310, a clamping assembly 330, the rotary knife blade 500, the blade housing 600 and the trim guide 700. The rotary knife blade 500 is supported for rotation about the axis of rotation R by the blade housing 600. The blade housing 600 defines a rotational plane RP of the rotary knife blade 500. The blade housing 600, in turn, is releasably affixed to the frame body 310 by a cover or clamp 332 of the clamp assembly 330. As is best seen in FIGS. 6-8, the frame body 310 also supports the drive mechanism 400 of the power operated rotary knife 100. In one exemplary embodiment, the frame body 310 includes the longitudinally extending, central throughbore 312 which supports the gear train 402 of the drive mechanism 400. Specifically, the gear train 402 includes a pinion gear 4604 and an input shaft of the pinion gear 404 is supported for rotation within a cylindrical bushing 410 positioned within a front portion 314 of the throughbore 312. The pinion gear 404 is precisely positioned and oriented by the frame body 310 such that a gear head 406 of the pinion gear meshes with a driven gear 520, namely, set of gear teeth 522 formed at the upper end 516 of the annular body 510 of the of the rotary knife blade 500 to rotate the knife blade 580 within the blade housing 600.

Frame Body 310

The frame body 310 includes a forward or distal blade housing support region 320 and a rearward annular boss 350. The forward blade support region 320 includes a pair of outwardly extending arcuate arms 322 which define a blade housing mounting region 324 for receiving an arcuate mounting section 650 of the blade housing 600 and a clamping receiving region 326 for receiving the proximal wall of the clamp 332 of the clamping assembly 330. The clamp 332 is secured to the frame body 310 by a pair of threaded fasteners 334 that extend through respective openings in the arcuate arms 322 of the frame body 310. The arcuate mounting section 392 of the blade housing 390 is sandwiched between the forward blade housing support region 320 and the clamp 332 to releasably secure the blade housing 600 to the frame body 310.

In one exemplary embodiment, the rearward annular boss 350 of the frame body 310 includes an inner surface defining a rear portion of the central throughbore 312. The rear portion of the central throughbore 312 includes a threaded section. A frame tube (not shown) threads into and is affixed to the threaded section of the rearward annular boss 350. The frame tube (not shown) extends rearwardly though a central throughbore of a hand piece 210 of the handle assembly 200 and includes a threaded proximal end section. An outer surface 352 of the rearward annular boss 350 includes a first region 354, closest to the forward blade support region 320, and a middle region 356. The first region 354 includes a pair of exterior grooves on the outer surface 352 that receives a pair of sealing members 382 of the grease cup assembly 380. The middle region 356 includes a plurality of raised splines 358 and is sized to receive an annular mounting ring 392 of the pivoting thumb support 390. If desired and depending on operator preference, the pivoting thumb support 390 may be removed from the power operated rotary knife 100 and the knife 100 may be used without the thumb support 390. In such an alternate exemplary embodiment, the annular mounting ring 392 is replaced with an annular spacer ring (not shown) which is sized to fit on the plurality of raised splines 358 of the rearward annular boss 350 of the frame 310. Specific details of the structure and function of the pivoting thumb support 390, the grease cup assembly 380 and attachment structure of the handle assembly 200 to the head assembly 300 are found in U.S. Published Application No. US2014/0259690 to Mascari et al., published Sep. 18, 2014 and U.S. Published Application No. US2014/0250697 to Steele et al., published Sep. 11, 2014, issued as U.S. Pat. No. 9,321,183 on Apr. 26, 2016. Both U.S. Published Application No. US2014/0259690 and U.S. Published Application No. US2014/0250697 are assigned to the assignee of the present invention and both of the aforesaid published applications are incorporated herein in their respective entireties by reference.

Drive Mechanism 400

The drive mechanism 400 of the power operated rotary knife 100 includes the drive train 402 supported within the central throughbore 312 of the frame body 310. In one exemplary embodiment, the drive train 402 includes the pinion gear 404. The input shaft 408 of the pinion gear 404 is supported for rotation by the cylindrical bushing 410 positioned within the front portion of the throughbore 412. A drive coupling of a flexible shaft drive transmission (not shown), driven by a remote motor drive (not shown), extends through a throughbore of the hand piece 210 of the handle assembly 200 and engages a female coupling defined by the pinion gear input shaft 408 to rotate the pinion gear 404. The gear head 406 of the pinion gear 404 operatively engages the set of gear teeth of the rotary knife blade 500 to rotate the knife blade 500 within the blade housing 600.

As mentioned above, in one exemplary embodiment, the drive mechanism 400 of the power operated rotary knife 100 may comprise a remote motor drive and a flexible shaft drive transmission which transfers rotational power from the motor drive to rotate a drive train 1550 of the power operated rotary knife 1000. The flexible shaft drive transmission includes a driver assembly which is received in a central, longitudinally extending throughbore of the handle assembly 200 to rotatably drive the drive train 402 of the drive mechanism 400. Such a drive mechanism, including a remote motor drive and flexible shaft drive transmission and driver assembly, are disclosed in U.S. Pat. No. 8,968,107 to Rapp et al., issued Mar. 3, 2015 and U.S. Published Application No. US2013/0174424 to Whited et al., published Jul. 11, 2013, issued as U.S. Pat. No. 9,265,263 on Feb. 23, 2016, both of which are assigned to the assignee of the present invention. Both U.S. Pat. No. 8,968,107 and U.S. Published Application No. US2013/0174424 are incorporated herein in their respective entireties by reference. In an alternate exemplary embodiment of the power operated rotary knife of the present disclosure, the drive mechanism 400 may include a pneumatic motor (not shown) disposed within the throughbore of the handle assembly 200. An output shaft and coupling of the pneumatic motor are operatively coupled to the female coupling defined by the pinion gear input shaft 408 to rotate the pinion gear 404. Such a pneumatic drive mechanism is disclosed in U.S. Pat. No. 7,207,114 to Rosu et al., issued Apr. 24, 2007 and U.S. Pat. No. 8,756,819 to Whited et al., issued Jun. 24, 2014, both of which are assigned to the assignee of the present invention. Both U.S. Pat. Nos. 7,207,114 and 8,756,819 are incorporated herein in their respective entireties by reference.

Blade Housing 600

Figure 18:
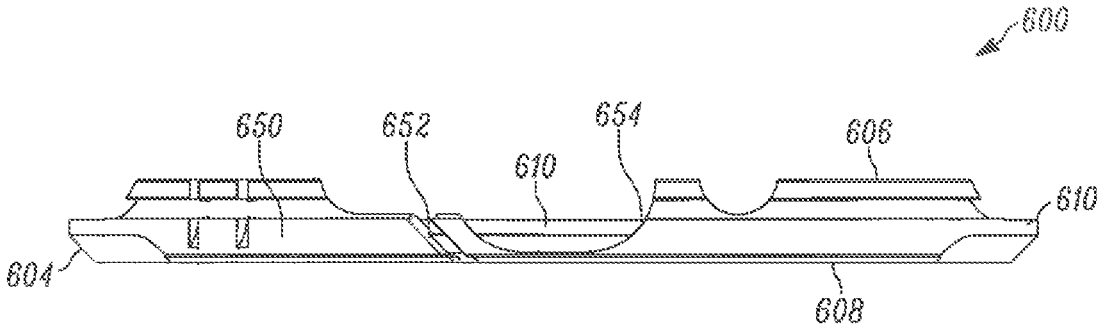
FIG. 18 is a schematic front elevation view of the blade housing of the head assembly of the power operated rotary knife of FIG. 1.
Figure 19:
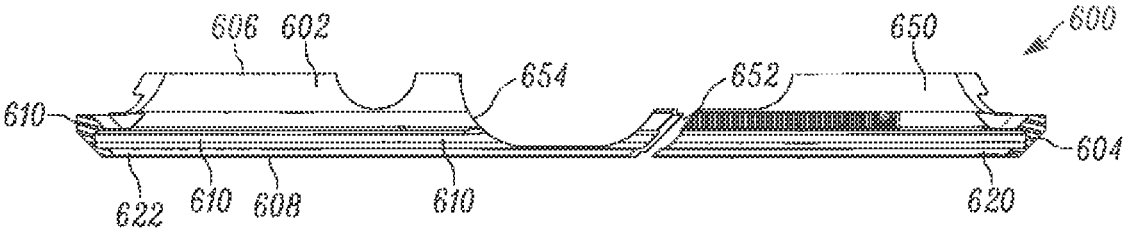
FIG. 19 is a schematic section view of the blade housing of the head assembly of the power operated rotary knife of FIG. 1.

The rotary knife blade 500 (FIGS. 10-13) is supported for rotation about a central axis of rotation R by the annular blade housing 600 (FIGS. 18-19). The blade housing includes a split, annularly curved blade support section 610 that surrounds and supports the rotary knife blade 500 about the entire 360 degree circumference of the blade 500 and a mounting section 650 extending axially from the blade support section 610 and provides a mounting structure for releasably mounting the blade 500 and blade housing 600 to the blade housing mounting region 324 of the frame body 310. The blade housing includes an inner wall 602 and an outer wall 604 and an upper end 606 and a lower end 608. Adjacent the lower end 608, the inner wall 602 defines a bearing surface 620, which in one exemplary embodiment is a radially inwardly protruding bearing bead 622, extending from an inner wall 602 of the blade housing 600. The blade housing bearing bead 622 extends into a generally V-shaped opening or bearing race 540 formed in and extending radially into an outer wall of the 514 of an annular body 510 of the rotary knife blade 500 to support the blade for rotation. The blade bearing race 540 comprises two axially spaced apart, generally frustoconical, bearing faces 542 which bear against the blade housing bead 622 to support the blade both axially and radially. The bearing support structure of the bearing bead 622 of the blade housing 600 and the bearing race 540 of the rotary knife blade 500 define the rotational plane RP of the rotary knife blade 500, which is substantially orthogonal to the blade central axis of rotation R.

The mounting section 650 of the blade housing 600 includes an angled split 652 and a pinion clearance region 654. The pinion clearance region 654 of the blade housing mounting section 650 provides for clearance for the gear head 406 of the pinion gear 404 of the drive mechanism drive train 402. The angled split 652 of the mounting section 650 is circumferentially offset from the pinion clearance region 654 and provides for expansion of the blade housing diameter for purposes of changing the rotary knife blade 500 when the blade has reached the end of its useful life. Specific details regarding an annular blade housing with an angle split and offset pinion clearance region are disclosed in U.S. Pat. No. 8,661,692 to Whited et al., issued Mar. 4, 2014. U.S. Pat. No. 8,661,692 is assigned to the assignee of the present invention and is incorporated herein in its entirety by reference.

Figure 9:
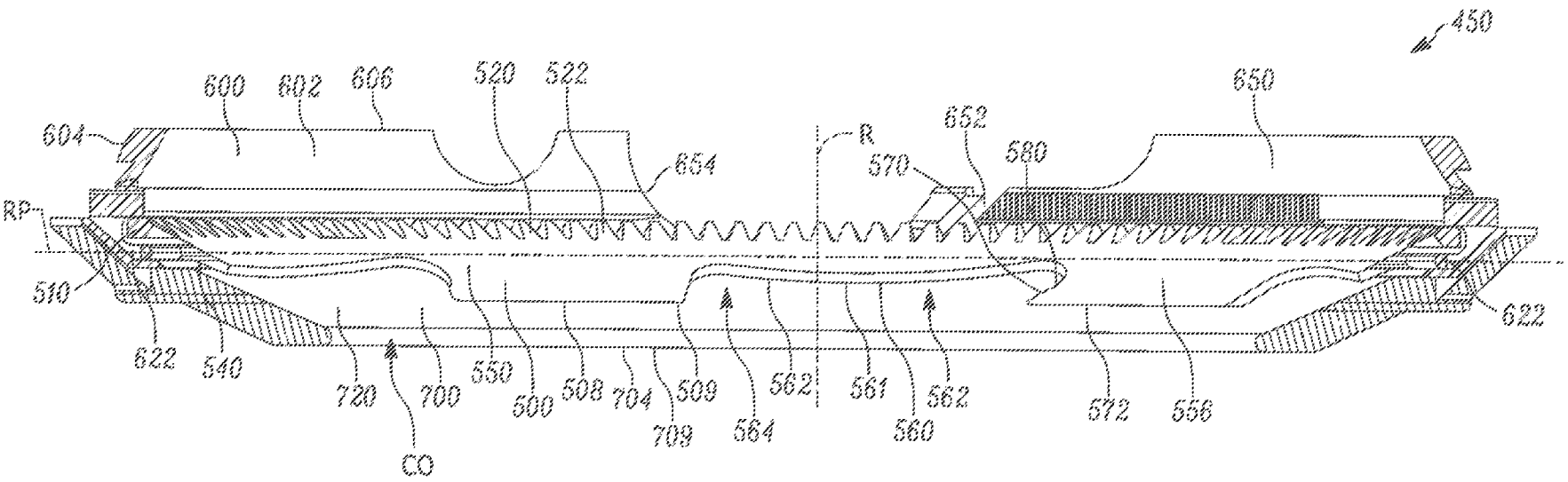
FIG. 9 is a schematic section view of the combination of the notched annular rotary knife blade, the blade housing, and the notched trim guide of the head assembly of the power operated rotary knife of FIG. 1, as seen from a plane indicated by the line 9-9 in FIG. 7.
Figure 10:
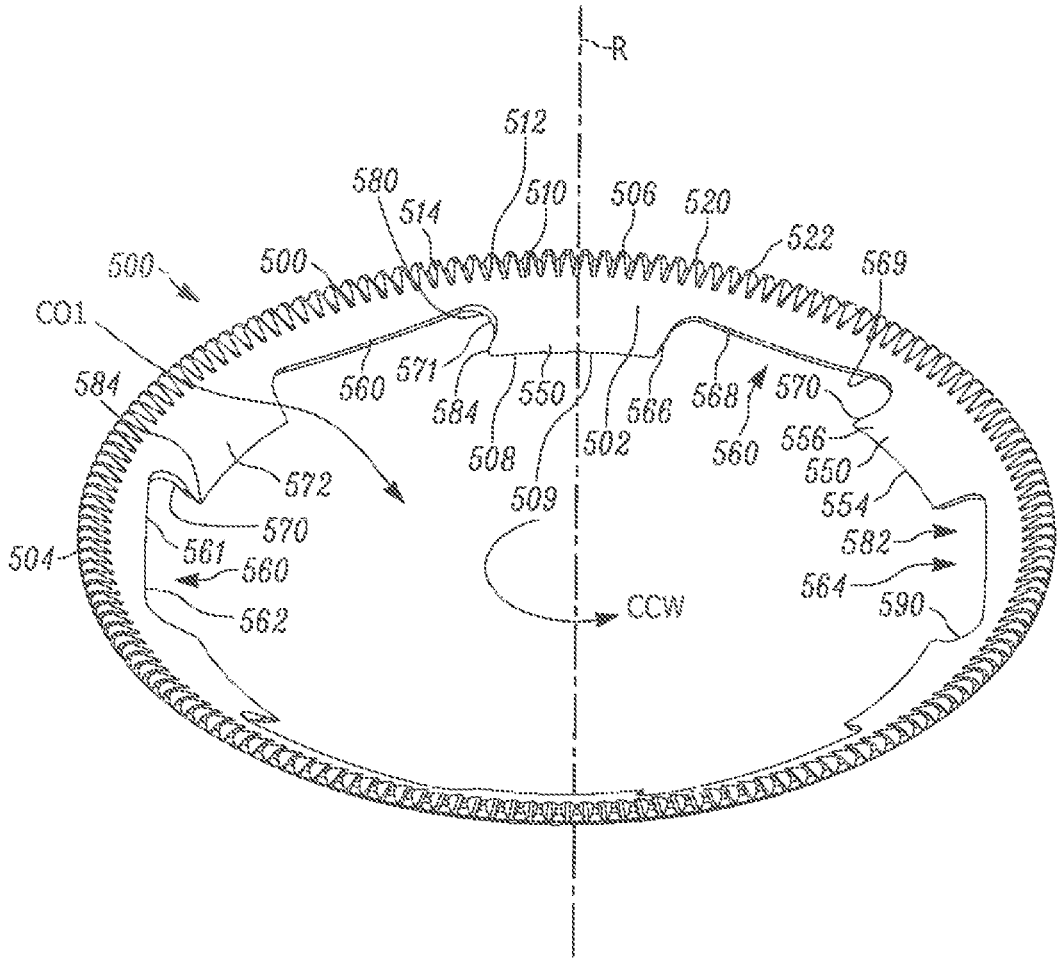
FIG. 10 is a schematic top, front perspective view of the notched annular rotary knife blade of the head assembly of the power operated rotary knife of FIG. 1.

The rotary knife blade 500, the blade housing 600, and the trim guide 700, are all annular and, when assembled, define an overlapping sandwiched combination 450, as shown in FIGS. 7-9, wherein the blade housing blade support section 610 is radially sandwiched between, on the radial inside, the annular body 510 of the rotary knife blade 500 and, on the radial outside, by the rib 751 of the guard section 750 of the trim guide 700.

Rotary Knife Blade 500

The rotary knife blade 500 of the power operated rotary knife 100 includes an inner wall 502 and a radially spaced apart outer wall 504 and an upper end 506 and an axially spaced apart lower or bottom end 508. The inner wall 502 defines a central opening of the blade 500. The blade 500 includes the annular body 510 which defines an inner wall 512 (defining part of the inner wall 502 of the blade 500), an outer wall 514 (defining part of the outer wall 504 of the blade 500), an upper end 516 (defining the upper end 506 of the blade 500) and a lower end 518. The rotary knife blade 500 further includes the blade section 550 extending axially downwardly and radially inwardly (toward the blade axis of rotation R) from the lower end 518 of the annular body 510. The blade section 550 includes upper end 552 adjacent the annular body lower end 518 and a lower end 554 (defining the lower end 508 of the blade 500) and a generally frustoconical wall 556 extending therebetween.

The upper end 516 of the annular body 510, as mentioned above, defines the driven gear 520 of the blade 500. The driven gear 520 comprises a set of gear teeth formed in a circumference adjacent the outer wall 514 of the annular body. Adjacent the lower end 518 of the annular body, the blade bearing race 540 defining frustoconical bearing surfaces 542 is formed in the outer wall 514 of the annular body, as described above.

The lower end 554 of the blade section 550 includes a plurality interrupted arc portions 572 that define a lower edge 509 of the blade 500. The interrupted arc portions 572 are centered about the blade central axis of rotation R and, if connected and continued, would form a circle defining an inner diameter of the blade 500 with a center on the axis of rotation R. Typically, the interrupted arc portions 572 would define a cutting edge of the blade, but, in the rotary knife 500 of the present disclosure, the cutting edge 590 of the blade are defined by the recessed, arcuate cutting portions 580 within the plurality of notches 560. Interrupting the arc portions 572 are the plurality of notches 560 formed at the lower end 554 of the frustoconical wall 556 of the blade section 550 and extending into the frustoconical wall 556. As can best be seen in FIG. 11, each of the notches of the plurality of notches 560, when viewed in top plan view, defines a generally rectangular cavity 561 defined by a peripheral wall 562 surrounding a central open portion 564 and defining the cavity 561. The peripheral wall 562, when viewed with respect to the counterclockwise direction of rotation CCW (FIG. 7) of the rotary knife blade 500, includes an angled leading portion or end 566, a generally linear central portion 568, and a hook-shaped or U-shaped trailing portion or end 570.

The trailing end 570 of the peripheral wall 562 includes an arcuate sharpened region 571 extending approximately from a transition segment 569 of the peripheral wall 562 bridging the linear central portion 568 and the trailing end 570 to a termination point 584 of the trailing end 570 located at the bottom edge 509 of the blade 500, as defined by the start of the next interrupted arc portion 572. The arcuate sharpened regions 571 may extend to the bottom edge 509 of the blade 500 or be in close proximity to the bottom edge. Both are contemplated by the present disclosure. The arcuate sharpened regions 571 are concave (like the inside of a bowl) in that they are curving in or hollowed inwardly due to the hook-shape of the trailing end 570 of the peripheral wall 562. The arcuate sharpened regions 571 of the plurality of notches 560 define the respective recessed arcuate cutting regions or portions 580 of the blade 500. The arcuate cutting portions 580 are recessed in that at least a portion of the arcuate sharpened region 571 is within an interior region 582 (that is, the central open portion 564) defined by each of the plurality of notches 560. It should be appreciated of course that the arcuate cutting portions 580 (and the associated sharpened regions 571), instead of being arcuate (by virtue of the hook-shaped trailing end 570 of the peripheral wall 562), could be linear or convex and the present disclose contemplates such an alternate embodiment. In one exemplary embodiment of the rotary knife blade 500, an inner diameter of the blade 500, as defined by the interrupted arc portions 572 constituting the lower edge 509 of the blade 500, is approximately 4.0 in., while the outside diameter of the blade, defined by the radial outermost extent of the outer wall 514 of the annular body 510 of the blade is approximately 5.092 in. In one exemplary embodiment, a thickness of the interrupted arc portions 572 is approximately 0.038 in. Additionally, in one exemplary embodiment, the number notches in the plurality of notches 560 is six, each of which is spaced equidistantly about an inner perimeter or inner diameter of the blade 500, each of the notches subtending an angle $\alpha$ (depicted schematically in FIG. 11) with respect to the central axis of rotation R of approximately 35°.

Trim Guide 700

The trim guide 700, which is stationary with respect to the rotation of the blade 500, includes an upper end 702 and a lower end 704 and defines the planar base 710, the guide section 720 extending axially below and radially inwardly from the base 710, and the guard section 750, including the upwardly extending rib 751, the vertical extension 754 and the radially inwardly extending lip 770, as previously described. The base 710 includes an attachment tab 718 extending from a rearward portion 712 of the base 710. The tab 718 includes an aperture 719. The trim guide 700 is releasably affixed to a bottom surface 321 of the blade housing support region 320 of the frame body 310 by a threaded fastener 800 that extends through the tab aperture 719 and threads into a threaded opening 321*a* of the bottom surface 321 of the blade housing support region 320 of the frame body 310.

The guide section 720 of the trim guide 700 includes an upper end 722 and a lower end 724 and defines a guide section frustoconical wall 721. The frustoconical wall 721 extends along the frustoconical wall 556 of the blade section 550. As described above, the extending distal portion 725 of guide section 720 extends axially below and radially inwardly beyond the lower edge 509 of the rotary knife blade 500 and has two functions: 1) to direct a branch or branches into an interior region 745 defined by one of the plurality of notches 730 as the knife 100 is moved by the operator to cut or trim a branch or branches within the central cutting opening CO of the knife 100; and 2) to guard the blade 500 from inadvertent contact with the ground or plastic mats or sheets positioned on the ground between rows of plants.

In the forward portion 726 of the guide section 720 are the plurality of notches 730 formed the lower end 724 and extending into the frustoconical wall 721. The lower end 724 of the guide section 720 also includes interrupted arc portions 738 that define a lower edge 709 of the trim guide 700. The interrupted arc portions 738 are centered about the blade central axis of rotation R and, if connected and continued, would form a circle defining an inner diameter of the trim guide 700 with a center on the axis of rotation R. Interrupting the arc portions 738 in the forward portion 726 of the guide section 720 are the plurality of notches 730 formed at the lower end 724 of the frustoconical wall 721 of the guide section 720 and extending into the frustoconical wall 721. As can best be seen in FIG. 15, each of the notches of the plurality of notches 730, when viewed in top plan view, defines a generally slanted, concave U-shaped cavity 741 defined by a peripheral wall 742 surrounding a central open portion 743 (the interior region 745) and defining the cavity 741. The peripheral wall 742, when viewed with respect to the counterclockwise direction of rotation CCW of the rotary knife blade 500, includes an angled leading portion or end 732, a generally linear central portion 733, and an angled trailing portion or end 734.

For each of the plurality of notches 730, the leading end 734 of the peripheral wall 742 defines a shearing region or portion 740 extending approximately from a termination point 747 of the notch 730 at the lower end 724 of the guide section 720 where the next adjacent interrupted arc portion 738 commences and extending to a radially innermost point 746 (FIG. 16) of the peripheral wall 742. Or, stated another way, the shearing region or portion 740 extends from the termination point 747 of the notch 730 to a radially innermost point 749 (FIG. 16) of the notch 730, which corresponds to the radially innermost point 746 of the peripheral wall 742. When viewed in top plan view, the shearing portions 740 defined by the leading ends 734 of the respective plurality of notches 730 define a linear segment 740*a* (FIG. 15) over most of their extent moving radially inwardly from the lower end 724 of the guide section 720 and then transition into a shorter arcuate segment 740*b* as the innermost point 746 of the peripheral wall 742 is approached. The shearing portions 740 of the plurality of notches 730 of the trim guide 700 are recessed in that at least a portion of the shearing portion 740 is within an interior region 745 (that is, the central open portion 743) defined by each of the plurality of notches 730.

As explained above, the cutting action of the knife 100 occurs through the combination 480 of the rotating rotary knife blade 500 and the stationary trim guide 700. As the blade 500 rotates about its central axis of rotation R, the shearing portions 740 of the guide section notches 730 come into overlapping axial alignment with the arcuate cutting portions 580 of the blade section notches 560. Additionally, the central open portion 564 or interior region 582 of each of the plurality of notches 560 of the blade section 550 of the rotary knife blade 500 come into overlapping axial alignment with the central open portion 743 or interior region 745 of each of the plurality of notches 730 as the blade 500 rotates about the axis of rotation R. This transitory overlapping alignment of the central open portions 564, 743 or interior regions 582, 745 define transitory cutting pockets 799 (two of which can be seen in FIG. 7). The uncut branch or branches directed into a transitory pocket 799 by the guide section 720 of the trim guide 700, that is, guided into a trim guide notch 730, will be rapidly and efficiently cut by the shearing action of the rotating cutting portions 580 of the blade 500 passing over the stationary shearing portions 740 of the trim guide 700 as the rotary knife blade 500 continues its high speed rotation in the counterclockwise direction CCW. The cutting pockets 799 are transitory in that as the blade 500 continues to rotate about its axis of rotation R, the blade 500 rotates with respect to the stationary trim guide 700. Thus, as would be understood, new cutting pockets 799 are formed by overlapping interior regions 582, 745 and then disappear as cutting of the branch or branches with the cutting pockets 799 occurs by shearing action by virtue of the rotating cutting portions 580 of the blade 500 passing over the stationary shearing portions 740 of the trim guide 700. Thus, as the blade 500 rotates about the central axis of rotation R, new cutting pockets 799 are constantly formed and old cutting pockets 799 disappear as cutting occurs and branches in the cutting pockets are cut by shearing action.

In one exemplary embodiment of the trim guide 700, an inner diameter of the trim guide 700, as defined by the interrupted arc portions 738 constituting the lower edge 709 of the trim guide 700, is approximately 3.809 in., while a diameter defined by a radially innermost point of each of the plurality of notches 730 of the guide section 720 is approximately 4.631 in. Additionally, in one exemplary embodiment, the number notches in the plurality of notches 730 is six, each of the notches subtending an angle β (depicted schematically in FIG. 15) with respect to the central axis of rotation R of approximately 20°.

Annular, as used herein, means generally ring-like or generally ring-shaped in configuration and includes configuration wherein the ring include or does not include a split extending through a diameter of the ring or annulus. Axially above or axially spaced above, as used herein, means positioned above as viewed with respect to an axis, for example, the central axis of rotation R of the rotary knife blade 500, even if the two elements are not in axial alignment with respect to the axis. Similarly, the terms axially below or axially spaced below, as used herein, means positioned below as viewed with respect to an axis, for example, the central axis of rotation R of the rotary knife blade 500, even if the two elements are not in axial alignment with respect to the axis. Axially extending, as used here, means one element extends from and is positioned above or below a second element with respect to an axis, even if the two elements are not in axial alignment with respect to the axis. Similarly, the terms radially offset from, radially outward of, radially inward of, as used herein, means one element is positioned offset from a second element, as viewed along a radius line extending radially from an axis, for example, the central axis of rotation R of the rotary knife blade 500, even if the two elements are not in radial alignment along the radius line because one element is axially above or axially below the other element Second Exemplary Embodiment—Power Operated Rotary Knife Assembly 1000

Figure 20:
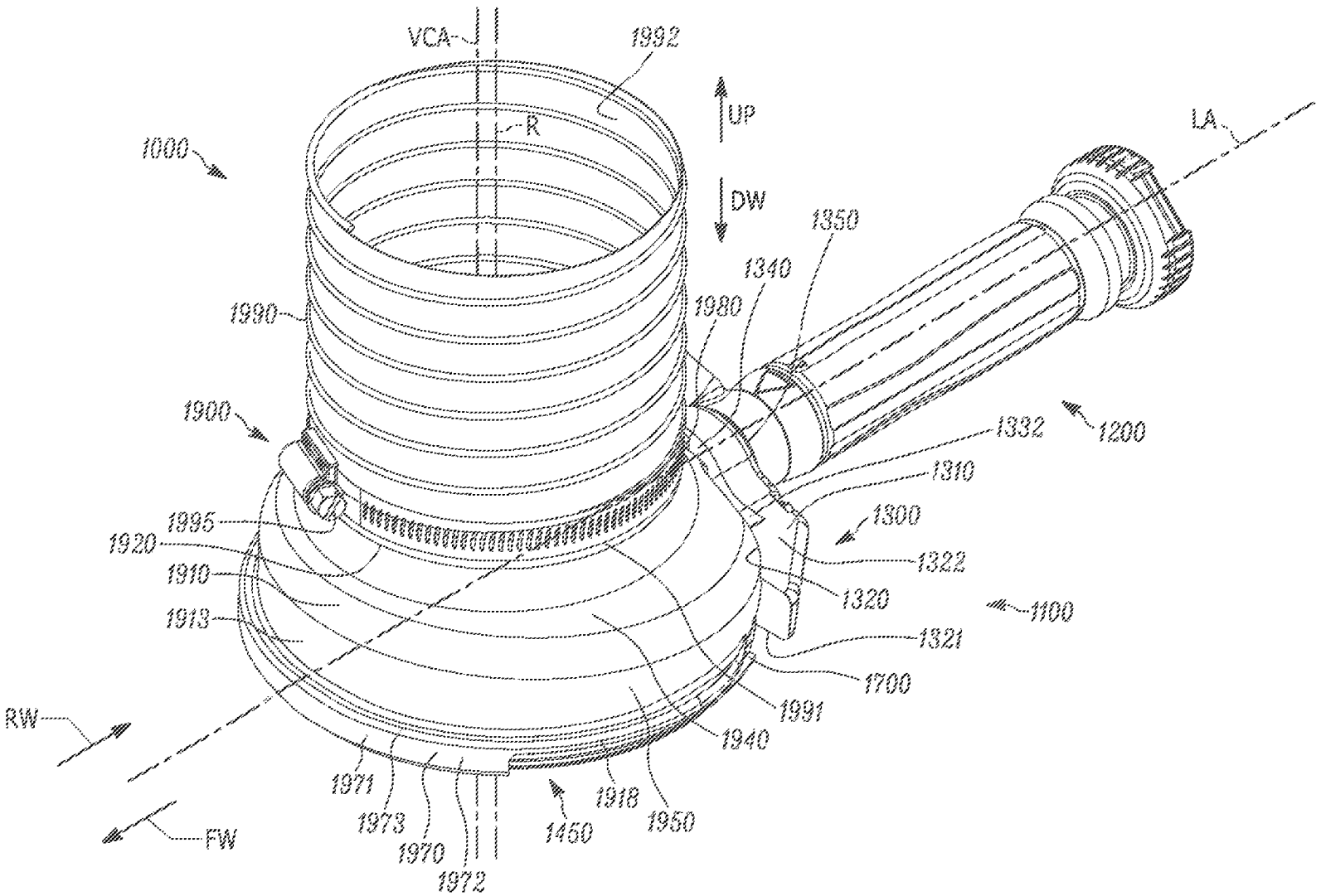
FIG. 20 is a schematic top front perspective view of a second exemplary embodiment of a power operated rotary knife assembly of the present disclosure including a power operated rotary knife and a vacuum assembly, the power operated rotary knife including a handle assembly, a head assembly, including a notched annular rotary knife blade, a blade housing, a notched trim guide, and a vacuum connector, the vacuum assembly including the vacuum connector and a vacuum hose coupled to the vacuum connector.
Figure 21:
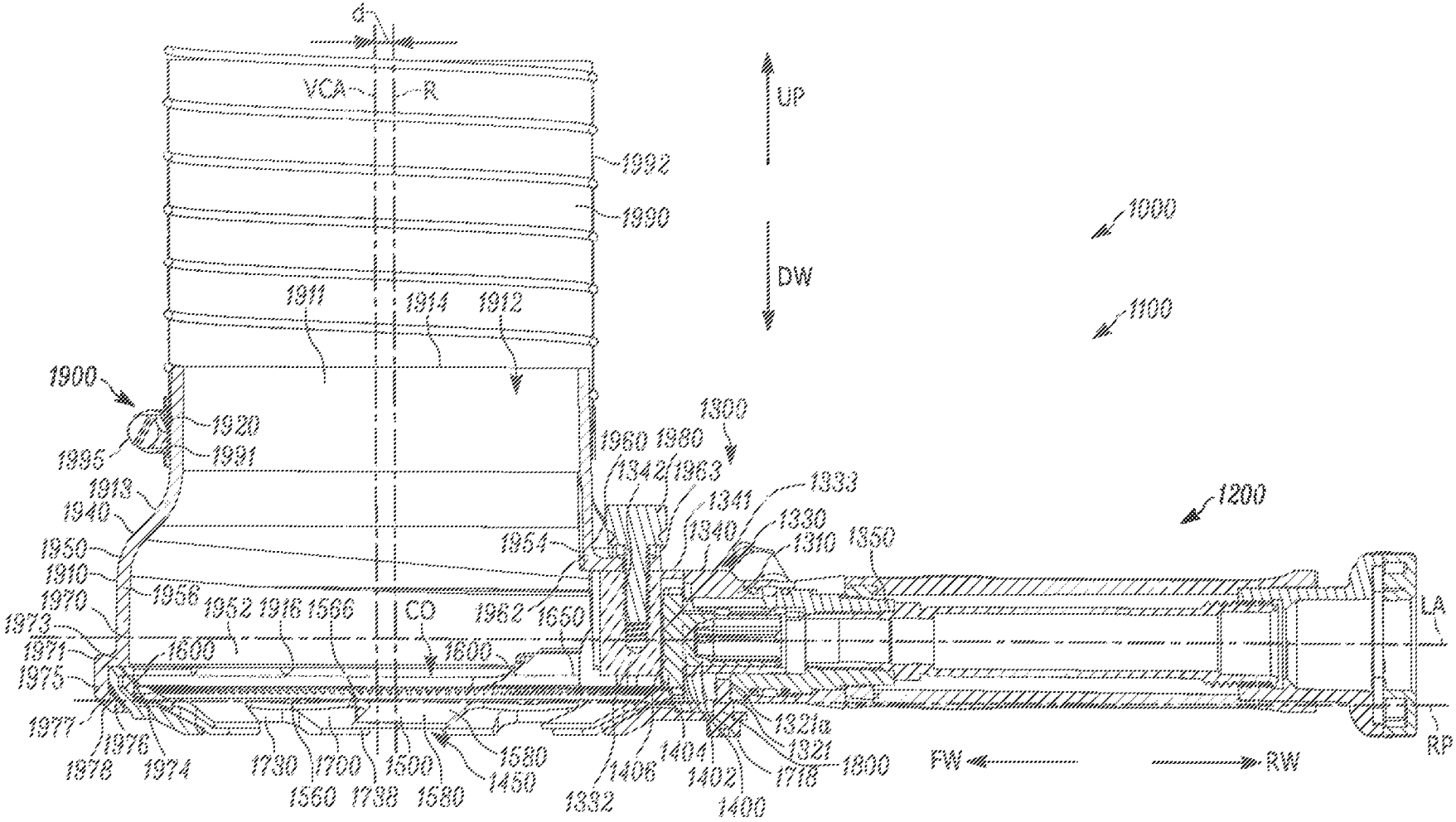
FIG. 21 is a schematic longitudinal section view of the power operated rotary knife assembly of FIG. 20.
Figure 22:
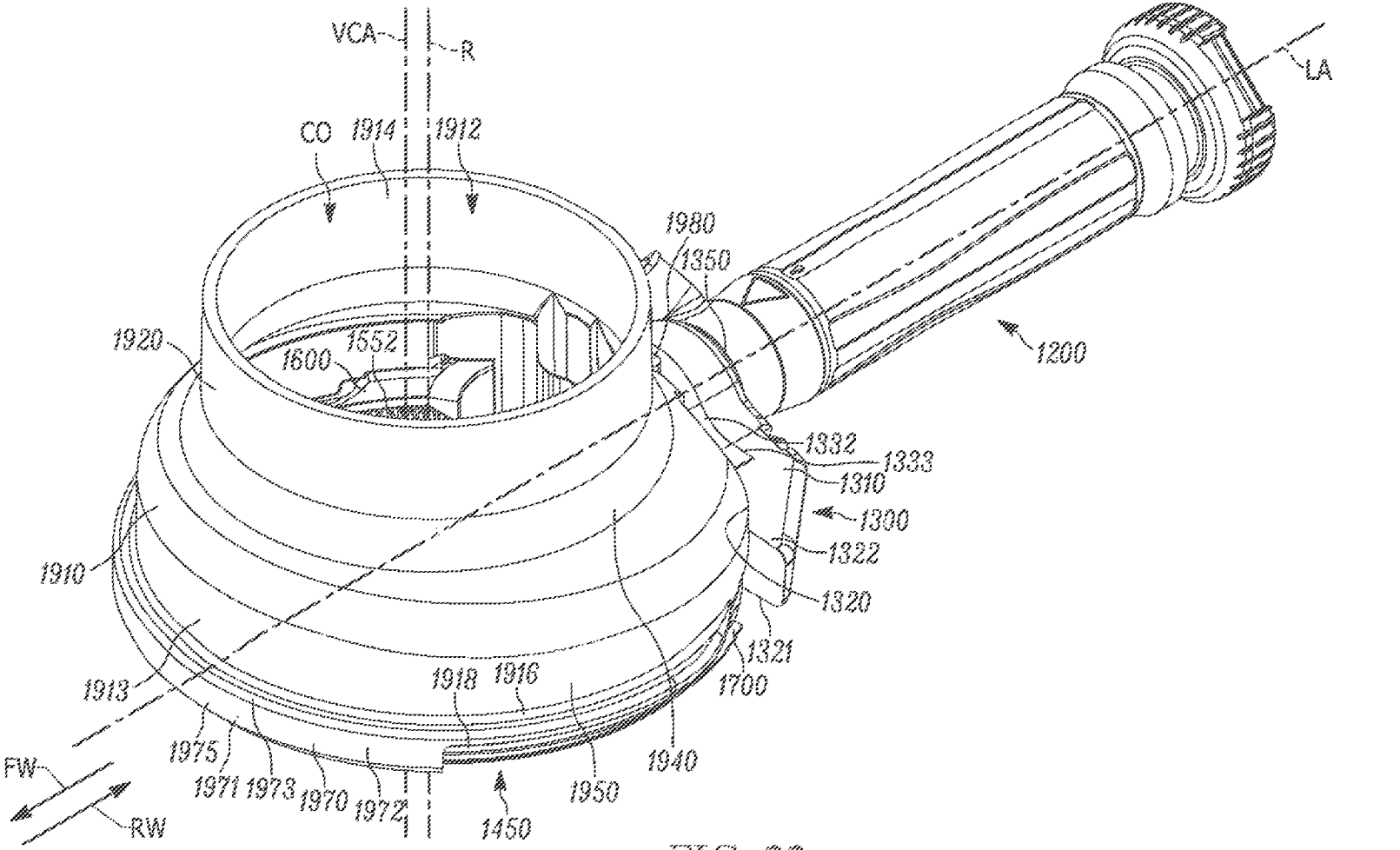
FIG. 22 is a schematic top front perspective view of the power operated rotary knife of FIG. 20, the vacuum hose of the vacuum assembly being removed for clarity purposes.
Figure 23:
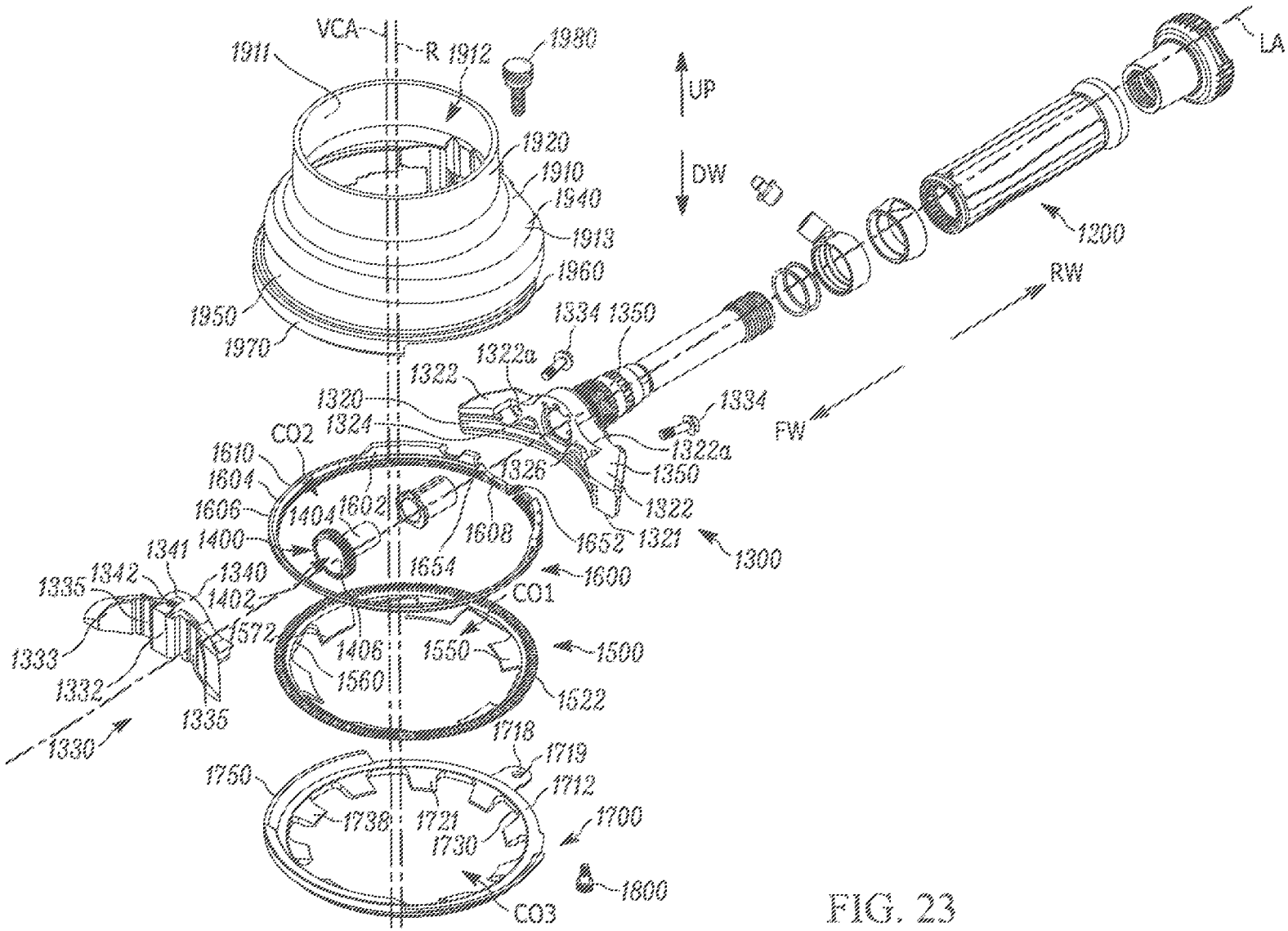
FIG. 23 is a schematic exploded perspective view of the power operated rotary knife of FIG. 22.
Figure 24:
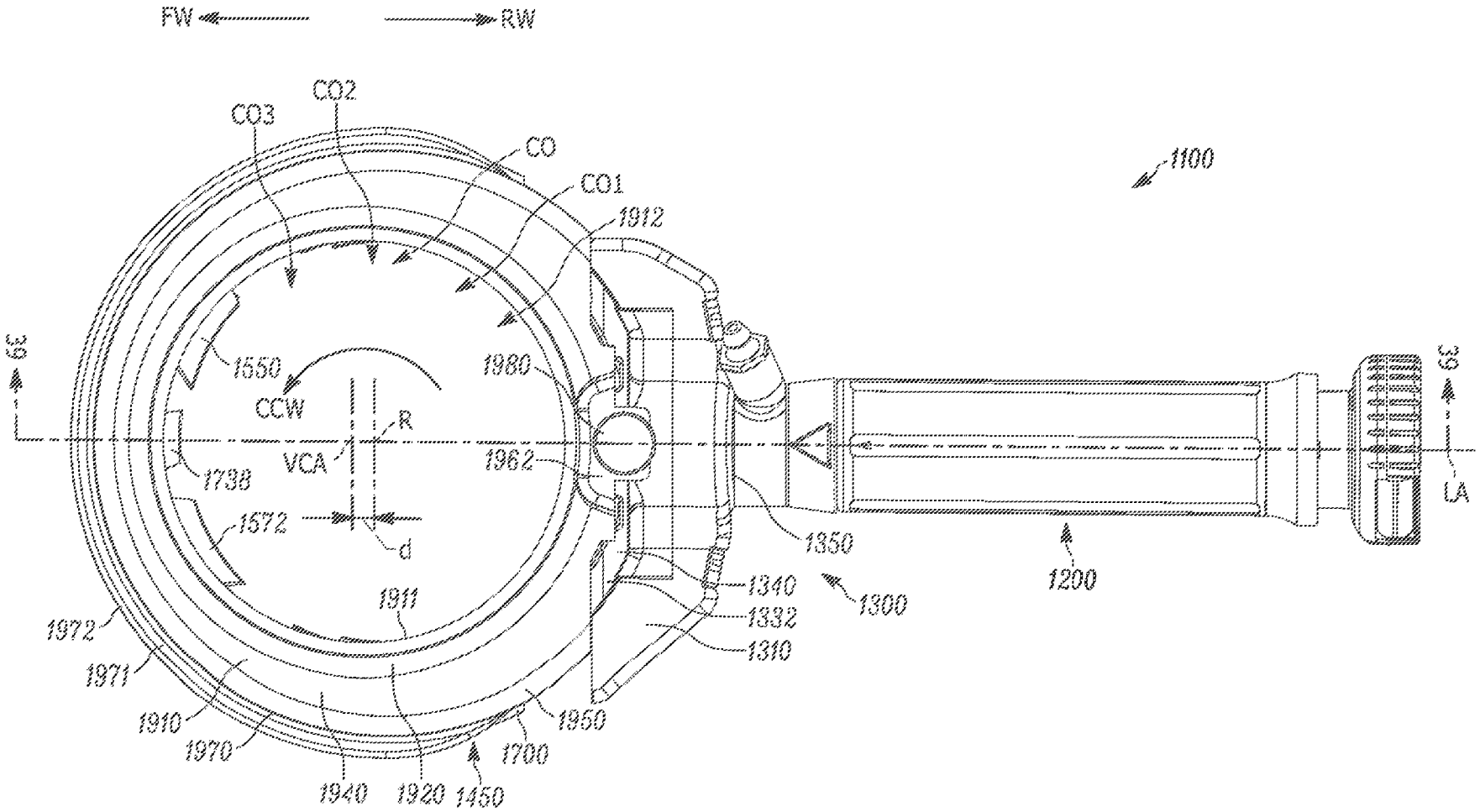
FIG. 24 is a schematic top plan view of the power operated rotary knife of FIG. 22.
Figure 25:
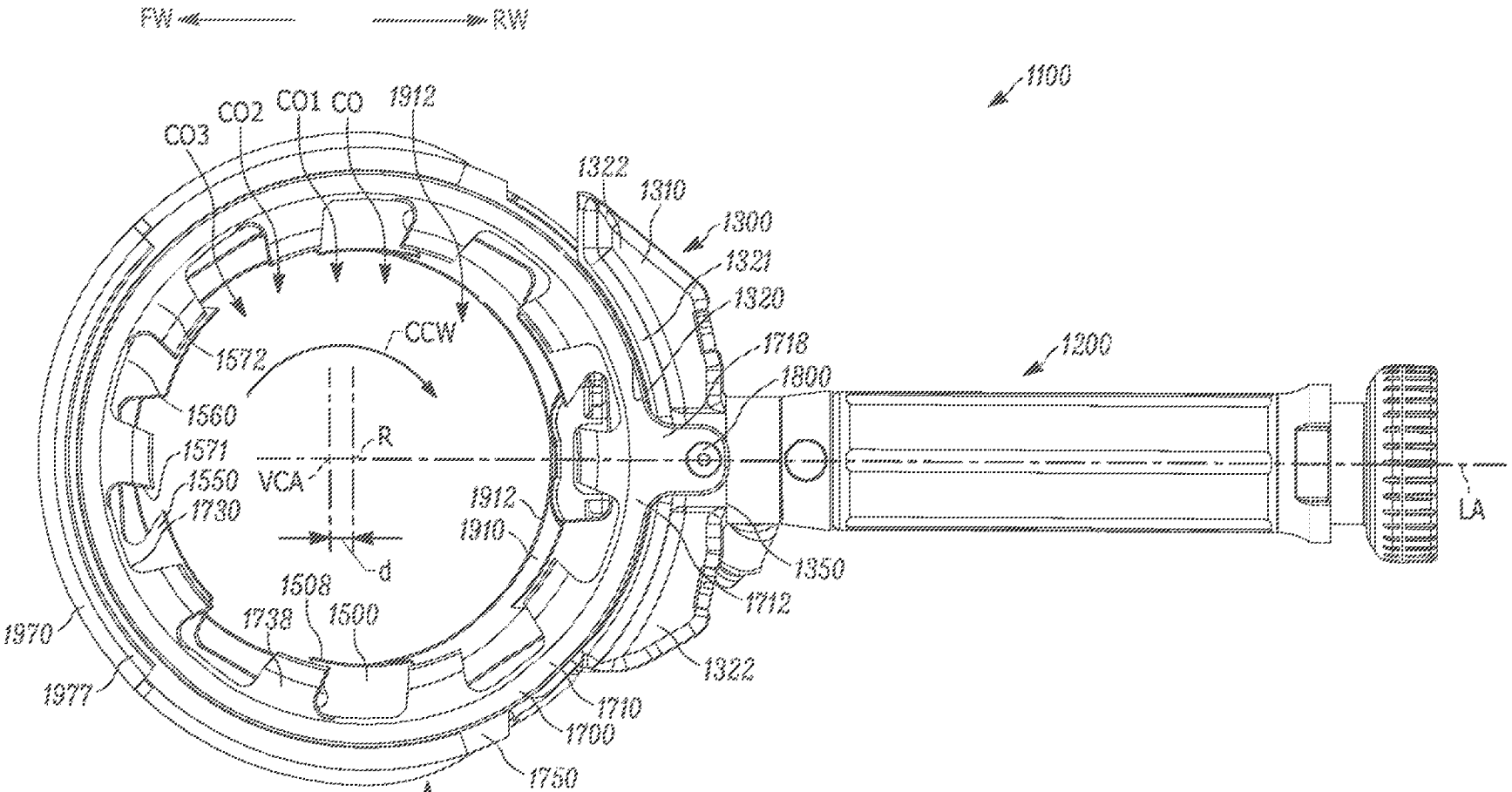
FIG. 25 is a schematic bottom plan view of the power operated rotary knife of FIG. 22.

A second exemplary embodiment of a power operated rotary knife assembly of the present disclosure is schematically shown, generally at 1000, in FIGS. 20-21. The power operated rotary knife assembly 1000 includes a power operated rotary knife 1100, generally similar in structure and function to the power operated rotary knife 100 of the first exemplary embodiment, and a vacuum assembly 1900. The power operated rotary knife 1100 is best seen in the schematic depictions of FIGS. 22-25, wherein a vacuum hose 1990 of the vacuum assembly 1900 has been removed for clarity. Advantageously, the vacuum assembly 1900 functions to remove, by vacuum suction, cut or trimmed materials (cut elements/branches) from the cutting opening CO of the power operated rotary knife 1100. The vacuum assembly 1900 (depicted schematically in FIGS. 20 and 21) expeditiously and efficiently removes trimmed branch materials from the cutting opening or cutting region CO (best seen in FIGS. 26 and 27) and, thus, away from the plant being trimmed, keeping the plant and the plant bed areas clean and free from trimmed branch materials is advantageous from a horticultural point of view. Leaving trimmed materials on the remaining branches of the plant or leaving trimmed materials to decay on the ground in the plant bed area is unsightly and potentially could lead to plant disease and/or insect infestation problems.

For brevity, the structural details/functions/advantages of those components and assemblies of the power operated rotary knife 1100 which are similar to the corresponding components and assemblies of the power operated rotary knife 100 will not be repeated in detail, all of the structural details/functions/advantages discussed above with respect to the power operated rotary knife 100 are hereby incorporated by reference with respect to the second exemplary embodiment. Explanations regarding the description of the power operated rotary knife 100, set forth above, are also hereby incorporated by reference with respect to the second exemplary embodiment. Common reference numbers and letters used in the two embodiments are assumed to represent similar concepts and/or structural details.

As best seen in FIGS. 22-25, the power operated rotary knife 1100 includes an elongated handle assembly 1200 extending and centered about a handle assembly longitudinal axis LA, similar to the handle assembly 200 of the power operated rotary knife 100 of the first exemplary embodiment, and a head assembly 1300, similar to the head assembly 300 of the power operated rotary knife 100. The head assembly 1300 includes a notched annular rotary knife blade 1500 supported for rotation about a central axis of rotation R by the split blade housing 1600, similar in operation and structure to the rotary knife blade 500 and blade housing 600 of the power operated rotary knife 100. Additionally, as with rotary knife blade 500 and the trim guide 700 of the power operated rotary knife 100, cutting and trimming of branches for the power operated rotary knife 1100 is accomplished by the shearing action of the rotating rotary knife blade 1500 and a notched stationary trim guide 1700. The configuration of the rotary knife blade 1500 and the trim guide 1700 are generally the same as the counterpart rotary knife blade 500 and trim guide 700 of the power operated rotary knife100. The structure differences of the rotary knife blade 1500 and the trim guide 1700 from their counterparts of the first exemplary embodiment are explained below.

The head assembly 1300 (FIG. 23) further includes a frame body 1310, similar to the frame body 310 of the power operated rotary knife 100, including a forward blade housing support region 1320 and a rearwardly extending annular boss 1350 and a clamping assembly 1330, similar to the clamping assembly 330 of the power operated rotary knife 100. As shown in FIGS. 20 and 21, the directions forward FW and rearward RW are generally along and with respect to the handle assembly longitudinal axis LA and the directions up UP and down DW are generally along and with respect to the rotary knife blade axis of rotation R. The clamping assembly 1330 includes an arcuate clamp 1332 secured to the frame body 1310 by a pair of threaded fasteners 1334 that extend through respective horizontally oriented openings 1322*a* of a pair of outwardly extending arcuate arms 1322 of the frame body 1310 and thread into respective threaded openings in a proximal wall 1333 of the clamp 1332. The clamping assembly 1330 functions to secure a split blade housing 1600 to the blade housing support region 1320, as described with respect to the head assembly 300 of the power operated rotary knife 100. The forward blade housing support region 1320 of the frame body 1310 includes the pair of outwardly extending arcuate arms 1322. The arcuate arms 1322 define a blade housing mounting region 1324 for receiving an arcuate mounting section 1650 of the blade housing 1600 and a clamping receiving region 1326 for receiving the proximal wall 1333 of the clamp 1332 of the clamping assembly 1330. The head assembly 1300 of the power operated rotary knife 1100 also includes a drive mechanism 1400, similar to the drive mechanism 400 of the power operated rotary knife 100.

In addition to the foregoing, the head assembly 1300 of the power operated rotary knife 1100 further includes a vacuum connector 1910 (FIGS. 36-40), which is releasably affixed to the blade housing 1600. The vacuum connector 1910 is both a part or component of the head assembly 1300 of the power operated rotary knife 1100 and also is a part or component of the vacuum assembly of the power operated rotary knife assembly 1000. The vacuum assembly additionally includes a flexible vacuum hose 1990 and a vacuum clamp 1995 for affixing a distal or entrance end portion 1991 of the vacuum hose 1990 to an upper or exit end 1914 of the vacuum connector 1910. The vacuum connector 1910 defines an inverted funnel-shaped interior region 1912 that provides a fluid communication path for the flow of trimmed foliage material from the cutting opening CO of the power operated rotary knife 1100 to an interior region 1992 of a vacuum hose 1990 to provide for efficient remove of trimmed materials by a vacuum drawn in the interior regions 1992, 1912 of the vacuum hose 1990 and the vacuum connector 1910 from the cutting opening CO. That is, in the power operated rotary knife 100, after shearing, cut materials drop generally downwardly from the shearing region toward the ground by action of gravity. By contrast, with the power operated rotary knife assembly 1000, the vacuum assembly 1900 functions to apply a vacuum suction pressure in the region of the cutting opening CO to draw cut materials into an interior region 1912 defined by the inverted funnel-shaped vacuum connector 1910 and ultimately into the interior region 1992 of a vacuum hose 1990. Vacuum pressure drawn in the vacuum hose interior region 1992 is communicated through the interior region 1912 of the vacuum connector 1910 and into an interior region of the rotary knife blade 1500. The vacuum suction pressure is created by a suitable vacuum motor system (not shown) and the cut materials accumulate in a container (not shown) at a proximal end of the vacuum hose 1992.

As mentioned above, the head assembly 1300 includes the notched annular rotary knife blade 1500 (FIGS. 29-32), the coacting stationary, notched trim guide 1700 (FIGS. 32-35), the blade housing 1600 (FIGS. 23, 28 and 28A) and the vacuum connector 1910 (FIGS. 36-40). The rotary knife blade 1500 is supported by the stationary blade housing 1600 for rotation about a central axis of rotation R of the blade 1500. The blade housing 1600 is positioned between the rotary knife blade 1500 and the trim guide 1700. The trim guide 1700 is secured to the frame body 1310 by a threaded fastener 1800 which passes through an aperture 1719 in a attachment tab 1718 of the trim guide 1700 and threads into a threaded opening 1321*a* of a bottom surface 1321 of the blade housing support region 1320 of the frame body 1310 to secure the trim guide 1700 to the flame body 1310 (similar in structure and function to the fastener 800 and the attachment tab 718 of the trim guide 700 of the power operated rotary knife 100).

As can be seen in FIG. 21, the vacuum connector 1910 is secured to a clamp 1332 of the clamping assembly 1330 by a threaded fastener 1980 (FIG. 21) which extends through a vertically oriented opening 1963 defined in a radially extending boss 1962 of a clamp interface portion 1960 of a lower mounting section 1950 of the vacuum connector 1910. The threaded fastener 1980 threads into a threaded opening 1342 formed in an upper surface 1340 of the clamp member 1332 to secure the vacuum connector 1910 to the clamp member 1332 and thereby couple the vacuum connector 1910 to the frame body 1310. In one exemplary embodiment, the threaded connector 1980 is a thumbscrew to advantageously allow for easy removal of the vacuum connector 1910 from the remainder of the head assembly 1300, specifically the clamp member 1332 and the blade housing 1600 for servicing of the vacuum connector 1910. The vacuum connector 1910 is also secured to the trim guide 1700 by a C-shaped latch 1972 (best seen in FIGS. 39 and 40) extending from an arcuate rim portion 1971 of a trim guide interface portion 1970 of the lower mounting section 1950 of the vacuum connector 1910. The C-shaped latch 1972 of the trim guide interface portion 1970 latches or hooks on to an axially and radially extending rib 1751, a vertical extension 1754 and a radially inwardly extending lip 1770 of a guard section 1750 (best seen in FIGS. 32 and 35) of the trim guide 1700. The C-shaped latch 1972 to the trim guide 1700 is circumferentially opposite of the connection of the thumbscrew 1980 of the radially extending boss 1962 to the clamp member upper surface 1340. The combined coupling of the C-shaped latch 1972 and the thumbscrew 1980 releasably secure the vacuum connector 1910 to remainder of the head assembly 1300.

Figure 26:
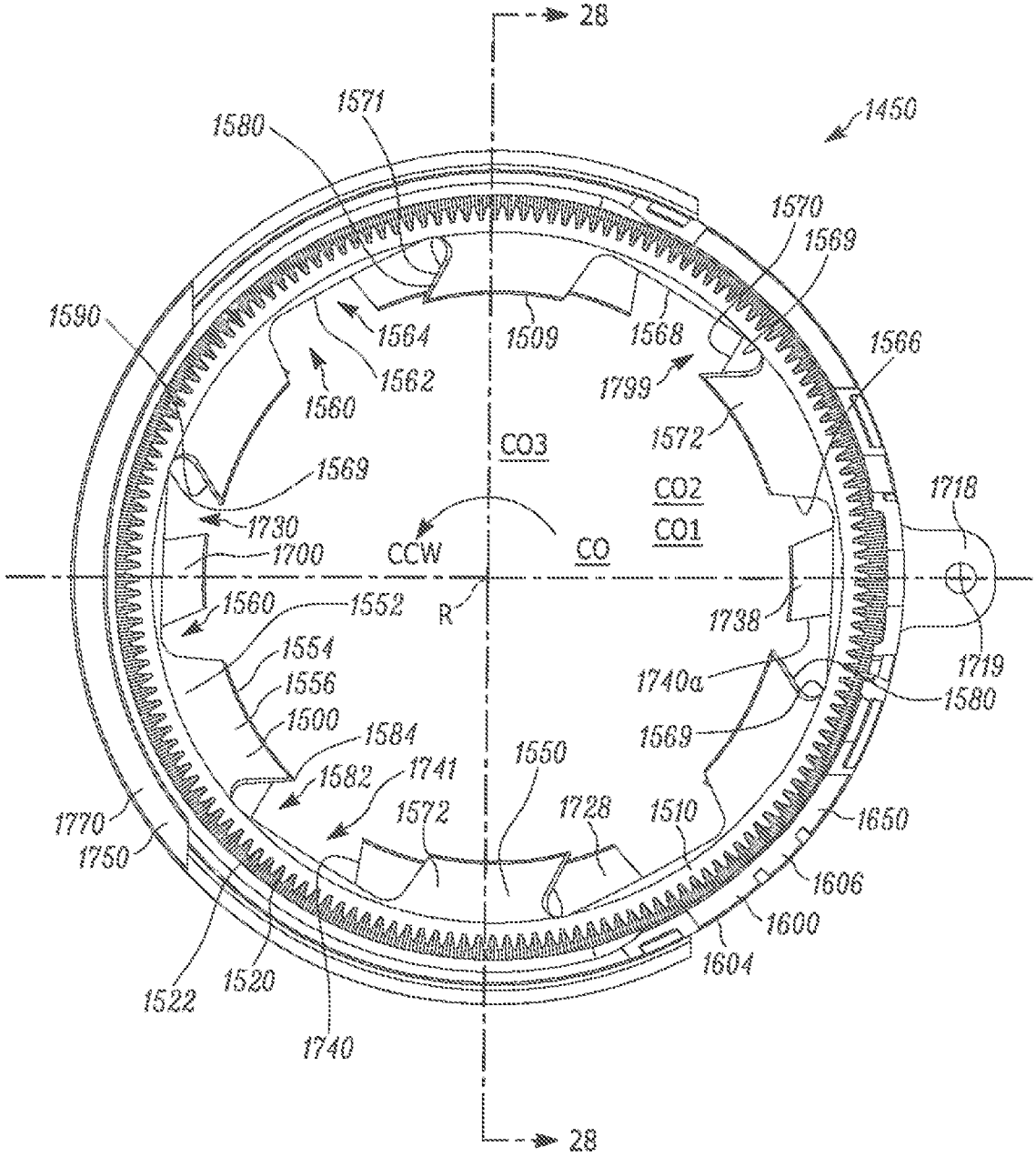
FIG. 26 is a schematic top plan view of a combination of the notched annular rotary knife blade, the blade housing, and the notched trim guide of the head assembly of the power operated rotary knife assembly of FIG. 20.
Figure 27:
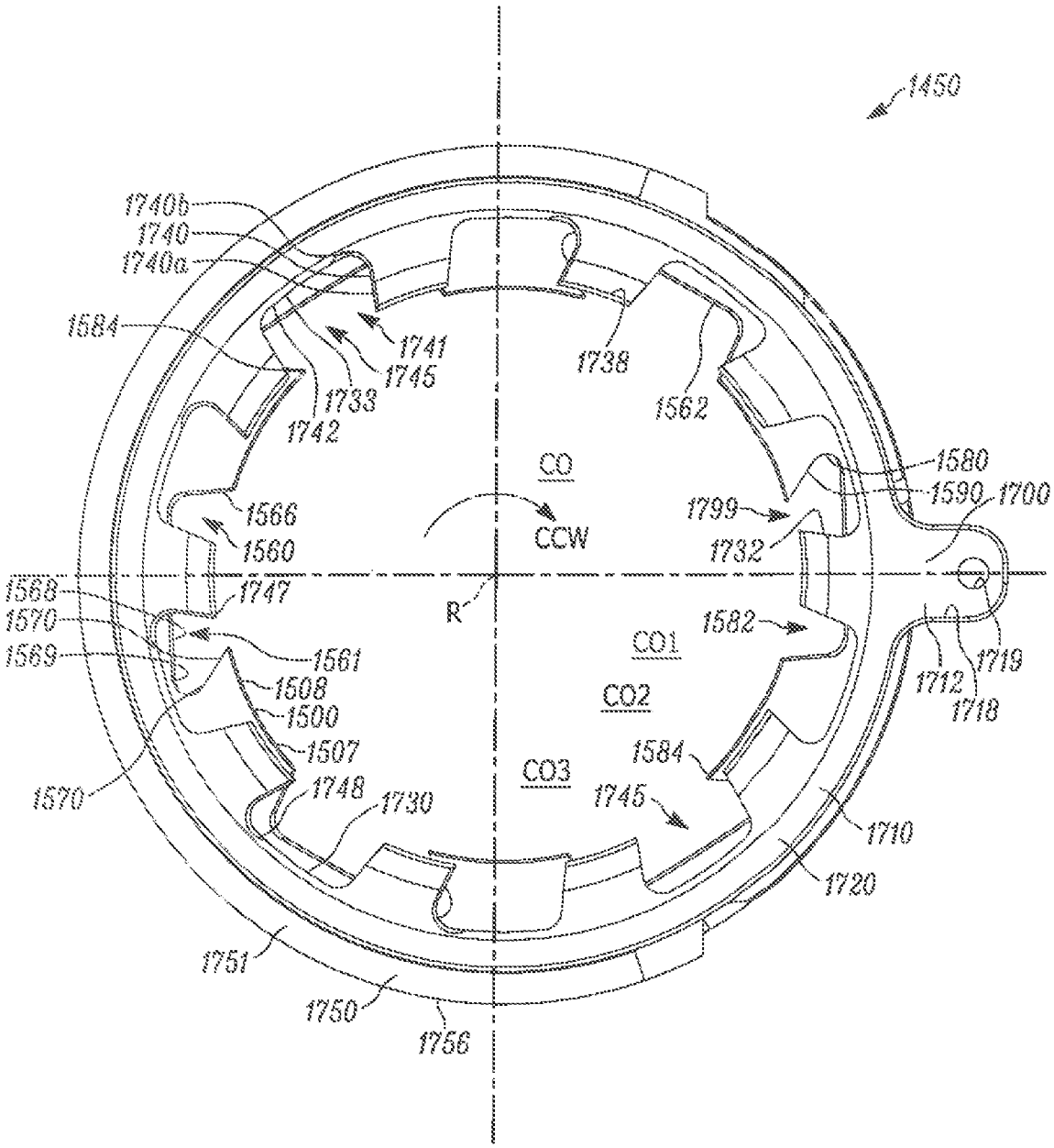
FIG. 27 is a schematic bottom plan view of the combination of the notched annular rotary knife blade, the blade housing, and the notched trim guide of the head assembly of the power operated rotary knife assembly of FIG. 20.

As schematically depicted in FIGS. 26 and 27, each of the rotary knife blade 1500, the blade housing 1600 and the trim guide 1700 are annular, defining central open regions CO1, CO2, CO3, respectively. When the rotary knife blade 1500, the blade housing 1600 and the trim guide 1700 are assembled and attached to the frame body 1310 of the head assembly 1300, the central open regions of a combination 1450 of the blade 1500, the blade housing 1600 and trim guide 1700 define the central cutting opening CO of the power operated rotary knife 1100. Cutting and trimming take place along a periphery of the central cutting opening CO. The central cutting opening CO is actually defined by a combination 1480 of the blade 1500, and the trim guide 1700. As can be seen in FIGS. 21 and 26-28A, no portion of the blade housing 1600 extends radially inwardly far enough to define any portion of the central cutting opening CO of the power operated rotary knife 1100. Thus, the central cutting opening CO is defined by intersecting central open regions CO1, CO3 of the assembled combination 1480 of the rotary knife blade 1500 and trim guide 1700.

Blade Housing 1600

As best seen in FIGS. 21, 23, 28 and 28A, the rotary knife blade 1500 of the power operated rotary knife 1100 is supported for rotation about the central axis of rotation R by the annular blade housing 1600. The blade housing includes a split, annularly curved blade support section 1610 that surrounds and supports the rotary knife blade 1500 about the entire 360 degree circumference of the blade 1500 and a mounting section 1650 extending axially from the blade support section 1610 and provides a mounting structure for releasably mounting the blade 1500 and blade housing 1600 to the blade housing mounting region 1324 of the forward blade housing support region 1320 of the frame body 1310. The blade housing 1600 includes an inner wall 1602 and an outer wall 1604 and an upper end 1606 and a lower end 1608. Adjacent the lower end 1608, the inner wall 1602 defines a bearing surface 1620, which in one exemplary embodiment is a radially inwardly protruding bearing bead 1622, extending from an inner wall 1602 of the blade housing 1600. The blade housing bearing bead 1622 extends into a generally V-shaped opening or bearing race 1540 formed in and extending radially into an outer wall of the 1514 of an annular body 1510 of the rotary knife blade 1500 to support the blade 1500 for rotation about the axis of rotation R. The blade bearing race 1540 comprises two axially spaced apart, generally frustoconical, bearing faces 1542 which bear against the blade housing bead 1622 to support the blade both axially and radially. The bearing support structure of the bearing bead 1622 of the blade housing 1600 and the bearing race 1540 of the rotary knife blade 1500 define a cutting plane RP of the rotary knife blade 1500, which is substantially orthogonal to the blade central axis of rotation R.

The mounting section 1650 of the blade housing 1600 includes an angled split 1652 and a pinion clearance region 1654. The pinion clearance region 1654 of the blade housing mounting section 1650 provides for clearance for a gear head 1406 of a pinion gear 1404 of a drive train 1402 of the drive mechanism 1400. The angled split 1652 of the mounting section 1650 is circumferentially offset from the pinion clearance region 1654 and provides for expansion of the blade housing diameter for purposes of changing the rotary knife blade 1500 when the blade has reached the end of its useful life. Specific details regarding an annular blade housing with an angle split and offset pinion clearance region are disclosed in U.S. Pat. No. 8,661,692 to Whited et al., issued Mar. 4, 2014. U.S. Pat. No. 8,661,692 is assigned to the assignee of the present invention and is incorporated herein in its entirety by reference.

The rotary knife blade 1500, the blade housing 1600, and the trim guide 1700, are all annular and, when assembled, define an overlapping sandwiched combination 1450 wherein the blade housing blade support section 1610 is radially sandwiched between, on the radial inside, the annular body 1510 of the rotary knife blade 1500 and, on the radial outside, by a radially outwardly and axially upwardly extending rib 1751 of the guard section 1750 of the trim guide 1700. The rib 1751 includes a frustoconical section 1752. A vertical extension 1754 of the guard section 1750 extends from an upper end 1751*a* of the rib 1751 and is disposed axially above the rib 1751. A radially inwardly extending lip 1770 of the guide section 1570 extends from an upper end 1754*a* of the vertical extension 1754 in a radially inward direction. An angle subtended by the rib frustoconical section 1752 is greater than 180°, while an angle subtended by the upper vertical extension 1754 and the lip 1770 are significantly less than 180°.

Rotary Knife Blade 1500

Figure 29:
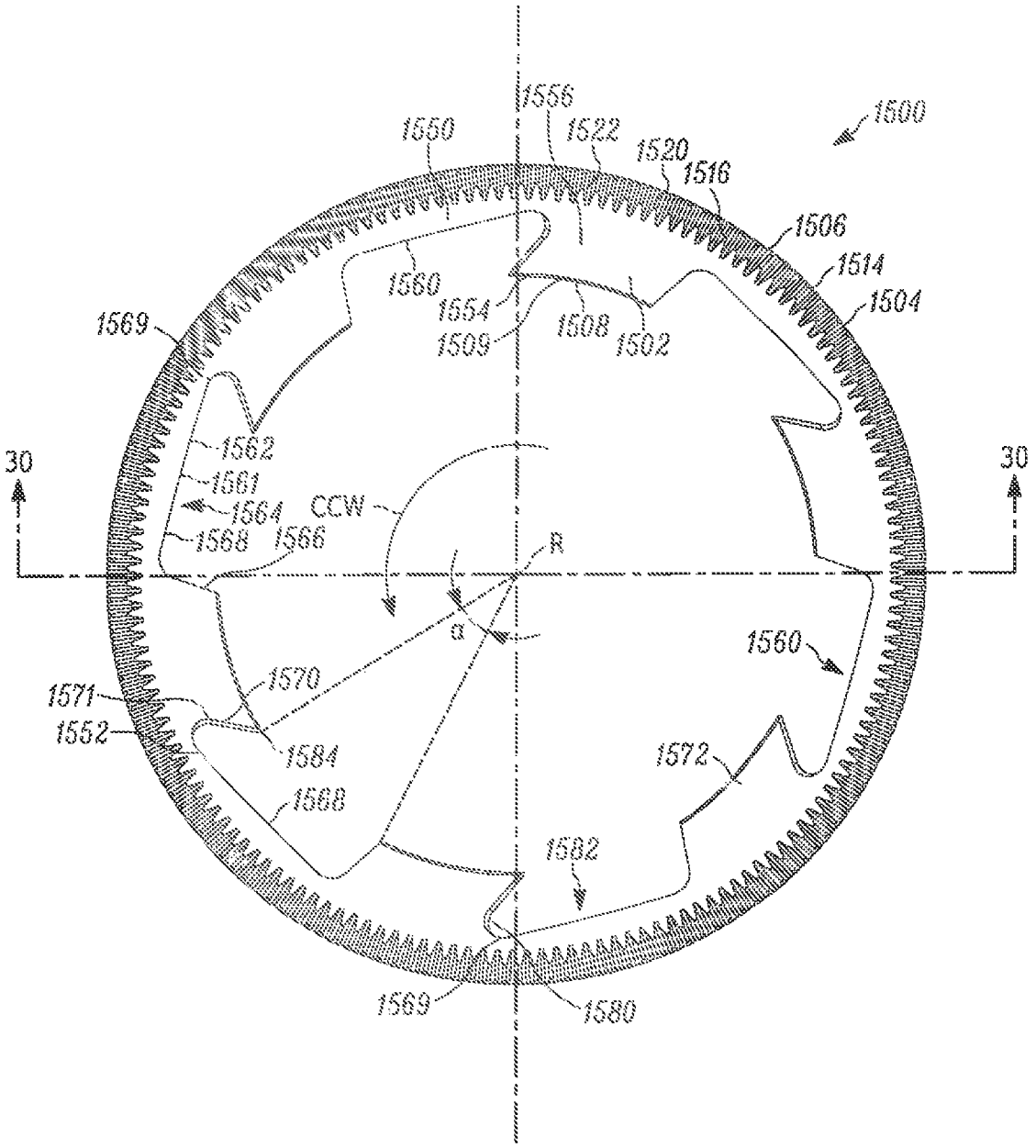
FIG. 29 is a schematic top plan view of the notched annular rotary knife blade of the head assembly of the power operated rotary knife assembly of FIG. 20.
Figure 30:
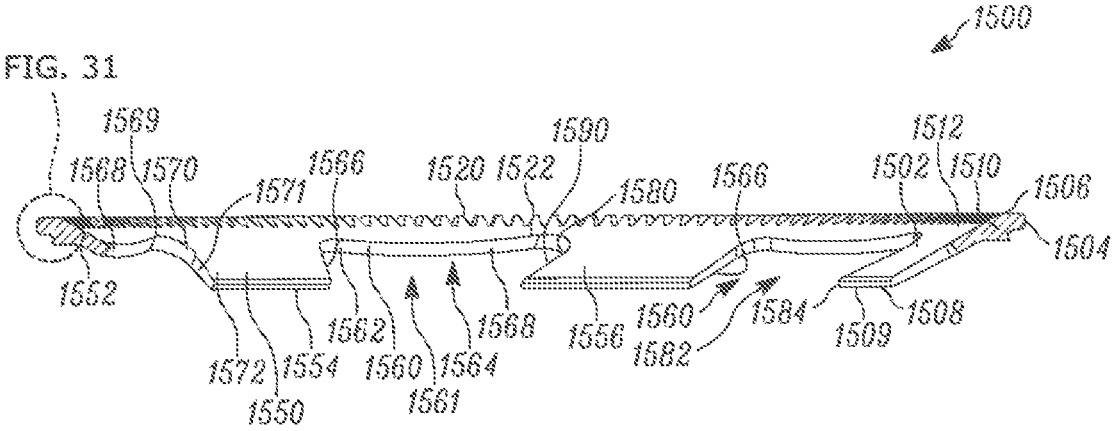
FIG. 30 is a schematic longitudinal section view of the notched annular rotary knife blade of FIG. 29, as seen from a plane indicated by the line 30-30 in FIG. 29.
Figure 31:
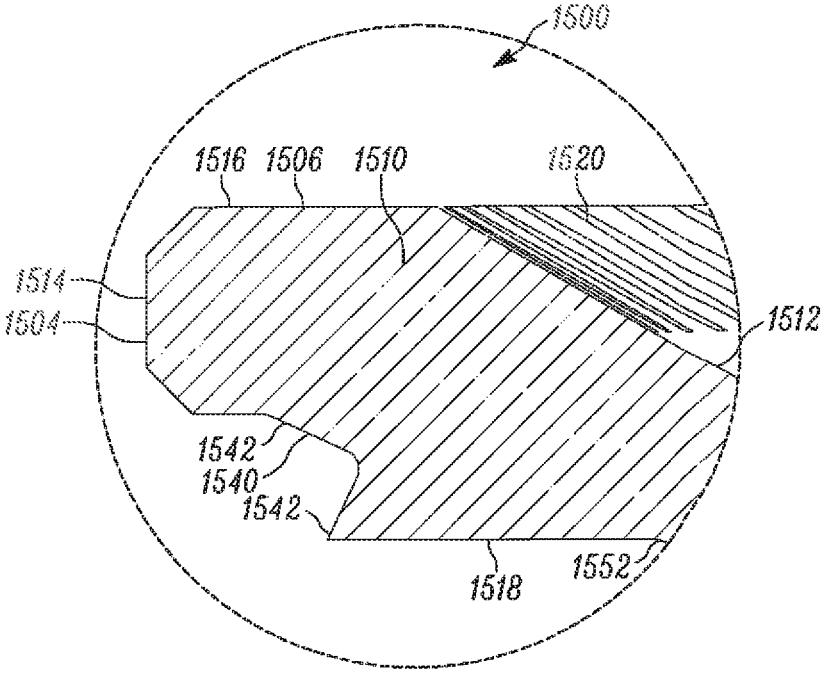
FIG. 31 is a schematic enlarged section view of an end portion of the notched annular rotary knife blade of FIG. 29 that is within a dashed circle labeled FIG. 31 in FIG. 30.
Figure 32:
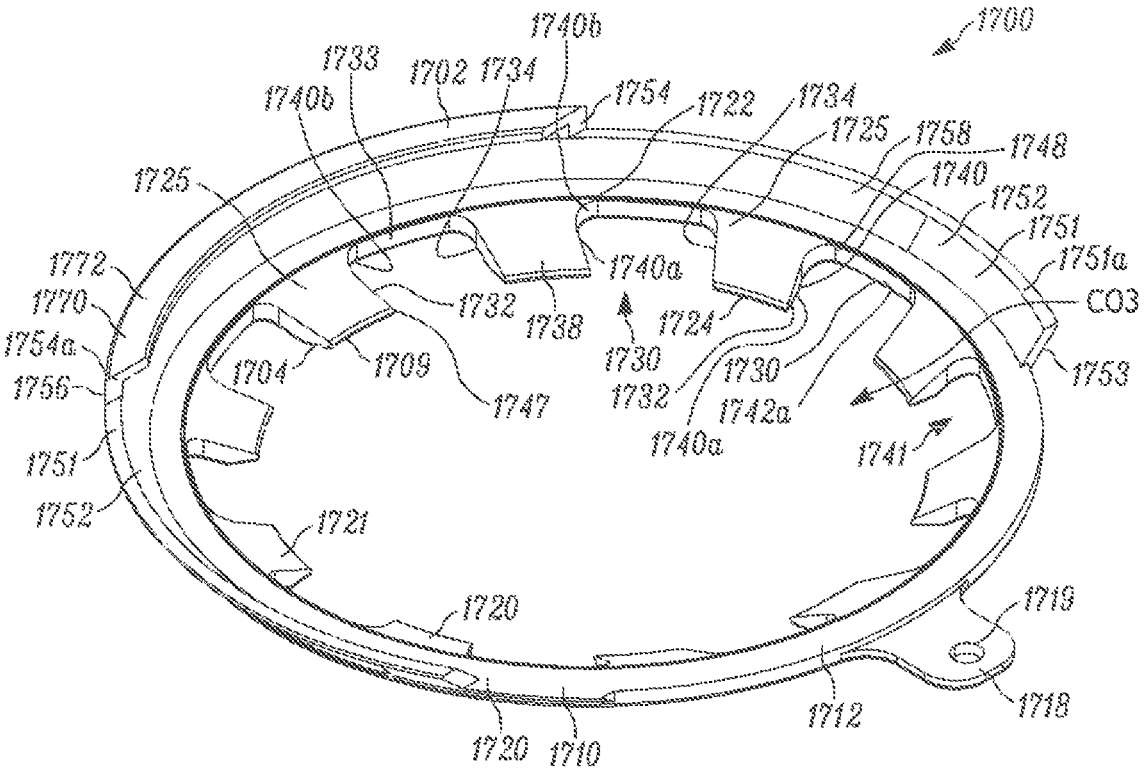
FIG. 32 is a schematic top perspective view of the notched trim guide of the head assembly of the power operated rotary knife assembly of FIG. 20.

As best seen in FIGS. 29-31, the rotary knife blade 1500 of the power operated rotary knife 1100 of the second exemplary embodiment includes an inner wall 1502 and a radially spaced apart outer wall 1504 and an upper end 1506 and an axially spaced apart lower or bottom end 1508. The inner wall 1502 defines a central opening of the blade 1500. The blade 1500 includes the annular body 1510 which defines an inner wall 1512 (defining part of the inner wall 1502 of the blade 1500), an outer wall 1514 (defining part of the outer wall 1504 of the blade 1500), an upper end 1516 (defining the upper end 1506 of the blade 1500) and a lower end 1518. The rotary knife blade 1500 further includes the blade section 1550 extending axially downwardly and radially inwardly (toward the blade axis of rotation R) from the lower end 1518 of the annular body 1510. The blade section 1550 includes upper end 1552 adjacent the annular body lower end 1518 and a lower end 1554 (defining the lower end 1508 of the blade 1500) and a generally frustoconical wall 1556 extending therebetween.

The upper end 1516 of the annular body 1510, as mentioned above, defines the driven gear 1520 of the blade 1500. The driven gear 1520 comprises a set of gear teeth formed in a circumference adjacent the outer wall 1514 of the annular body. Adjacent the lower end 1518 of the annular body, the blade bearing race 540 defining frustoconical bearing surfaces 542 is formed in the outer wall 1514 of the annular body, as described above.

The lower end 1554 of the blade section 1550 includes interrupted arc portions 1572 that define a lower edge 1509 of the blade 1500. The interrupted are portions 1572 are centered about the blade central axis of rotation R and, if connected and continued, would form a circle defining an inner diameter of the blade 1500 with a center on the axis of rotation R. Typically, the interrupted arc portions 1572 would define a cutting edge of the blade, but, in the rotary knife 1500, the cutting edge 1590 of the blade is defined by a plurality of recessed, arcuate cutting portions 1580 within the plurality of notches 1560. Interrupting the arc portions 1572 are the plurality of notches 1560 formed at the lower end 1554 of the frustoconical wall 1556 of the blade section 1550 and extending into the frustoconical wall 1556. As can best be seen in FIGS. 29 and 30, each of the notches of the plurality of notches 1560, when viewed in top plan view, defines a generally rectangular cavity 1561 defined by a peripheral wall 1562 surrounding a central open portion 1564 and defining the cavity 1561. The peripheral wall 1562 of each notch of the plurality of notches 1560, when viewed with respect to the counterclockwise direction of rotation CCW of the rotary knife blade 1500, includes an angled leading portion or end 1566, a generally linear central portion 1568, and a hook-shaped or U-shaped trailing portion or end 1570.

As best seen in FIGS. 29 and 30, the trailing end 1570 of the peripheral wall 1562 includes an arcuate sharpened region 1571 extending approximately from a transition segment 1569 of the peripheral wall 1562 bridging the linear central portion 1568 and the trailing end 1570 to a termination point 1584 of the trailing end 1570 located at the bottom edge 1509 of the blade 1500, as defined by the start of the next interrupted arc portion 1572. The arcuate sharpened regions 1571 may extend to the bottom edge 1509 of the blade 1500 or be in close proximity to the bottom edge 1509. Both are contemplated by the present disclosure. The arcuate sharpened regions or cutting portions 1571 are concave (like the inside of a bowl) in that they are curving in or hollowed inwardly due to the hook-shape of the trailing end 1570 of the peripheral wall 1562. The arcuate sharpened regions 1571 of the plurality of notches 1560 define the respective recessed arcuate cutting regions or portions 1580 of the blade 1500. The arcuate cutting portions 1580 are recessed in that at least a portion of the arcuate sharpened region 1561 is within an interior region 1582 (that is, the central open portion 1564) defined by each of the plurality of notches 1560.

It should be appreciated of course that the arcuate cutting portions 1580 (and the associated sharpened regions 1571), instead of being arcuate (by virtue of the hook-shaped trailing end 1570 of the peripheral wall 1562), could be linear or convex and the present disclose contemplates such an alternate embodiment. In one exemplary embodiment of the rotary knife blade 1500, an inner diameter of the blade 1500, as defined by the interrupted arc portions 1572 constituting the lower edge 1509 of the blade 1500, is approximately 3.704 in., while the outside diameter of the blade, defined by the radial outermost extent of the outer wall 1514 of the annular body 1510 of the blade is approximately 5.092 in. The inner diameter of the blade 1500 is approximately twice the radius RAD, schematically depicted in FIG. 11. In one exemplary embodiment, a thickness of the interrupted arc portions 1572 is approximately 0.063 in. Additionally, in one exemplary embodiment, the number notches in the plurality of notches 1560 is six, each of which is spaced equidistantly about an inner perimeter or inner diameter of the blade 1500, each of the notches subtending an angle $\alpha$ (depicted schematically in FIG. 29) with respect to the central axis of rotation R of approximately 32°.

Trim Guide 1700

As can best be seen in FIGS. 32-35, the trim guide 1700 of the power operated rotary knife 1100, which is stationary with respect to the rotation of the blade 1500, includes an upper end 1702 and a lower end 1704 and defines the planar base 1710, the guide section 1720 extending axially below and radially inwardly from the base 1710, and the guard section 1750, including the radially outwardly and upwardly extending rib 1751, the vertical extension 1754 and the radially inwardly extending lip 1770. As can best be seen in FIG. 35, the guard section 1750 of the trim guide 1700 extends axially upwardly and radially outwardly from the base 1710. The rib 1751 of the guard section 1750 includes the frustoconical section 1752. The vertical extension 1754 extends axially upwardly from the upper end 1751*a* of the rib 1751. The lip 1770 extends radially inwardly from the upper end 1754*a* of the vertical extension 1752. The lip 1770 subtends an angle substantially equal to the angle subtended by the vertical extension 1752. The base 1710 includes the attachment tab 1718 extending from a rearward portion 1712 of the base 1710. The tab 1718 includes the aperture 1719. The trim guide 1700 is releasably affixed to the bottom surface 1321 of the blade housing support region 1320 of the frame body 1310 by the threaded fastener 1800 that extends through the tab aperture 1719 and threads into the threaded opening 1321*a* of the bottom surface 1321 of the blade housing support region 1320 of the frame body 1310.

Figure 35:
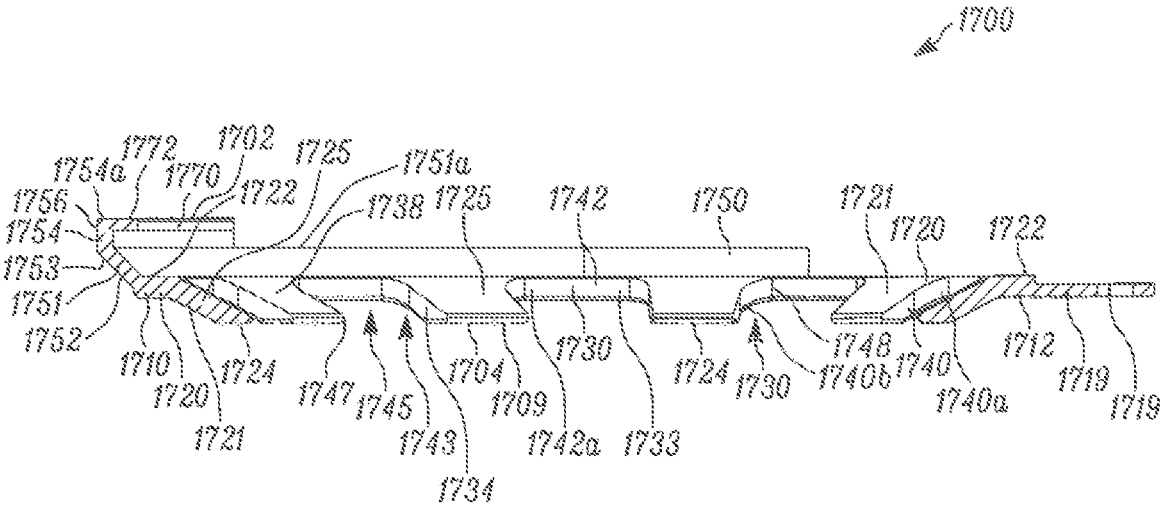
FIG. 35 is a schematic longitudinal section view of the notched trim guide of FIG. 32, as seen from a plane indicated by the line 35-35 in FIG. 33.
Figure 36:
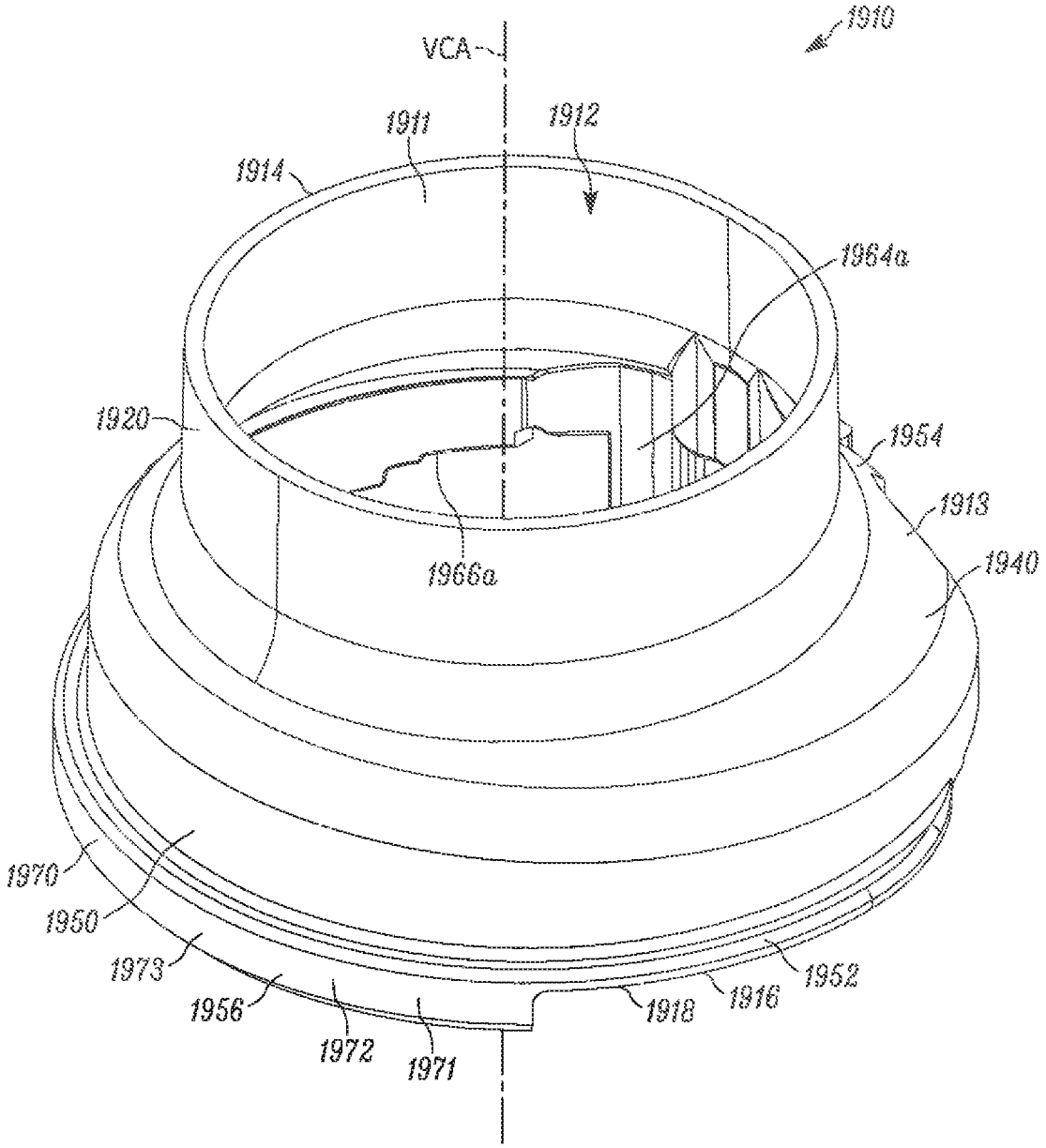
FIG. 36 is a schematic top perspective view of the vacuum connector of the head assembly of the power operated rotary knife assembly of FIG. 20.
Figure 37:
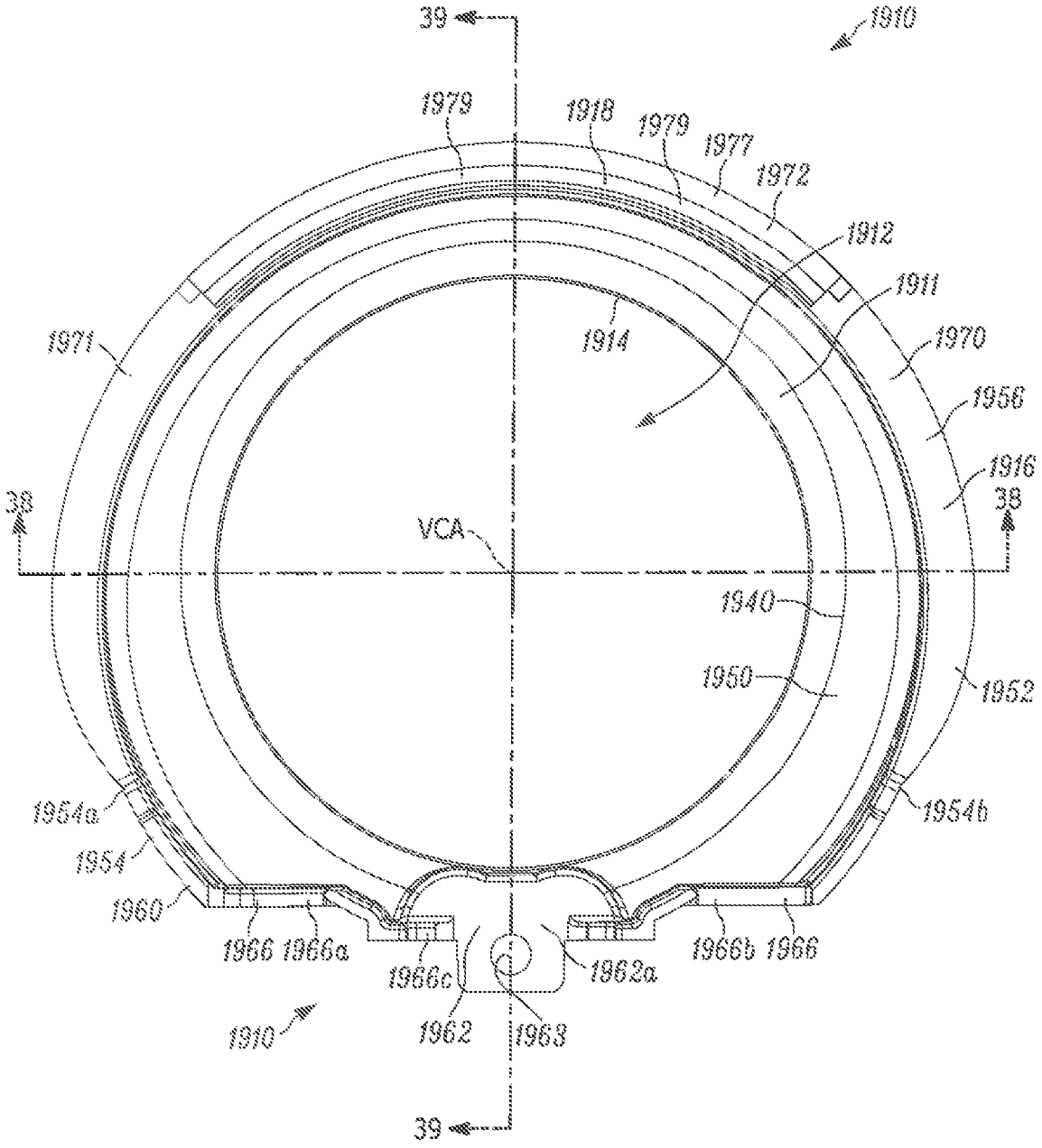
FIG. 37 is a schematic bottom plan view of the vacuum connector of FIG. 36.
Figure 38:
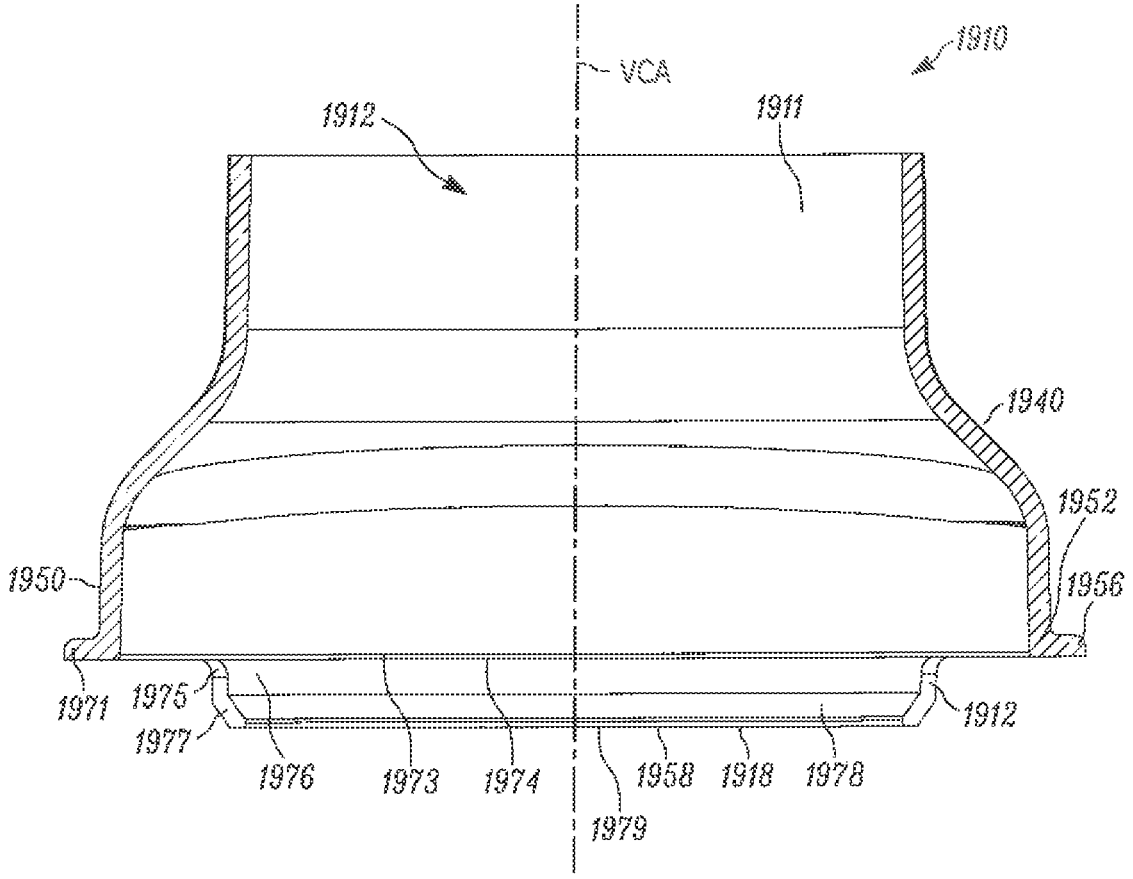
FIG. 38 is a schematic longitudinal section view of the vacuum connector of FIG. 36, as seen from a plane indicated by the line 38-38 in FIG. 37.
Figure 39:
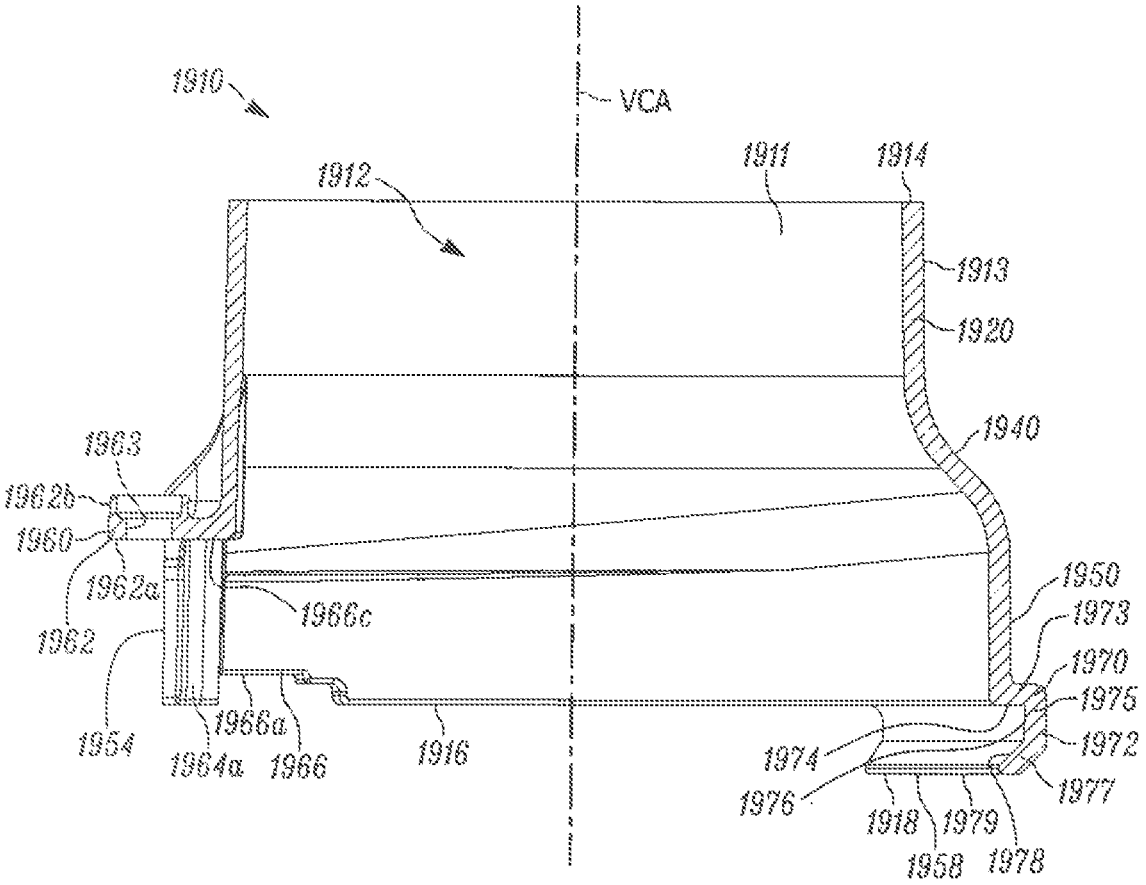
FIG. 39 is a schematic longitudinal section view of the vacuum connector of FIG. 36, as seen from a plane indicated by the line 39-39 in FIG. 37.

As can best be seen in FIG. 35, the guide section 1720 of the trim guide 1700 includes an upper end 1722 and a lower end 1724 and defines a guide section frustoconical wall 1721. The frustoconical wall 1721 extends along the frustoconical wall 1556 of the blade section 1550. The guide section 1720 of the trim guide 1700 includes interrupted arc portion 1738 circumferentially spaced apart by a plurality of notches 1730. In one exemplary embodiment, the notches of the plurality of notches 1730 are spaced equidistant about the lower end 1724 of the guide section 1720 and the number of notches 1730 is ten. The openings or cavities defined by each of the notches of the plurality of notches 1730 are generally a concave, slanted or skewed U-shape.

Unlike the trim guide 700 of the power operated rotary knife 100 of the first embodiment, the plurality of notches 1730 are disposed circumferentially in spaced-apart relationship about an entirety (that is around the entire 360° circumference) of the lower end 1724 of the guide section 1720. That is, in the trim guide 700, the guide section 720 included the forward portion 725, subtending just over 180 degrees of the total annulus defined by the trim guide 700. As shearing action for trimming of branches occurred in a region of the plurality of notches 730 of the guide section 720, for trimming branches, in the power operated rotary knife 100 of the first embodiment, the operator needed to pull the power operated rotary knife 100 in a rearward or proximal direction RW along the handle assembly longitudinal axis LA toward himself or herself since the plurality of notches 730 were positioned in a forward portion 726 of the guide section 720.

Advantageously, with the trim guide 1700 and the vacuum assembly 1900 of the power operated rotary knife 1100, the operator may move the power operated rotary knife 100 in any direction, i.e., toward the operator along the longitudinal axis LA of the handle assembly 1200 in the rearward or proximal direction RW, away from operator along the longitudinal axis LA of the handle assembly 1200 in the forward or distal direction FW, or anywhere therebetween, as plurality of notches 730 are spaced about the entire 360° of the guide section 1720 and shearing action is therefore not limited to a forward portion of the guide section but may take place at any circumferential position where a notch 1730 is disposed and shearing action occurs, as explained. Additionally and advantageously, the vacuum assembly 1900 functions to expeditiously and efficiently remove trimmed branch materials from the cutting opening CO region and away from the plant, keeping the plant and the plant bed areas clean and free from trimmed branch materials and possible diseases and other problems associated with leaving trimmed materials on the remaining branches of the plant or left to compost on the plant bed area.

The notches 1730 of the trim guide 1700 function to direct the plant branches to be cut into recessed shearing portions 1740 defined by each of the plurality of notches 1730 of the trim guide 1700 wherein the recessed arcuate cutting portions 1580 of the plurality of notches 1560 of the rotary knife blade 1500 cut the branches by shearing action as the blade 1500 rotates with respect to the stationary trim guide 1700. To cut or trim a branch and then evacuate the cut or severed portions of the branch, the power operated rotary knife 1100 is positioned with respect to a plant branch to be cut or trimmed such that the branch extends through the cutting opening CO defined by the power operated rotary knife 1100, the operator then moves the knife 1100 in a direction such that the branch is moved within the cutting opening CO and urged against the guide section 1720 of the trim guide 1700. Depending on the position of the branch within the cutting opening CO, the movement of the rotary knife 1100 by the operator will move the branch into one of the plurality of notches 1730 of the trim guide guide section 1720. A cutting portion 1580 of the rotary knife blade 1500 will impact the branch within the interior region 1745 of the notch 1720, cutting the branch by a shearing action between the shearing portion 1740 of the trim guide notch 1720 at the leading end 1732 of the notch 1720 and the cutting portion 1580 of the blade section notch 1560 at the trailing end 1570 of the notch 1560.

Figure 28:
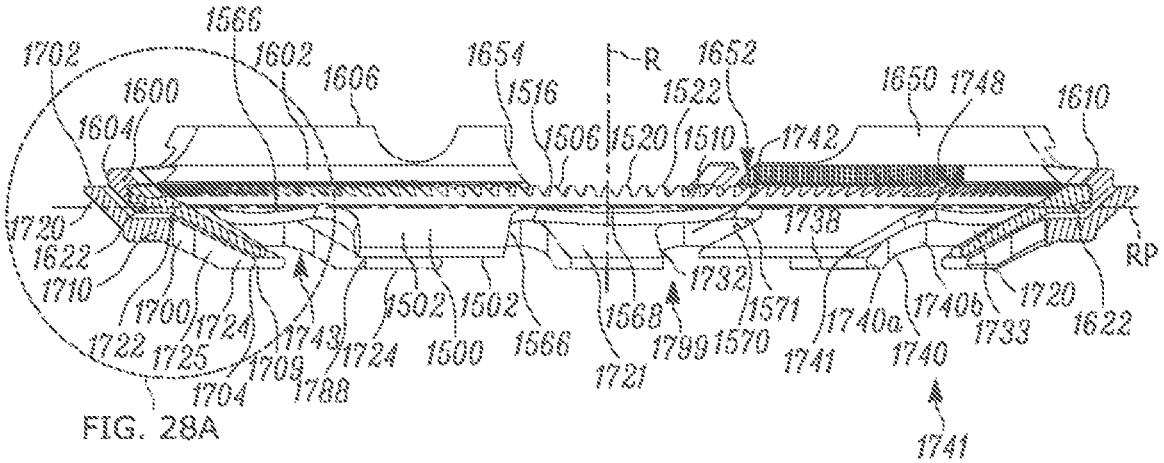
FIG. 28 is a schematic section view of the combination of the notched annular rotary knife blade, the blade housing, and the notched trim guide of the head assembly of the power operated rotary knife assembly of FIG. 20, as seen from a plane indicated by the line 28-28 in FIG. 26.
Figure 28A:
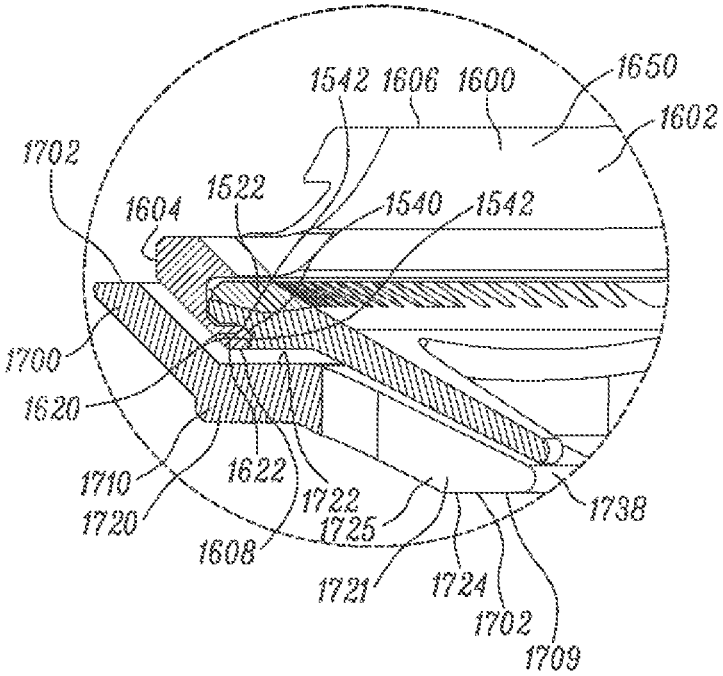
FIG. 28A is a schematic enlarged section view of the combination of the notched annular rotary knife blade, the blade housing, and the notched trim guide of FIG. 28 that is within a dashed circle labeled FIG. 28A in FIG. 28.

As best seen in FIG. 28, an extending distal portion 1725 of guide section 1720 extends axially below and radially inwardly beyond the lower edge 1509 of the rotary knife blade 1500 and has two functions: 1) to direct a branch or branches into an interior region 1745 defined by one of the plurality of notches 1730 as the power operated rotary knife 1100 is moved or manipulated by the operator to cut or trim a branch or branches within the central cutting opening CO of the knife 1100; and 2) to guard the rotary knife blade 1500 from inadvertent contact with the ground or plastic mats or sheets positioned on the ground between rows of plants. The trim guide 1700 also includes the guard section 1750 including the peripheral rib 1751 which extends axially above and radially outwardly from the base 1710. The rib 1751 extends around most, but not all of the total annulus defined by the trim guide 1700. Additionally, the vertical extension 1754 and the lip 1770 extend axially upwardly and radially inwardly from the upper end 1751*a* of the rib 1751. The vertical extension 1754 and the lip 1770 subtend an angle less than an angle subtended by the rib 1751. Both the rib 1751, the vertical extension 1754 and the lip 1770 of the guard section 1750 function as guards to protect the blade 1500 from inadvertent contact with plastic mats, portions of plants that are not to be trimmed or cut, and the like.

Figure 33:
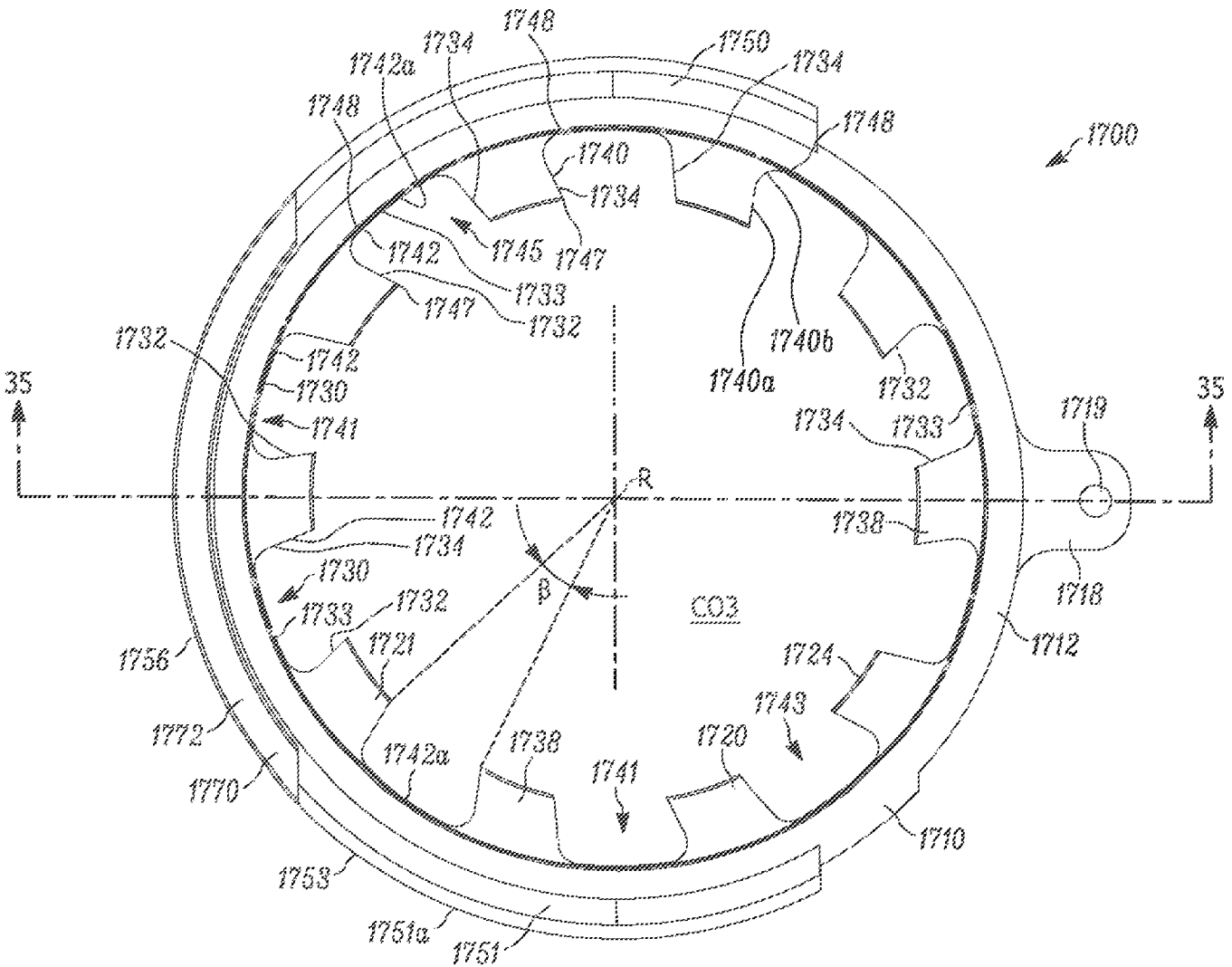
FIG. 33 is a schematic top plan view of the notched trim guide of FIG. 32.
Figure 34:
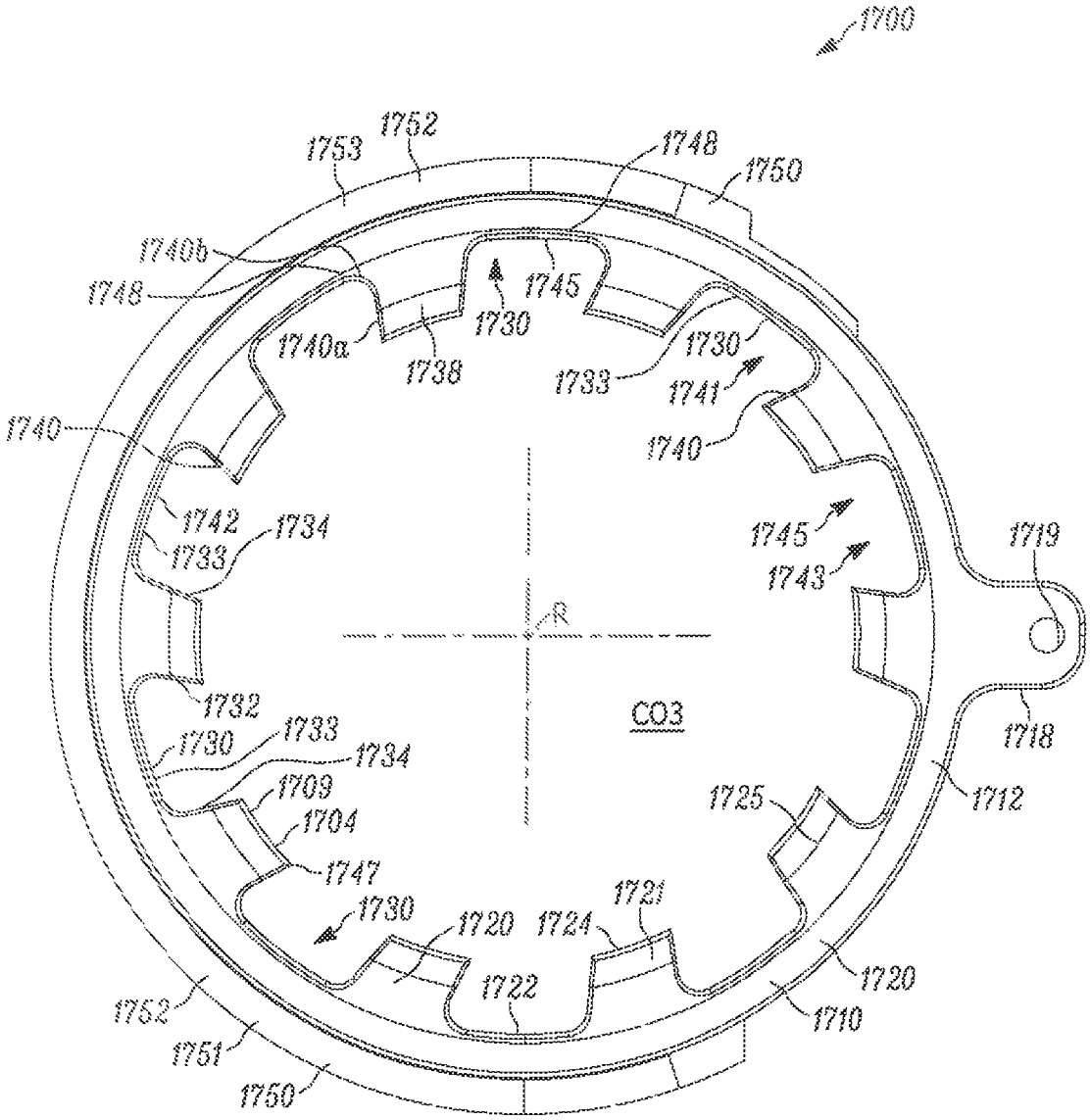
FIG. 34 is a schematic bottom plan view of the notched trim guide of FIG. 32.

As best seen in FIGS. 33-35, the guide section 1720 includes the plurality of notches 1730 formed the lower end 1724 and extending into the frustoconical wall 1721. The lower end 1724 of the guide section 1720 also includes interrupted arc portions 1738 that define a lower edge 1709 of the trim guide 1700. The interrupted arc portions 1738 are centered about the blade central axis of rotation R and, if connected and continued, would form a circle defining an inner diameter of the trim guide 1700 with a center on the axis of rotation R. Interrupting the arc portions 1738 of the guide section 1720 are the plurality of notches 1730 formed at the lower end 1724 of the frustoconical wall 1721 of the guide section 1720 and extending into the frustoconical wall 1721. As can best be seen in FIG. 33, each of the notches of the plurality of notches 1730, when viewed in top plan view, defines a slightly slanted, concave U-shaped cavity 1741 defined by a peripheral wall 1742 surrounding a central open portion 1743 and defining the cavity 1741. The central open portion 1743 corresponds to the interior region 1745 of the notch 1730. The peripheral wall 1742, when viewed with respect to the counterclockwise direction of rotation CCW (FIG. 26) of the rotary knife blade 1500, includes an angled leading portion or end 1732 (FIG. 33), a central portion 1733, and an angled trailing portion or end 1734. The central portion 1733, which is generally arcuate, defines a radially innermost section or region 1742*a* of the peripheral wall 1742.

The angled leading end 1734 of the peripheral wall 1742 defines a shearing region or portion 1740 extending approximately from a termination point 1747 at the lower end 1724 of the guide section 1720 where the next adjacent interrupted arc portion 1738 commences and extending to a transition point 1748 along the central portion 1733 of the peripheral wall 1742 where the angled leading end 1732 terminates. The transition point 1748 being along the central portion 1733 is one of the radially innermost points of the peripheral wall 1742. When viewed in top plan view, the shearing portions 1740 defined by the leading ends 1734 of the respective plurality of notches 1730 define a linear segment 1740*a* over most of their extent moving radially inwardly from the lower end 1724 of the guide section 1720 and then transition into a shorter arcuate segment 1740*b* as the transition point 1748 of the peripheral wall 1742 is approached. The shearing portions 1740 of the plurality of notches 1730 of the trim guide 700 are recessed in that at least a portion of the shearing portion 1740 is within an interior region 1745 (that is, the central open portion 1743) defined by each of the plurality of notches 1730.

As explained above, the cutting action of the power operated rotary knife 1100 occurs through the combination 1480 of the rotating rotary knife blade 1500 and the stationary trim guide 1700. As the blade 1500 rotates about its central axis of rotation R, the shearing portions 1740 of the guide section notches 1730 come into overlapping axial alignment with the arcuate cutting portions 1580 of the blade section notches 1560. Additionally, the central open portion 1564 or interior region 1582 of each of the plurality of notches 1560 of the blade section 1550 of the rotary knife blade 1500 come into overlapping axial alignment with the central open portion 1743 or interior region 1745 of each of the plurality of notches 1730 as the blade 1500 rotates about the axis of rotation R. This transitory overlapping alignment of the central open portions 1564, 1743 or interior regions 1582, 1745 define transitory cutting pockets 1799. (Such transitory cutting pockets 1799 are depicted schematically, for example, in FIGS. 26 and 27. The uncut branch or branches directed into a transitory pocket 1799 by the guide section 1720 of the trim guide 1700, that is, guided into a trim guide notch 1730, will be rapidly and efficiently cut by the shearing action of the rotating cutting portions 1580 of the blade 1500 passing over the stationary shearing portions 1740 of the trim guide 1700 as the rotary knife blade 1500 continues its high speed rotation in the counterclockwise direction CCW. The cutting pockets 1799 are transitory in that as the blade 1500 continues to rotate about its axis of rotation R, the blade 1500 rotates with respect to the stationary trim guide 1700. Thus, as would be understood, new cutting pockets 1799 are formed by overlapping interior regions 1582, 1745 and then disappear as cutting of the branch or branches with the cutting pockets 1799 occurs by shearing action by virtue of the rotating cutting portions 1580 of the blade 1500 passing over the stationary shearing portions 1740 of the trim guide 1700. Thus, as the blade 1500 rotates about the central axis of rotation R, new cutting pockets 1799 are constantly formed and old cutting pockets 1799 disappear as cutting occurs and branches in the cutting pockets are cut by shearing action.

In one exemplary embodiment of the trim guide 1700 of the power operated rotary knife 1100, an inner diameter of the trim guide 1700, as defined by the interrupted arc portions 1738 constituting the lower edge 1709 of the trim guide 1700, is approximately 3.808 in., while a diameter defined by a radially innermost point of each of the plurality of notches 1730 of the guide section 1720 is approximately 4.631 in. Additionally, in one exemplary embodiment, the number notches in the plurality of notches 1730 is ten, spaced about the entirety of the 360° of the central opening CO3 of the trim guide 1700 and circumferentially spaced apart by ten interrupted arc portions 1738 wherein each of the notches of the plurality of notches 1730 subtends an angle β (depicted schematically in FIG. 33) with respect to the central axis of rotation R of approximately 21°.

Advantageously, with the trim guide 1700 and the vacuum assembly 1900 of the power operated rotary knife 1100, the operator may move the power operated rotary knife 100 in any direction, i.e., a rearward or proximal direction RW toward the operator along the longitudinal axis LA of the handle assembly 1200, a forward or distal direction FW away from operator, or any direction therebetween, as plurality of notches 1730 are spaced about the entire 360° of the guide section 1720 and shearing action is therefore not limited to a forward portion of the guide section but may take place at any circumferential position where a notch 1730 is disposed and shearing action occurs, as explained. Additionally and advantageously, the vacuum assembly 1900 functions to expeditiously and efficiently remove trimmed branch materials from the cutting opening CO region and away from the plant, keeping the plant and the plant bed areas clean and free from trimmed branch materials and possible issues associated with leaving trimmed materials on the remaining branches of the plant or dropping to the ground and decaying on the ground in the plant bed area.

Vacuum Assembly 1900

As best seen in FIGS. 20-23 and 36-40, the vacuum assembly includes the vacuum connector 1910, which, as described above is also part of the head assembly 1300 of the power operated rotary knife 1100, a flexible vacuum hose 1990, which is coupled to an upper or exit end 1925 of the vacuum connector 1910 by a clamp 1995. In one exemplary embodiment, the vacuum hose is a 4 in. diameter flexible hose or duct which defines the interior region 1992 of the vacuum hose 1990.

The vacuum connector 1910 has a generally inverted funnel shape and includes the lower, larger diameter lower mounting section 1950 and an upper, reduced diameter cylindrical section 1920, bridged by a tapered middle section 1940 that necks down the diameter between the mounting section 1950 and the cylindrical section 1920. An inner wall or inner surface 1911 of the vacuum connector 1910 defines the inverted funnel-shaped interior region 1912 that is in fluid communication with the interior region 1992 of the vacuum hose 1990. An outer wall or outer surface 1913 is radially spaced from the inner wall 1911 and generally conforms to the shaped of the inner wall 1911. Advantageously, the necked down configuration of the vacuum connector 1910 provides for the funnel shape of the interior region 1912 that proceeds from a larger diameter at a generally cylindrical entry end 1916 of the vacuum connector 1910, where trimmed branches/foliage material enter the interior region 1912 of the vacuum connector 1910 from the cutting opening CO of the power operated rotary knife 1100 defined by the assembled combination 1450 of the blade 1500, blade housing 1600 and trim guide 1700, to a cylindrical exit or upper end 1914 of the vacuum connector 1910, where trimmed branches and foliage material exit the interior region 1912 of the vacuum connector 1910. Additionally, the inner surface 1911 of the vacuum connector 1910 is smooth, with minimal discontinuities, to facilitate flow of trimmed foliage materials from the entry end 1916 to the exit end 1914 of the vacuum connector 1910. The vacuum connector 1910 is centered about a central axis VCA extending though the interior region 1912 of the vacuum connector 1910. When the vacuum connector 1910 is coupled to the head assembly 1300 of the power operated rotary knife 1100, the central axis VCA of the vacuum connector 1910 is substantially parallel to but slightly offset by a radial distance schematically shown as distance d in FIG. 21, from the central axis of rotation R of the rotary knife blade 1500. In one exemplary embodiment, an offset distance d between the rotary knife blade axis of rotation R and the vacuum connector central axis VAC is 0.200 in.

The lower mounting section 1950 of the vacuum connector 1910 includes a lower end 1952. The lower end 1952 of the mounting section 1950 includes a lower edge 1958. The lower end 1952 of the mounting section 1950 corresponds to a lower end 1916 of the vacuum connector 1910. The lower edge 1958 of the lower end 1952 of the mounting section 1950, which corresponds to a lower edge 1918 of the lower end 1916 of the vacuum connector 1910, is defined by an axially lowest peripheral edge 1979 of a C-shaped latch 1972 of the a trim guide interface portion 1970. A generally proximal portion 1954 of the lower end 1952 includes a clamp interface portion 1960, while a generally distal portion 1959 of the lower end 1952 includes the trim guide interface portion 1970. The clamp interface portion 1960 extends peripherally between approximate endpoints 1954*a*, 1954*b* of the proximal portion 1954, while the trim guide interface portion 1960 includes the remainder of the lower end 1952. The arcuate trim guide interface portion 1970 and the clamp interface portion 1960, advantageously function in co-acting relationship to releasably secure the vacuum connector 1910 to the head assembly 1300 of the power operated rotary knife 1100.

The arcuate trim guide interface portion 1970 of the lower mounting section 1950 of the vacuum connector 1910 includes the radially extending arcuate rim portion 1971 that seats on the rib 1751, the vertical extension 1754 and the lip 1770 of the guard section 1750 of the trim guide 1700. As can be seen in FIG. 21, more specifically, extending from the annular rim 1953 of the trim guide interface portion 1970 of the vacuum connector 1910 is the C-shaped latch 1972 that hooks over and thereby attaches the vacuum connector 1910 to the guard section 1750 of the trim guide 1700, acting in cooperation with the clamp interface portion 1960. The arcuate trim guide interface portion 1970 extends radially outwardly from and axially below the entry opening 1914 of the vacuum connector 1910 and subtends an angle of approximately 270° with respect to the central axis VCA of the vacuum connector 1910. That is, the trim guide interface portion 1970 (approximately 270°) and the clamp interface portion 1960 (approximately 90°) circumscribe the entirety of the circular lower peripheral surface of the vacuum connector 1910 with respect to the vacuum connector central axis VCA.

The C-shaped latch 1972 of the trim guide interface portion 1970 is located at and extends from a lower end 1956 of the distal portion 1952 of the lower mounting section 1950 of the vacuum connector 1910. The C-shaped latch 1972 includes an upper horizontal section 1973, a vertical section 1975, and a lower frustoconical section 1977. When the trim guide interface portion 1960 is latched to the trim guide 1700, a horizontal wall 1974 of the upper horizontal section 1973 bears against an upper surface 1772 of the radially inwardly extending lip 1770 of the guard section 1750 in the trim guide 1700, a vertical wall 1976 of the middle vertical section 1975 bears against an outer surface 1753 of the vertical extension 1754 of the guard section 1750 of the trim guide 1700, and an angled wall 1978 bears against the outer surface 1753 of the frustoconical section 1752 of the rib 1751 of the guard section 1750 of the trim guide 1700. The axially lowest peripheral edge 1979 of the C-shaped latch 1972 defines the lower edge 1918 of the lower end 1916 of the vacuum connector 1910 and the lower edge 1958 of the lower end 1952 of mounting section 1950.

Figure 40:
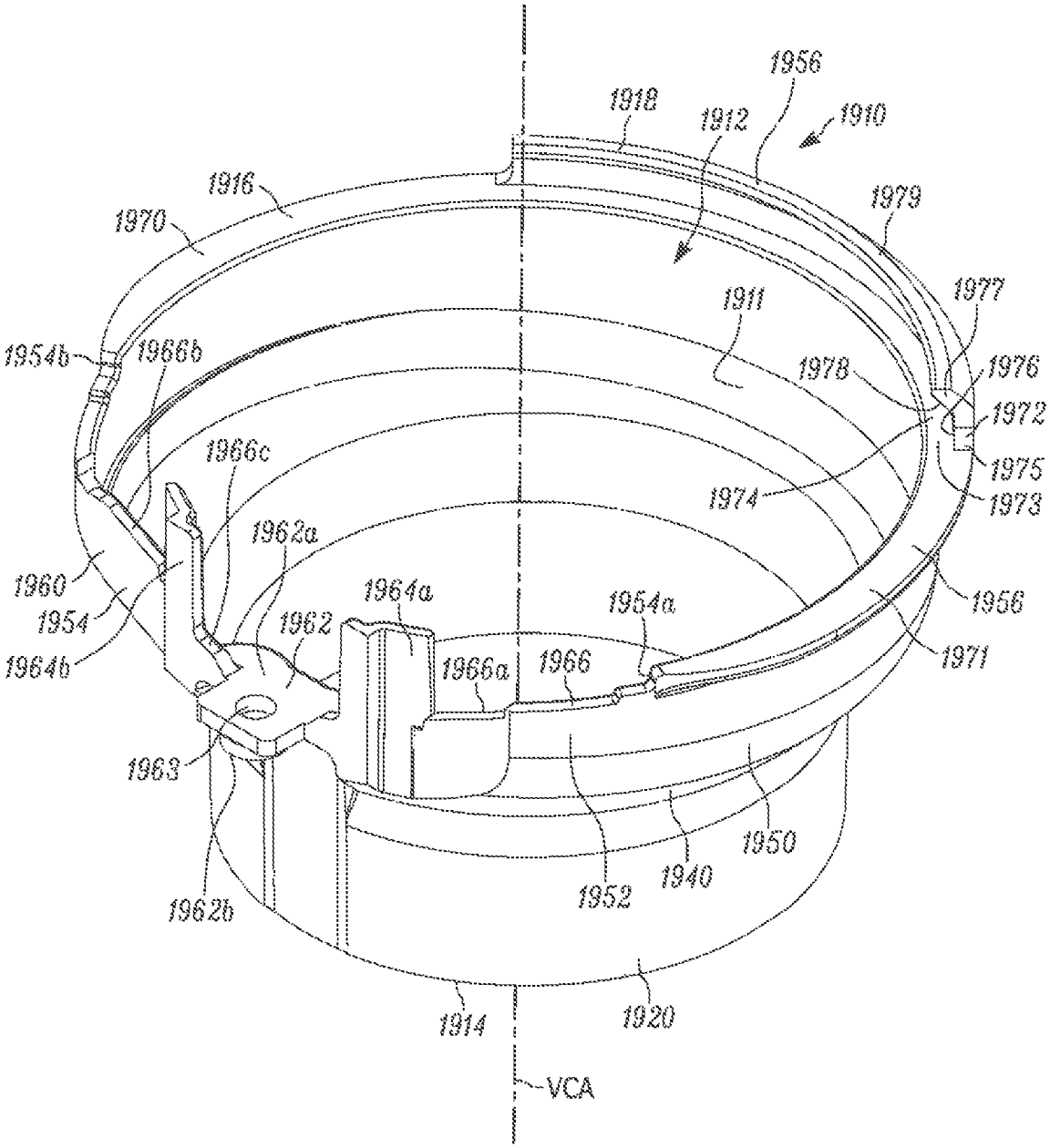
FIG. 40 is a schematic bottom perspective view of the vacuum connector of FIG. 36.

Additionally, as best seen in FIG. 40, the clamp interface portion 1960 of the proximal portion 1954 of the lower mounting section 1950 includes a radially protruding boss 1962 having a planar lower surface 1962*a* and a cylindrical projection 1962*b* extending axially upwardly. The boss 1962 defines a vertical opening 1963. A threaded connector 1980, preferably a thumb screw, extends through the boss vertical opening 1963 and threads into a threaded vertically extending opening 1342 in an upper surface 1340 of the clamp 1332 of the clamping assembly 1330 to secure the vacuum connector 1910 to the clamp 1332 of the clamp assembly 1330. Stated another way, the threaded fastener/thumb screw 1980 extends through the vertically oriented opening 1963 of the radially extending boss 1962 of the clamp interface portion 1960 of the mounting section 1950 and threads into the threaded opening 1342 formed in the upper surface 1340 of the clamp member 1332 to secure the vacuum connector 1910 to the clamp member 1332 and thereby couple the vacuum connector 1910 to the frame body 1310.

The clamp interface portion 1960 further includes a pair of axially extending pedestals 1964*a*, 1964*b* circumferentially flanking the boss 1962. The pair of pedestals 1964*a*, 1964*b* fit into and engage respective ones of a pair of axially extending slots 1335 formed in the proximal wall 1333 of the clamp 1332. The clamp interface portion 1960 further includes a contoured opening 1966 sized and shaped to engage the upper surface 1340 of the clamp 1332. The contoured opening 1966 is defined by the lower edge 1958 of the lower end 1952 of the vacuum connector 1910 in the region of the clamp interface portion 1960. The contoured opening 1966 of the clamp interface portion 1960 comprises a pair of lateral contoured openings 1966*a*, 1966*b* and a central contoured opening 1966*c*. The contoured opening 1966*a* is adjacent the pedestal 1964*a*, while the contoured opening 1962*b* is adjacent the pedestal 1964*b*. The central contoured opening 1966*c*, which includes the generally planar lower surface 1962*a* of the boss 1962, engages a central portion 1341 of the upper surface 1340 of the clamp 1332. The contoured opening 1962 is defined by a lower peripheral edge 1964 of the lower mounting section 1950 in the region of the clamp 1332. The peripheral edge 1964 bears against the upper surface 1340 of the clamp 1332 along a region of contact corresponding to the clamp interface portion 1960, that is, the portion 1954 of the lower end 1952 of the mounting section 1950 of the vacuum connector 1910 corresponding to the clamp interface portion 1960 to provide a seal between the vacuum connector 1910 and the clamp upper surface 1340 to mitigate loss of vacuum pressure which would otherwise occur if there was a gap or space between the vacuum connector 1910 and the upper surface of the clamp 1332.

Third Exemplary Embodiment—Power Operated Rotary Knife Assembly 2000

Figure 41:
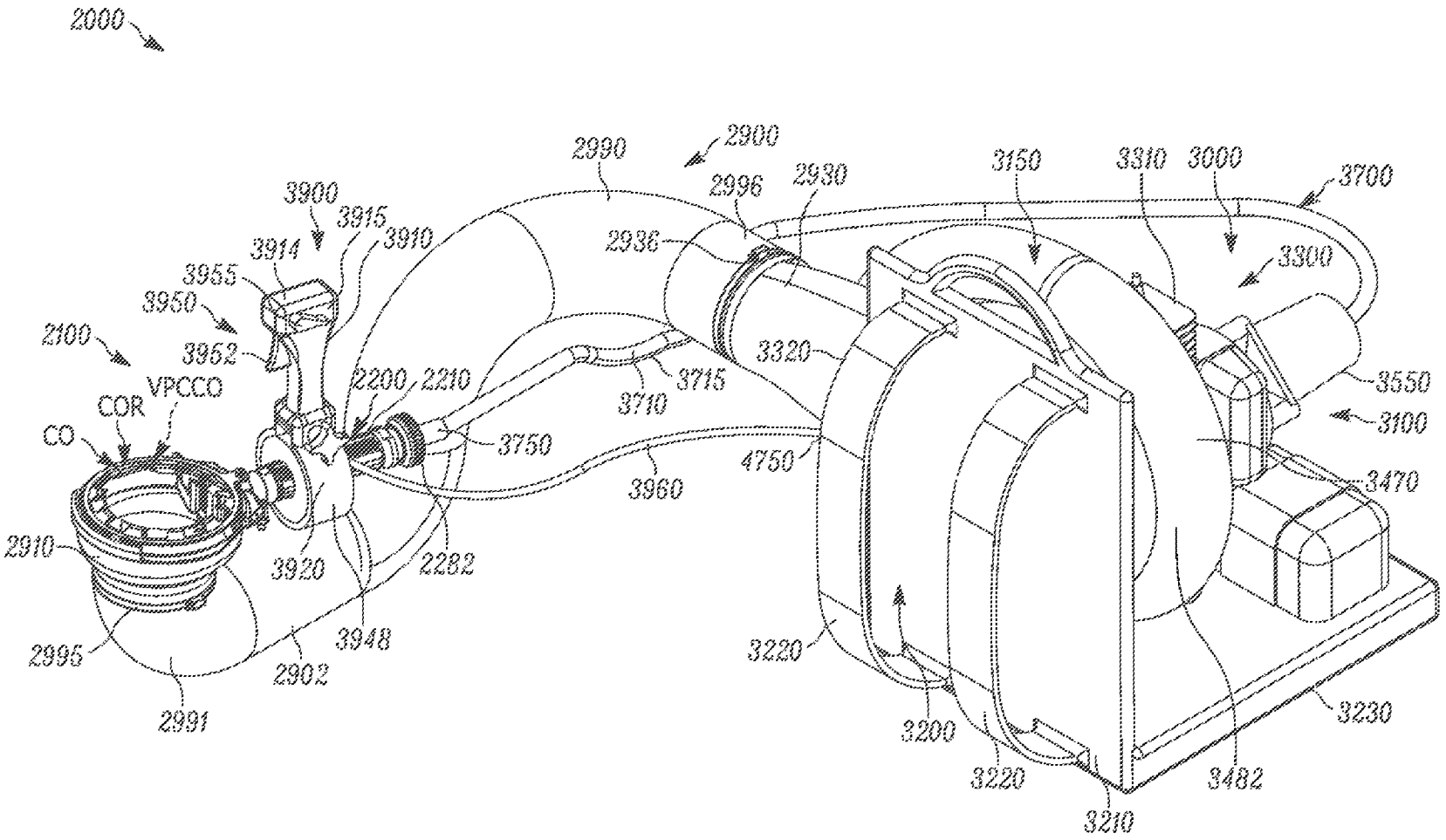
FIG. 41 is a schematic top front perspective view of a third exemplary embodiment of a power operated rotary knife assembly of the present disclosure including a power operated rotary knife, a vacuum assembly, a flexible shaft drive transmission, a handle extension assembly, a speed control assembly, and a portable power unit including a rotational power source and a vacuum source.
Figure 42:
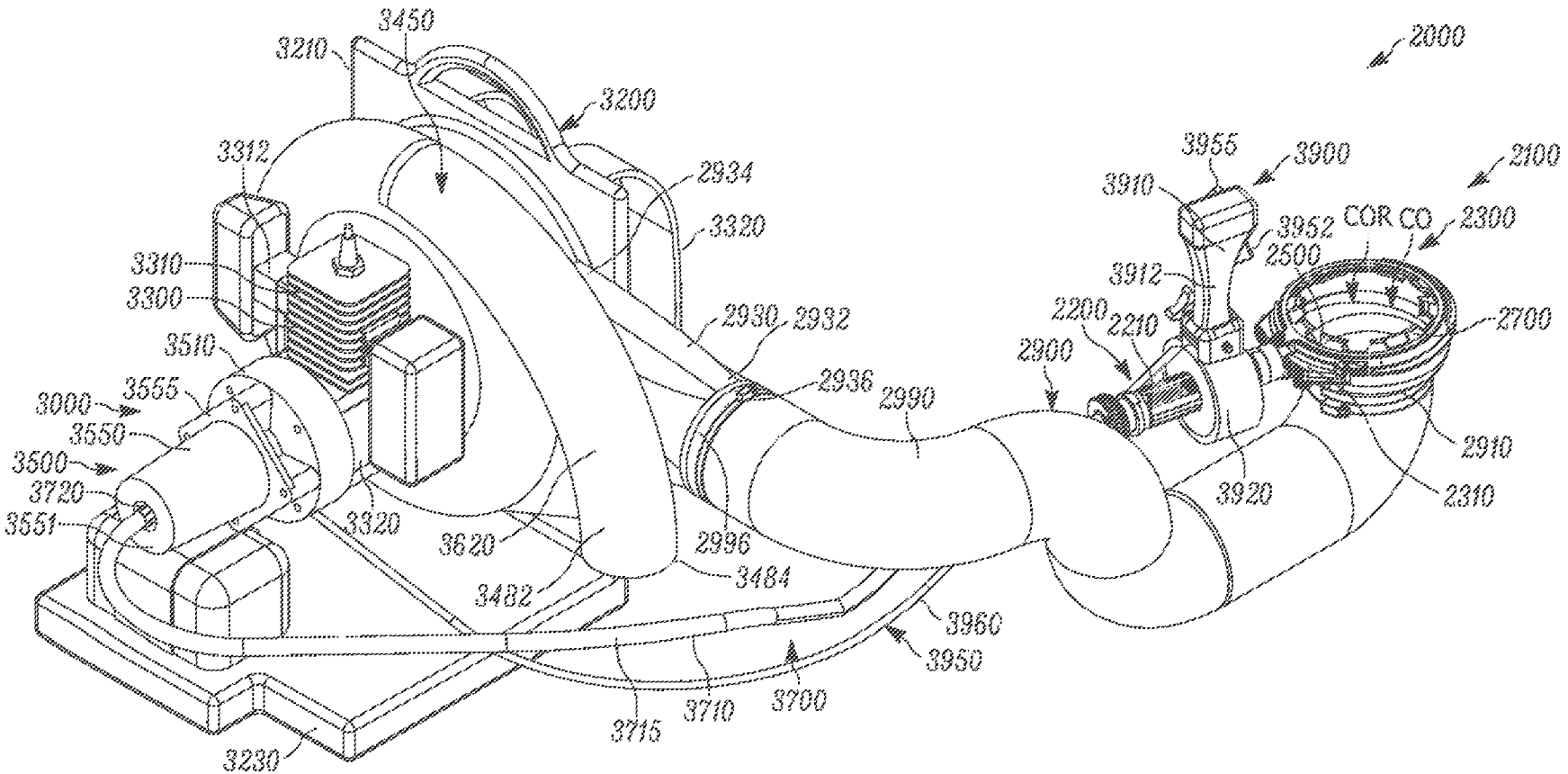
FIG. 42 is a schematic top back perspective view of the power operated rotary knife assembly of FIG. 41.

A third exemplary embodiment of a power operated rotary knife assembly of the present disclosure is schematically shown, generally at 2000, in FIGS. 41 and 42. The power operated rotary knife assembly 2000 includes a power operated rotary knife 2100, generally similar in structure and function to the power operated rotary knife 1100 of the power operated rotary knife assembly 1000 of the second exemplary embodiment, and a vacuum assembly 2900, generally similar in structure and function to the vacuum assembly 1900 of the power operated rotary knife assembly 1000 of the second exemplary embodiment. The power operated rotary knife 2100 includes a head assembly 2300, substantially similar to the head assembly 1300 of the second exemplary embodiment, and an elongated handle assembly 2200 extending along a longitudinal axis LA, substantially similar to the handle assembly 1200 of the second exemplary embodiment, extending away from the head assembly 2300. The head assembly 2300 includes an annular, notched rotary knife blade 2500 supported for rotation about a central axis of rotation R by a stationary blade housing 2600. A stationary annular trim guide 2700 is positioned adjacent the rotary knife blade and includes a plurality of notches that provide for a shearing action between overlapping axially aligned cutting portions of the notches of the rotary knife blade and shearing portions of the notches of the trim guide 2700, as previously described with respect to the rotary knife blade 1500 and trim guide 1700 of the power operated rotary knife 1100 of the second exemplary embodiment. The blade housing 2600 is positioned between the rotary knife blade 2500 and the trim guide 2700 and, like the blade housing 1600 of the second exemplary embodiment, supports the blade 2500 for rotation about its axis of rotation R.

Both the rotary knife blade 2500, the blade housing 2600 and the trim guide 2700 are annular and thus have central open regions or central openings (identified as CO1, CO2, CO3 in the second embodiment and shown schematically in FIGS. 27 and 27). As explained with respect to the second embodiment, the annular shapes of the rotary knife blade 2500 and the trim guide 2700 define a generally planar central cutting opening CO of the power operated rotary knife 2100, as shown schematically in FIGS. 41-46. As explained with respect to the second embodiment, the blade housing 2600 is not part of the cutting process, being radially recessed from the cutting opening CO.

Additionally and advantageously, the power operated rotary knife assembly 2000 of the third exemplary embodiment further includes a portable power unit 3000 (FIGS. 47, 48 and 50) and a flexible shaft drive assembly or transmission 3700 (FIGS. 50 and 51) operatively coupling the portable power unit 3000 to a drive mechanism 2400 of the power operated rotary knife 2100. In one exemplary embodiment, the portable power unit 3000 is both remote from the power operated rotary knife 2100 and is suitable to be carried by an operator as the operator moves along a rows of plants, such as grape vines, performing cutting and/or trimming operations. In this way, the operator is free to move freely and unencumbered along and between rows of plants and advantageously position his or her body and manipulate the power operated rotary knife 2100 such that the central cutting opening CO of the power operated rotary knife 2100 is properly presented to and moved with respect to and through the plant foliage for efficient cutting and trimming operations. That is, advantageously, the portable power unit 3000 is spaced from the power operated rotary knife 2100 so as not to interfere with the operator's grasping or holding of the knife 2100 or the operator's manipulation of the cutting opening CO of the knife 2100 in cutting/trimming operations. Nor is the weight of the portable power unit 3000 added to the weight of the power operated rotary knife 2100, that is, the hand of the operator grasping and manipulating the knife 2100 is not burdened with the weight of the portable power unit 3000. In one exemplary embodiment, the portable power unit 3000 is mounted on a lightweight support frame 3200 configured to be carried akin to a backpack on the shoulders of the operator utilizing a pair of vertically extending shoulder straps 3220 affixed to a vertical support 3210 of the support frame 3200.

In one exemplary embodiment, portable power unit 3000 comprises a drive motor assembly 3300, including a rotatably driven crankshaft or driveshaft 3400, and a blower assembly 3450, including a centrifugal-type fan 3460. Advantageously, the drive motor assembly 3300 and the blower assembly 3450 are operatively coupled by and through the rotating driveshaft 3400 of the drive motor assembly 3300 which is common to or a part of both assemblies 3300, 3450. Advantageously, the rotating driveshaft 3400 both provides the rotational power source 3100 to rotate the rotary knife blade 2500 of the power operated rotary knife 2100 about the central axis of rotation R and provides the vacuum source 3150 by rotating the centrifugal-type fan 3460 of the blower mechanism 3450 of the drive motor assembly 3300. That is, the rotating driveshaft 3400 powers both the rotary knife blade 2500 of the power operated rotary knife 2100 and powers the centrifugal fan 3460 of the blower mechanism 3450.

In one exemplary embodiment, the flexible shaft drive assembly or transmission 3700 includes an outer casing assembly 3710 and a flex shaft assembly 3800, which is rotatably supported within a tubular throughbore defined by the outer casing 3710. The outer casing assembly 3710 is stationary with respect to the rotating flex shaft assembly 3800 and includes an outer casing 3715, a motor end coupling 3720, at a proximal end of the outer casing 3715, and the handle assembly coupling 3750, at a distal end of the outer casing 3715. The outer casing 3715 comprising a flexible tube including one or more tubular layers of plastic material, such as nylon, and, optionally, also may include one or more layers of braided wire between the tubular layers for added strength and durability. The flex shaft assembly 3800 of the flexible shaft drive transmission 3700 includes a rotating drive transmitting shaft or flex shaft 3802, a first, driven fitting 3820 at a first, motor or proximal end 3810 of the flex shaft 3802 and the second, male drive fitting 3850 at a second, handle assembly or distal end 3812 of the flex shaft 3802. When a motor end coupling 3720 of the shaft drive transmission 3700 is in an engaged state (operatively coupled or connected) with a drive motor coupling 3550 of a drive motor coupling assembly 3500 of the drive motor assembly 3300 of the portable power unit 3000, the first, driven fitting 3820 of the flex shaft assembly 3800 is operatively engaged with a drive fitting 3410 of a drive motor assembly 3300. Actuation of the drive motor assembly 3300, when the motor end coupling 3720 of the shaft drive transmission 3700 and the drive motor coupling 3550 of the drive motor coupling assembly 3500 are in the engaged state results in rotation of the flex shaft 3802 and, via an operative interconnection of the second, male drive fitting 3850 of the flex shaft assembly 3800 with the drive mechanism 2400 of the power operated rotary knife 2100, rotation of the rotary knife blade 2500 about the blade central axis or rotation R. Additional details regarding the structure and function of the flexible shaft drive transmission 3700 are found in U.S. Pat. No. 9,121,438, issued Sep. 1, 2015 to Mascari. The aforesaid U.S. Pat. No. 9,121,438 is assigned to the assignee of the present application and is hereby incorporated herein in its entirety by reference.

The power operated rotary knife assembly 2000 of the third exemplary embodiment is advantageously suited for the trimming/cutting of leaves of grape vines. In the production of fine table wines, grape vineyard owners and managers must carefully control the amount of sun that is received by the clusters of grapes growing on grape vines. In order to provide a requisite amount of sun, the leaves of the grape vines often require period pruning through the growing season. The power operated rotary knife assembly 2000 advantageously allows for efficient and effective power-assisted hand trimming of foliage (i.e., leaves, stems of leaves and small runners, etc.) the grape vines that would otherwise block grape clusters from receiving a requisite amount of sunlight. Moreover, because the power operated rotary knife 2100 is capable of being easily and accurately manipulated by the operator using an upward sweeping motion of the power operated rotary knife 2100 with the knife being in the orientation of; for example, FIG. 41, undesirable over-trimming and/or damage to the grapes or vines is mitigated. To use the power operated rotary knife assembly 2000, the operator positions the cutting opening CO of the power operated rotary knife 2100 generally horizontally and vertically below the grape leaf or leaves desired to be cut from the grape vine. The operator then sweeps the knife 2100 generally arcuately upwardly to trim the grape foliage (leaves, leaf stems, runners, etc.). Advantageously, the power operated rotary knife 2100 includes a handle extension 3910 of a speed control/handle extension assembly that is substantially parallel to the central axis of rotation R of the rotary knife blade 2500 and substantially orthogonal to the handle assembly longitudinal axis LA. The operator grips a finger gripping portion 3912 of the handle extension 3910 and advantageously moves the power operated rotary knife in a natural upward, arcuate sweeping motion by bending his or her arm at the elbow.

A vacuum suction or vacuum pressure condition (schematically represented as arrow VPCCO in FIGS. 41 and 43-45) drawn by the blower assembly 3450 of the portable power unit 3000 and transmitted by the vacuum assembly 2900 to a region COR of the cutting opening CO of the power operated rotary knife 2100 tends to advantageously gently pull or draw the foliage (i.e., grape leaves) to be trimmed which are adjacent or above the cutting opening CO into the cutting opening where they are efficiently and effectively cut by the shearing action of the rotary knife blade 2500 and the trim guide 2700. That is, in the cutting opening region COR of the cutting opening CO, the vacuum suction VPCCO at the cutting opening CO will draw or pull foliage to be trimmed into the cutting opening CO and, in cooperation with the movement of the power operated rotary knife 2100 by the operator, the foliage will be moved into contact with the overlapping axially aligned cutting portions of the notches of the rotary knife blade 2500 and shearing portions of the notches of the trim guide 2700 causing efficient cutting of the foliage. The trimmed or cut grape leaves, cut grape leaf stems, cut grape vine runners, etc. (generally, trimmed foliage or trimmed foliage material) is advantageously routed through the vacuum assembly 2900 and subsequently passes through a spiral turbine or spiral duct 3470 of the portable power unit 3000 and is then blown toward the ground upon exiting an exit opening 3484 of a blower or outlet side duct 3482 of the spiral duct 3470. Blowing of the trimmed foliage material on the ground adjacent the grape vines is generally acceptable and, thus, there is no reason to collect the trimmed foliage. However, as one of skill in the art would recognize, the provision of a collection receptacle coupled to the blower side duct exit opening 3484 could be added to the lightweight support frame 3200, or otherwise supported by the operator's body, if it was desired to collect the trimmed foliage material rather than blowing the trimmed foliage to the ground. It is within the contemplation of the present disclosure to provide such a collection receptacle for the power operated rotary knife assembly 2000, if desired.

For brevity, the structural details/functions/advantages of those components and assemblies of the power operated rotary knife assembly 2000 which are similar to the corresponding components and assemblies of the power operated rotary knife assembly 1000 or the power operated rotary knife 100 will not be repeated in detail, all of the structural details/functions/advantages discussed above with respect to the power operated rotary knife assembly 1000 and the power operated rotary knife 100 are hereby incorporated by reference with respect to the third exemplary embodiment. Explanations regarding the description of the power operated rotary knife assembly 1000 and power operated rotary knife 100, set forth above, are also hereby incorporated by reference with respect to the third exemplary embodiment. Common reference numbers and letters used in the three embodiments are assumed to represent similar concepts and/or structural details.

Overview

Figure 51:
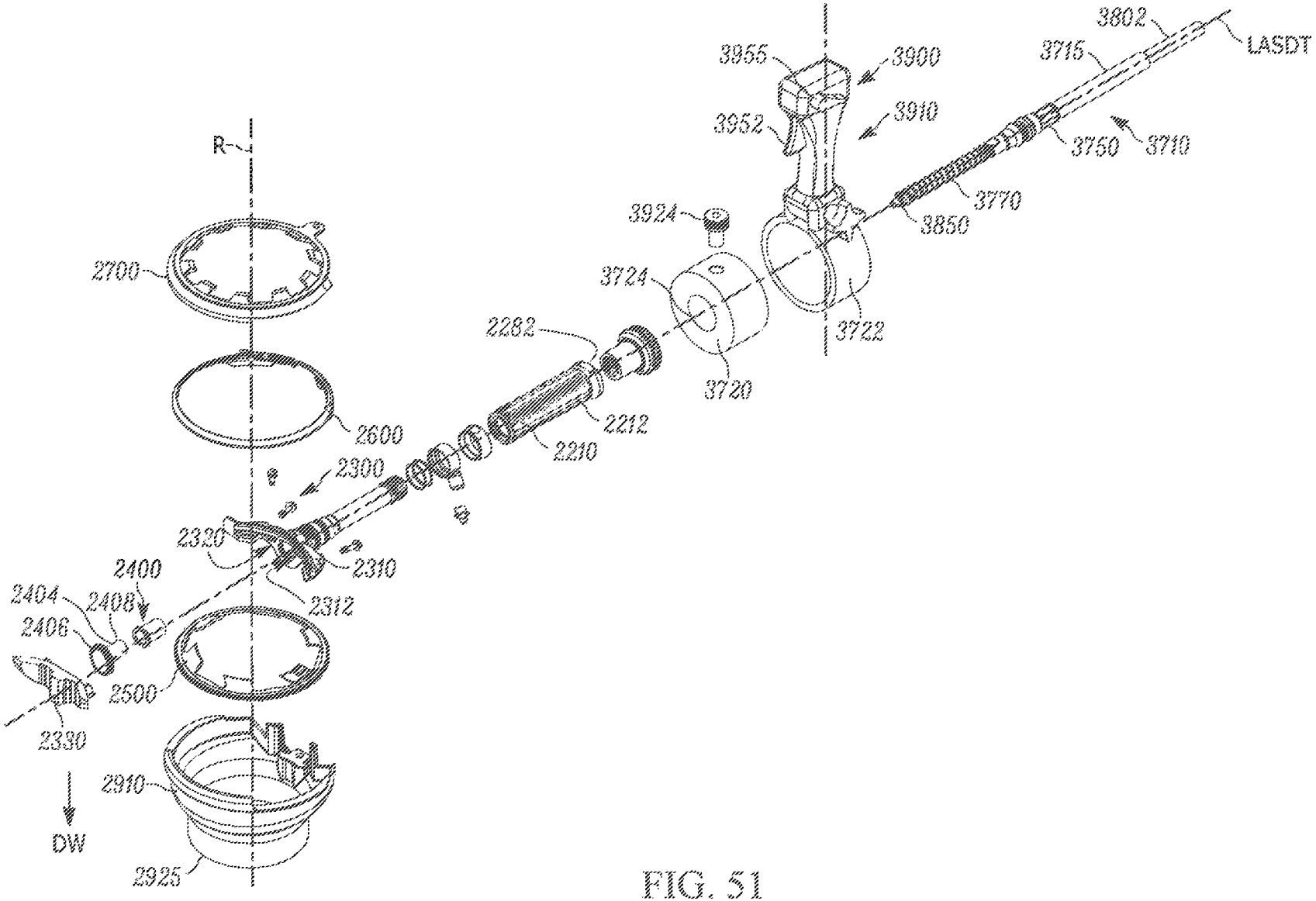
FIG. 51 is a schematic explode front perspective view of portions of the power operated rotary knife, the vacuum assembly, the flexible shaft drive transmission, the speed control assembly, and the handle extension assembly of the power operated rotary knife assembly of FIG. 41.

As best seen in FIG. 51, the head assembly 2300 of the power operated rotary knife 2100 includes a frame body 2310, a clamping assembly 2330, along with a rotating, notched annular rotary knife blade 2500 and a coacting stationary, notched trim guide 2700. The rotary knife blade 2500 is supported by the stationary blade housing 2600 for rotation about a central axis of rotation R of the blade 2500. The blade housing 2600 is positioned between the rotary knife blade 2500 and the trim guide 2700 and is releasably secured by the clamping assembly 2330 to a forward or distal blade housing support region 2320 of the frame body 2310. When the rotary knife blade 2500, the blade housing 2600 and the trim guide 2700 are assembled and attached to a frame body 2310 of the head assembly 2300, the central cutting opening CO is defined by a combination of the blade 2500 and the trim guide 2700 where cutting and trimming take place, as previously described.

The power operated rotary knife 2100 further includes the elongated handle assembly 2200 defining and extending along a handle assembly longitudinal axis LA, which is substantially orthogonal to and intersection the rotary knife blade central axis of rotation R. The head assembly 2300 releasably affixed to a distal end of the handle assembly 2200, as previously described. The head assembly 2300 of the power operated rotary knife 2100 also includes a drive mechanism 2400, similar to the drive mechanism 1400 of the power operated rotary knife 1100. The frame body 2310 supports a drive mechanism 2400 of the power operated rotary knife 2100 which is operatively coupled to the rotary knife blade 2500 to rotate the blade 2500 about its central axis of rotation R. In one exemplary embodiment, the drive mechanism 2400 comprises a pinion gear 2404 rotatably supported in a throughbore 2312 of the frame body 2310. As previously described with respect to the pinion gear 404 of the power operated rotary knife 100 of the first exemplary embodiment, the pinion gear 2404 rotates about a pinion gear axis that is substantially coincident with the handle assembly longitudinal axis LA and includes a gear head 2406 that operatively engages a driven gear of the rotary knife blade 2500 to rotate the blade about the blade central axis of rotation R.

Similar to the vacuum assembly 1900 of the power operated rotary knife assembly 1000 of the second exemplary embodiment, the vacuum assembly 2900 includes the vacuum connector 2910, which is both part of the vacuum assembly 2900 and is also part of the head assembly 2300 of the power operated rotary knife 2100 and a flexible vacuum hose 2990. A distal or entrance end portion 2991 of the vacuum hose 2990 is coupled to an exit end 2925 of the vacuum connector 2910 by a clamp 2995. In one exemplary embodiment, the vacuum hose 2990 is a 4 in. diameter flexible hose or duct which defines an interior region 2992 of the vacuum hose 2990.

As noted above, the power operated rotary knife assembly 2000 of the third exemplary embodiment further includes a portable power unit 3000 and a flexible shaft drive assembly or transmission 3700 operatively coupling the portable power unit 3000 to the drive mechanism 2400 of the power operated rotary knife 2100. Advantageously, the portable power unit 3000 provides: a) a rotational power source 3100 that is operatively coupled via the flexible shaft drive assembly or transmission 3700 to the drive mechanism 2400 of the power operated rotary knife 2100 to rotatably drive the rotary knife blade about its central axis of rotation R; and b) a vacuum source 3150 that is operatively coupled to a proximal or exit end portion 2996 of the vacuum hose 2990 of the vacuum assembly 2900 to draw vacuum pressure in the interior region 2992 of the vacuum hose 2990. In one exemplary embodiment, both the rotational power source 3100 and the vacuum source 3150 are provided by the single drive motor assembly 3300. As noted previously, the drive motor assembly 3300 includes the rotating crankshaft or driveshaft 3400 which provides the rotational power source 3100 and the blower mechanism 3450 which provides the vacuum source 3150. Advantageously, the driveshaft 3400 powers the blower mechanism 3450.

Figure 50:
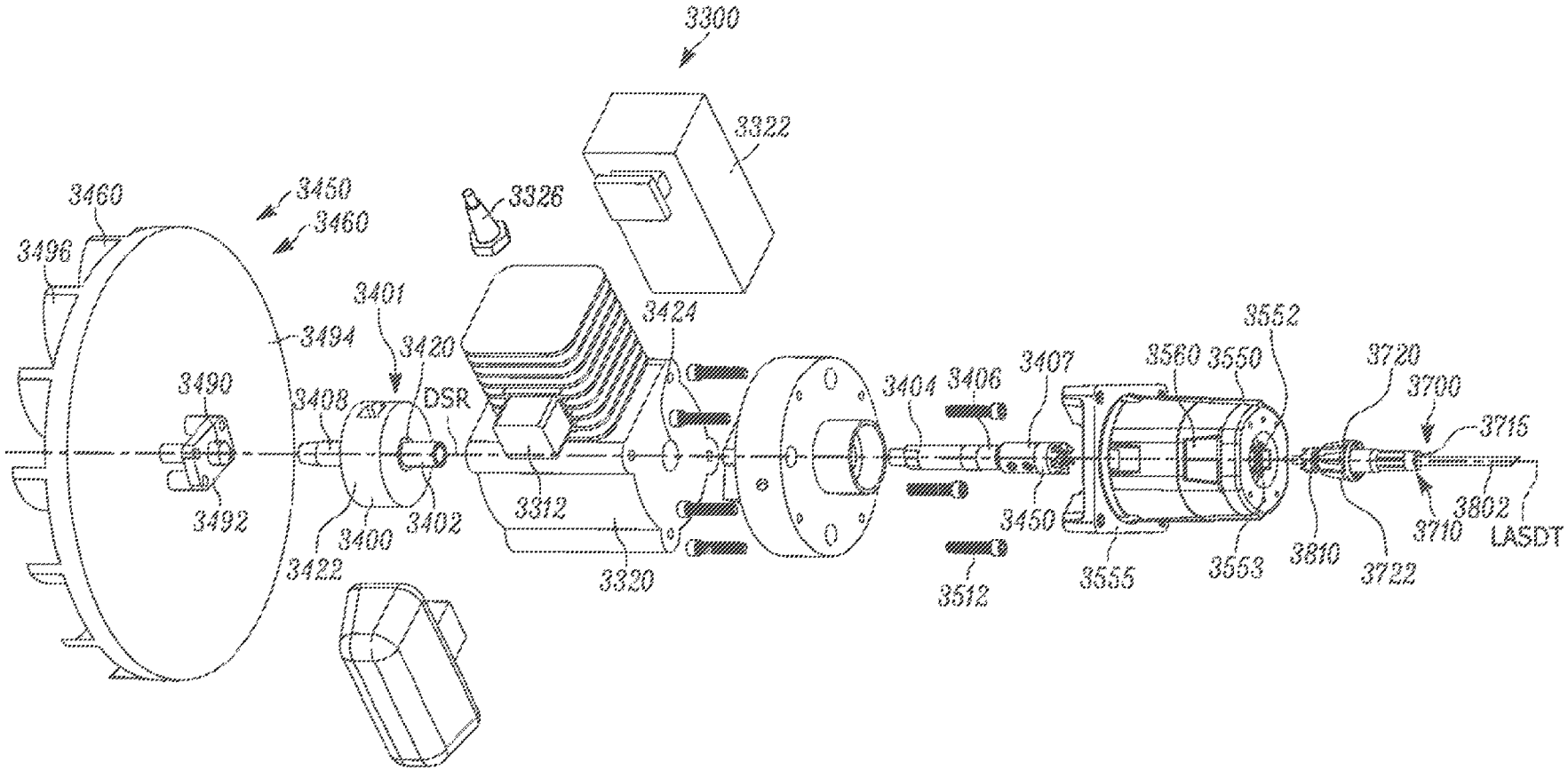
FIG. 50 is a schematic exploded side perspective view of the portable power unit of FIG. 47.

In one exemplary embodiment, as best seen in FIG. 50, coupled to a distal end portion 3402 of the driveshaft 3400 is a multi-engagement face drive fitting 3410. The rotation of the driveshaft 3400 provides rotational power through the drive fitting 3410 to rotate the cooperating driven fitting 3820 mounted to the motor or proximal end 3810 of the flex shaft 3802 of the flex shaft assembly 3800 of the flexible shaft drive transmission 3700. Rotation of the flex shaft 3802 causes rotation of the male drive fitting 3850 at the distal or handle assembly end 3812 of the flex shaft 3802. The male drive fitting 3850, in turn, is operatively coupled to an input shaft 2408 at a back end of the pinion gear 2404 of the drive mechanism 2400 of the power operated rotary knife 2100. A gear head 2406 of the pinion gear 2404 engages a rotary driven gear of the rotary knife blade 2500. Thus, rotation of the driveshaft 3400 causes rotation of the rotary knife blade 2500 about the blade central axis of rotation R.

Figure 45:
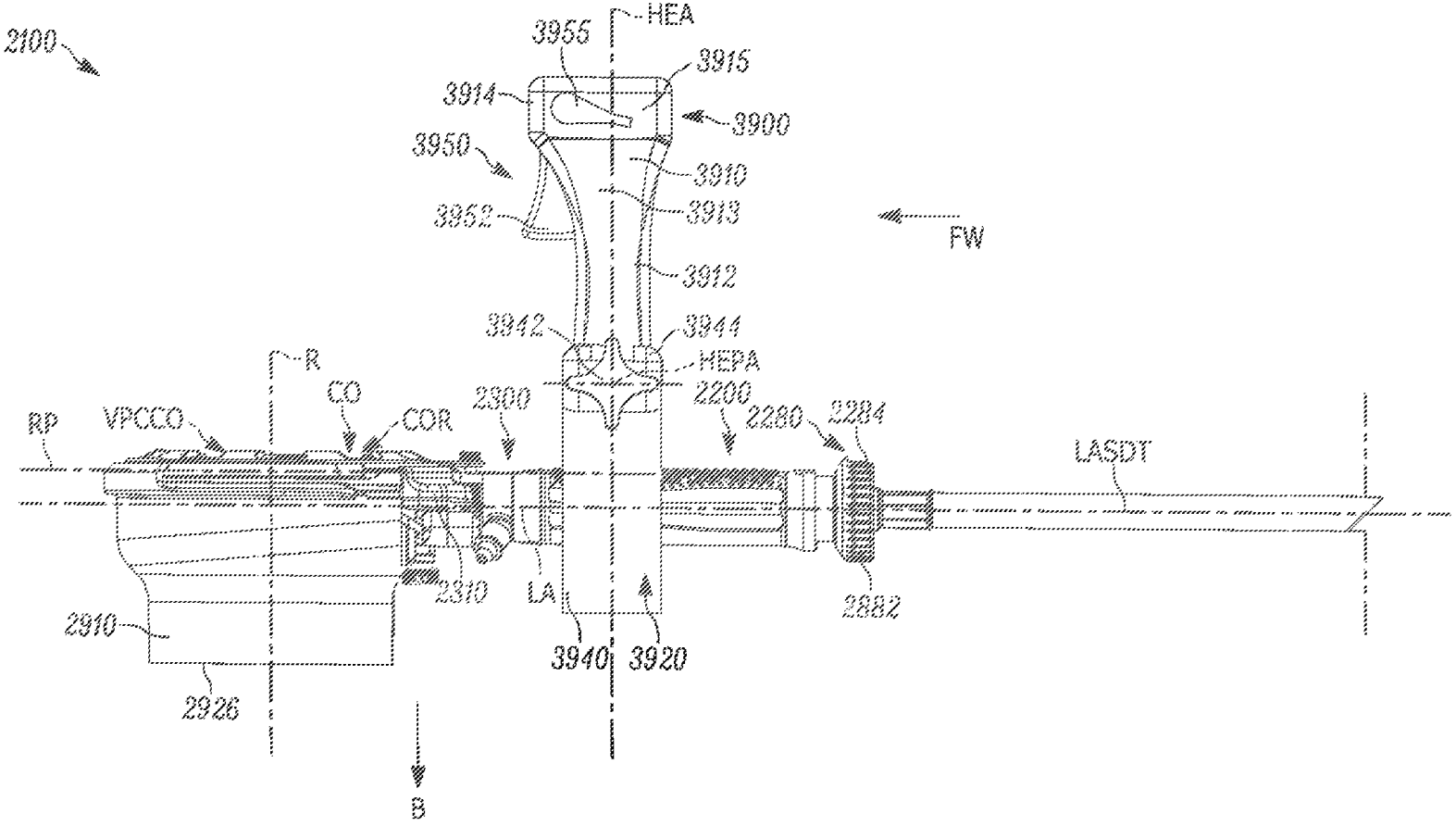
FIG. 45 is a schematic side elevation view of the distal portion of the power operated rotary knife assembly of FIG. 43.
Figure 46:
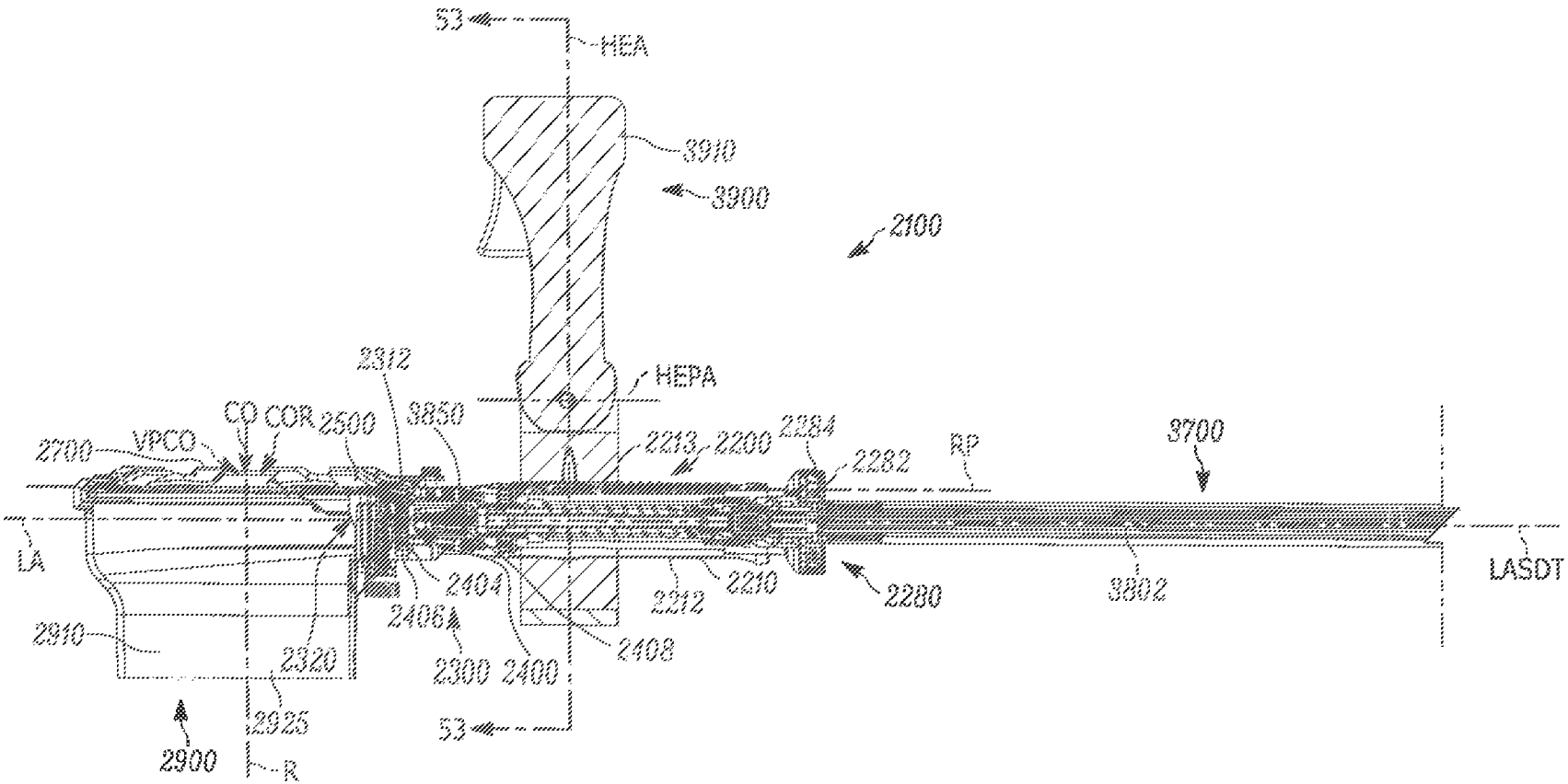
FIG. 46 is a schematic longitudinal section view of the distal portion of the power operated rotary knife assembly of FIG. 43.

As can best be seen in FIGS. 45, 46 and 50, the flexible shaft drive transmission 3700 includes a first end adjacent the drive motor assembly 3300, an opposite or second end, adjacent the power operated rotary knife handle assembly 2200, and a flexible, elongated central portion. When driven by the drive motor assembly 3300, the flex shaft 3802 of the flex shaft assembly 3800 rotates about an axis of rotation which is substantially congruent with a central longitudinal axis LASDT of the flexible shaft drive transmission 3700, which is also the central longitudinal axis LASDT of the flex shaft assembly 3800. That is, the central longitudinal axis LASDT of the shaft drive transmission 3700 is substantially congruent with a center line though the flex shaft 3802 and also defines a central longitudinal axis of the flexible shaft drive transmission 3700. In the region of the handle assembly 2200, the central longitudinal axis LASDT is substantially aligned with and coincident with the longitudinal axis LA of the handle assembly 2200 and, in the region of the motor driveshaft 3400, the central longitudinal axis LASDT is substantially aligned with and coincident with a central axis is rotation of the driveshaft 3400.

In one exemplary embodiment, the handle assembly coupling 3750 includes a driver assembly 3770 (FIG. 51). As seen in FIG. 46, when fully inserted into a frame tube of the handle assembly 2200, the driver assembly 3770 positions the male drive fitting 3850 of the flex shaft assembly 3800 into driving engagement with the input shaft 2408 at a back end of the pinion gear 2404 of the drive mechanism 2400 of the power operated rotary knife 2100. The handle assembly 2200 includes a drive shaft latching assembly 2280 to releasably secure the driver assembly 3770 to the handle assembly 2200. In one exemplary embodiment, a slidable latching member2284 supported by a latching knob 2282 engages an annular recess of the driver assembly 3770 to releasably secure the driver assembly 3770 to the handle assembly 2200. The latching knob 2282 of the drive shaft latching assembly 2280 threads onto a threaded proximal end section of the frame tube extending from the frame body 2310. When the latching knob 2282 is threaded onto the threaded proximal end section of the frame tube, the hand piece 2210 of the handle assembly 2200 is thereby sandwiched and secured to a rearwardly or proximally extending annular boss of the frame body 2310.

Drive Motor Assembly 3300

As previously noted, in one exemplary embodiment of the present disclosure, the remote, portable power unit 3000 comprises the drive motor assembly 3300 and the blower assembly 3450. The driveshaft 3400 is part of both the drive motor assembly 3300 and the blower assembly 3450 and provides both the rotational power source 3100, in conjunction with the flexible shaft drive transmission 3700, to rotate the rotary knife blade 2500 about its axis of rotation R and provides the vacuum source 3150, in conjunction with the centrifugal fan 3460, the spiral turbine or duct 3470 and the vacuum assembly 2900, to provide vacuum pressure at the cutting opening CO of the power operated rotary knife 2100.

In one exemplary embodiment of the present disclosure, the portable power unit 3000 is a modified version of a commercially available outdoor power equipment product, namely, a power leaf blower, modified to both provide the rotational power source 3100 operatively coupled to the drive mechanism 2400 of the power operated rotary knife 2100 to rotate the rotary knife blade 2500 about the blade central axis of rotation R and supply the vacuum source 3150 operatively coupled to the vacuum assembly 2900 to draw vacuum pressure in the vacuum hose 2990 and vacuum connector 2910. In one exemplary embodiment, the power leaf blower is an ECHO power backpack leaf blower, ECHO model number PB580T, available from Echo Incorporated, 400 Oakwood Road, Lake Zurich, Ill. 60047-1564.

As best seen in FIGS. 41, 42, 47 and 48, the drive motor assembly 3300 is portable in that it is mounted to the support frame 3200. The support frame 3200 includes the pair of vertically extending shoulder straps 3220 to allow the user to carry the support frame 3200 and, therefore, the drive motor assembly 3300 on his or her back, similar to a mountaineering backpack. One of skill in the art will recognize that the drive motor assembly 3300 may include various sources of motive power including portable internal combustion engines, portable electric motors, portable pneumatic motors, etc. In one exemplary embodiment, the drive motor assembly 3300 comprises a 2 cycle internal combustion engine 3310, being both light weight for portability and ease of carrying by the operator, as mounted to a horizontal support 3230 of the support frame 3200, and providing sufficient power output, via the rotating driveshaft 3400 of the engine 3310, to both provide the rotational power source 3100 for driving the rotary knife blade 2500 via the flexible shaft drive transmission 3600 and the power operated rotary knife drive mechanism 2400 and provide the vacuum source 3150 for rotating the centrifugal-type fan 3460 of the blower mechanism 3450 to generate appropriate vacuum pressure in the interior region 2992 of the vacuum hose 2990 of the vacuum assembly 2900 and appropriate vacuum pressure in the region of the cutting opening CO of the power operated rotary knife 2100 so as to effectively and efficiently draw foliage into the cutting opening and then route the cut or trimmed foliage material through the vacuum connector 2910 and the vacuum hose 2990 away from the cutting opening CO and ultimately exiting through the exit opening 3484 of the outlet or blower side duct 3482 of the blower assembly 3450 of the portable power unit 3000.

Figure 47:
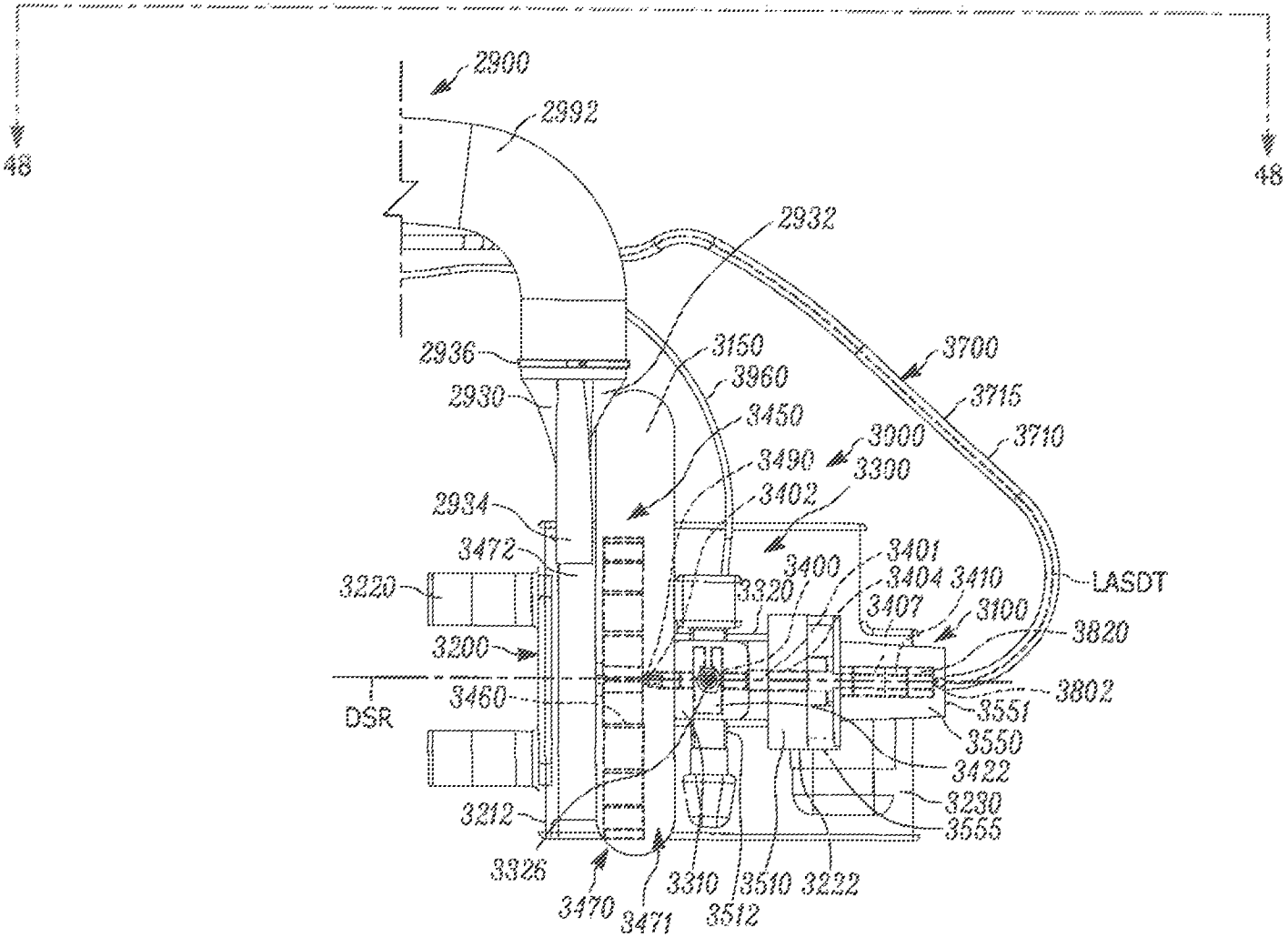
FIG. 47 is a schematic top plan view of the portable power unit of the power operated rotary knife assembly of FIG. 41.
Figure 48:
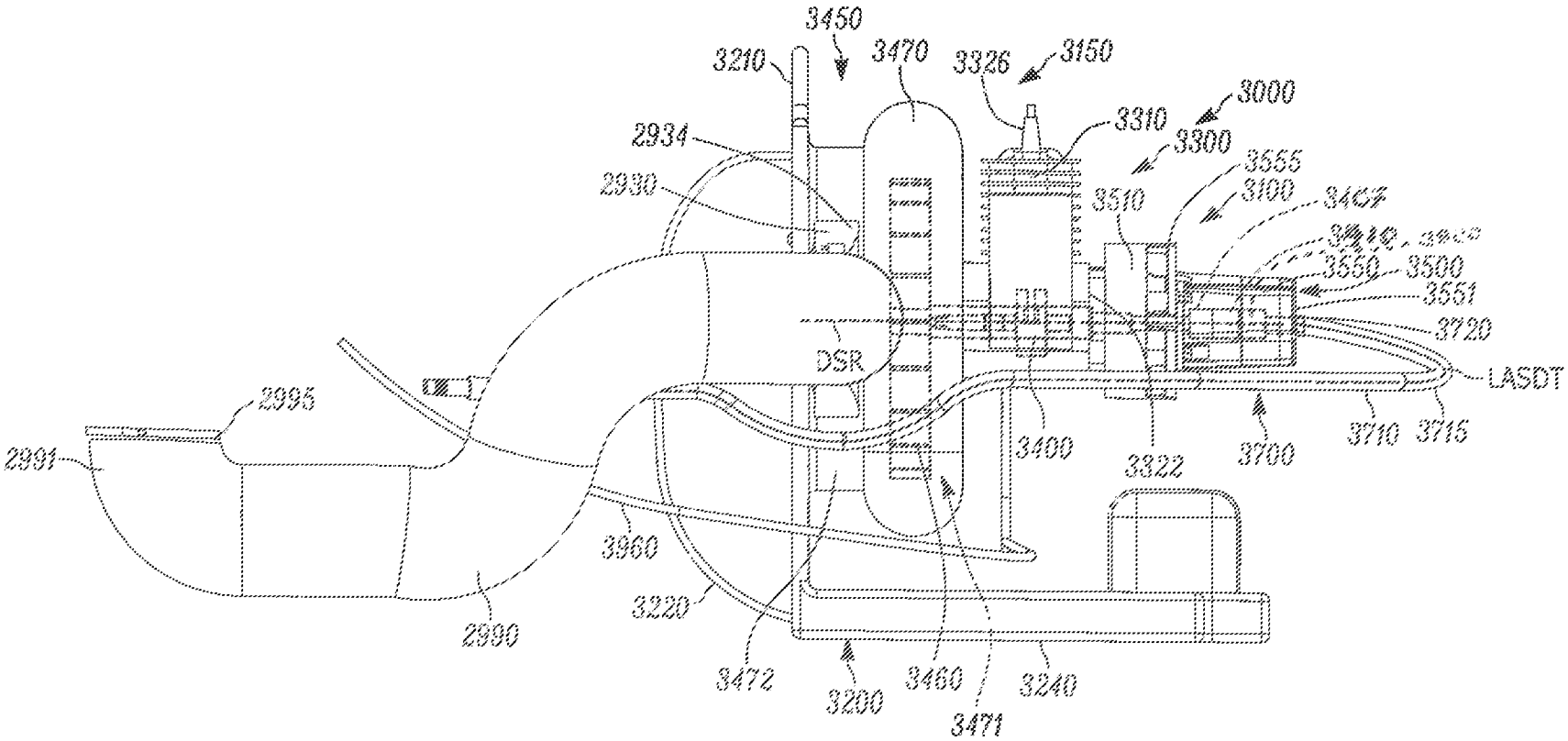
FIG. 48 is a schematic side elevation view of the portable power unit of FIG. 47.

As best seen in FIGS. 47, 48 and 50, the internal combustion engine 3310 includes the rotating crankshaft or driveshaft 3400, which is part of a driveshaft assembly 3401. The driveshaft assembly 3401 extends generally horizontally though openings on opposite sides of an engine or motor crankcase 3320 of the engine 3310 and rotates about a horizontally oriented central axis of rotation DSR of the driveshaft 3400. The term horizontally oriented assumes that engine 3310 is oriented in a vertical position, that is, a vertical axis of the engine 3310 extending though the engine sparkplug 3326 would be orthogonal to the driveshaft central axis of rotation DSR. The driveshaft 3400 is rotated by a reciprocating piston slidably supported within a cylinder (not shown) in conventional fashion. The driveshaft 3400 includes a central portion 3420 including an enlarged, disk-shaped counterweight 3422, a first, distal end portion 3402 and a second, proximal end portion 3408. An extending coupler 3404 is affixed to the distal end portion 3408 of the driveshaft 3400 to extend an axial length of the driveshaft 3400 in the direction of the flexible shaft drive transmission 3700 for purposes of enabling the driving engagement of a multi-engagement face drive fitting 3410 of the engine 3310 with a mating multi-engagement face driven fitting 3820 affixed to a proximal or motor end 3810 of the flex shaft assembly 3800 of the flexible shaft drive transmission 3700. In one exemplary embodiment, the extending coupler 3404 is affixed, by press fitting, into an opening formed in the distal end portion 3402 of the driveshaft 3400. The extending coupler 3404 protrudes though an opening 3324 in a first side or a front wall 3322 of the motor case 3320. A collar 3407 is affixed to a distal end portion 3406 of the extending coupler 3404. The multi-faced drive fitting 3410, in turn, is affixed to the collar 3407. The multi-faced drive fitting 3410, the collar 3407 and the extending coupler 3404 are all components of the driveshaft assembly 3401 and all of the components of the driveshaft assembly 3401 rotate about the driveshaft central axis of rotation DSR.

Additionally, affixed to the front wall 3322 of the motor case 3320 is a generally annular pedestal 3510, which is part of a drive motor coupling assembly 3500. The pedestal 3510 serves as a mounting base for a flange 3555 of the drive motor coupling 3550. The pedestal 3510 is secured to the motor case 3320 by a plurality of threaded fasteners 3512 which extend though openings of the pedestal 3510 and thread into aligned threaded openings in the motor case 3320. In turn, the drive motor coupling 3550 is secured to the pedestal 3510 by a plurality of threaded fasteners 3557 which extend through aligned openings of the flange 3555 of the drive motor coupling 3550 and thread into aligned threaded openings in the pedestal 3510. At a distal end 3551 of the drive motor coupling 3550 there is an opening 3553 defined by a tapered collar 3552. The tapered collar 3552 receives and, via a latching mechanism of the drive motor coupling 3550, releasably holds and secures a mating tapered coupling body 3722 of the motor end coupling 3720 of the outer casing assembly 3710 of the flexible shaft drive transmission 3700. When the tapered coupling body 3722 is secured within the tapered collar 3552 of the drive motor coupling 3550, the drive fitting 3410 of the driveshaft assembly 3401 engages and rotates the driven fitting 3820 of the flex shaft assembly 3800 of the shaft drive transmission 3700. As best seen in FIGS. 47, 48 and 50, in the engagement region of the drive and driven fittings 3410, 3820, the driveshaft central axis of rotation DSR and the central longitudinal axis LASDT of the flex shaft assembly 3800 are substantially aligned and coincident. The drive motor coupling 3550 includes a release latch 3560 which, when depressed by the operator, releases the tapered coupling body 3722 of the motor end coupling 3720 from the tapered collar 3552 of the drive motor coupled coupling 3550 and allows for disengagement of the drive fitting 3410 of the driveshaft assembly 3401 and the driven fitting 3820 of the flex shaft assembly 3800 of the shaft drive transmission 3700. Additional details of the various components of the drive motor coupling 3550 and the motor coupling 3700, the drive fitting 3410, the driven fitting 3820, as well as other components of the flexible shaft drive transmission 3700 may be found in the aforesaid U.S. Pat. No. 9,121,438 to Mascari, which is incorporated herein in its entirety.

Blower Assembly 3450

As best seen in FIG. 50, the centrifugal fan 3460 is affixed to the proximal end portion 3408 of the driveshaft 3400. The fan 3460 is disposed outside of a back wall of the motor case 3320 and is positioned within the spiral turbine or duct 3470 of the blower assembly 3450. The fan 3460 includes a planar backing plate 3494. A plurality of arcuate vanes 3496 extension from a back side of the backing plate 3494. The proximal end portion 3408 of the driveshaft 3400 extends thought an opening in a back wall of the motor case 3320 and fits into a stubshaft 3490 extending distally from a mounting bracket 3492 of the fan 3460 to affix the fan 3460 to the driveshaft assembly 3401. The fan 3460 is supported for rotation about the driveshaft central axis of rotation DSR within a large central, generally cylindrical region 3471 (best seen in FIGS. 47 and 48) of the duct 3470. Rotation of the driveshaft 3400 causes rotation of the fan 3460 and flow of air through the spiral duct 3470. A portion of the spiral duct 3470 that is routing air to the fan 3460 will be in a vacuum condition, while a portion of the spiral duct 3470 on the exhaust or outbound air side of the fan 3460 will be in a higher pressure condition. Accordingly, the spiral duct 3470 will include an inlet or input or vacuum side duct 3472, providing air to the fan 3460 and the central region 3471 of the duct 3470 in which the fan 3460 rotates, and a generally arcuate shaped output or blower side duct 3476, receiving blown air from the fan 3460 and the central region 3471 of the duct 3470 in which the fan rotates. Stated another way, the inlet, input or vacuum side duct 3472 is on the inlet side of the fan 3460 to provide air to the fan 3460 (and thus the interior region 3476 of the inlet side duct 3472 is in a vacuum pressure condition), while the output or blower side duct 3476 is on the outlet side of the fan 3460 receives blown air from the fan 3460 (and thus the interior region of the output side duct is in a high pressure condition). Typically, the output or blower side duct would be attached to a blower wand for purposes of blowing leaves, yard debris and dirt and the like. However, in the application of the present disclosure, the inlet or vacuum side duct 3472 is utilized to draw vacuum pressure in the vacuum assembly 2900 of the power operated rotary knife assembly 2000. The output or blower side duct 3476 includes an exit opening 3484 that trimmed foliage exits and is blown downwardly towards the ground. As the central region 3471, the inlet or input or vacuum side duct 3472 and the output or blower side duct 3476 are all in fluid communication, trimmed foliage material therefore enters an inlet opening 3474 of the vacuum or inlet side duct 3472 moves through the central region 3471 of the spiral duct 3470 and exits the blower assembly 3450 at a downwardly directed exit opening 3484 of the output or blower side duct 3476.

Figure 49:
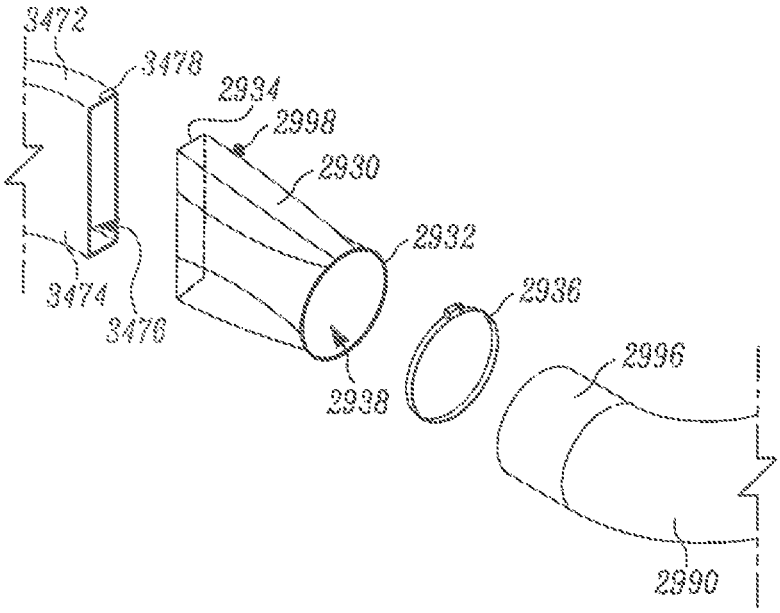
FIG. 49 is a schematic side perspective view of a vacuum adapter of the vacuum assembly and a peripheral end portion of an input side duct of a blower assembly of the portable power unit of the power operated rotary knife assembly of FIG. 41.

As best seen in FIG. 49, to provide fluid communication and transmission of vacuum pressure an interior region 3476 of the inlet or input side duct 3472 and the interior region 2992 of the vacuum hose 2990 of the vacuum assembly 2900, the vacuum assembly 2900 further includes an generally funnel shaped vacuum adapter 2930 which provides a substantially sealed, airtight connection between the respective interior regions 3476, 2992 of the inlet side duct 3472 of the blower assembly 3450 and vacuum hose 2990. A distal or inlet end portion 2932 of the vacuum adapter 2930 is generally cylindrical to snuggly receive a proximal end portion 2996 of the vacuum hose 2900. A clamp 2936 overlaps and seals the proximal end portion 2996 of the vacuum hose 2900 to the inlet end portion 2932 of the vacuum adapter 2930. Similarly, a proximal or outlet end portion 2934 of the vacuum adapter 2930 is configured in a generally rectangular in cross section to engage and snuggly fit against and seal with a peripheral edge 3478 defining the inlet opening 3474 of the vacuum or inlet or input side duct 3472 of the blower assembly 3450. The outlet end portion 2934 of the vacuum adapter is secured to the peripheral edge 3478 of the input side duct 3472 with a pair of threaded fasteners 2998 (FIG. 49). Accordingly, with the vacuum adapter 2930, the vacuum pressure generated by the centrifugal fan 3460 is communicated from the interior region 3476 of the input or inlet side duct 3472 though an interior region 2938 of the vacuum adapter 2930 through the interior region 2992 of the vacuum hose 2900 though the interior region of the vacuum connector 2910 to the region of the cutting opening CO of the power operated rotary knife 2100. Additionally, because the aforesaid interior regions are in fluid communication and the respective interior regions are substantially axially or longitudinally aligned, the trimmed foliage material flows generally smoothly along a passageway from the cutting opening CO through the vacuum connector 2910, the vacuum hose 2900, the vacuum adapter 2930, and the spiral duct 3470, to exit the blower assembly 3450 at the exit opening 3484 of the output side duct 3476.

The blower fan 3460, being rotated by the motor driveshaft 3400, generates a vacuum pressure condition within the interior region 3476 of the inlet or vacuum duct side 3472 of the blower duct 3470. This, in turn causes a vacuum pressure condition within an interior region 2992 of the vacuum hose 2990 and a vacuum condition in the region COR of the central cutting opening CO of the head assembly 2300. Thus, when the operator manipulates the power operated rotary knife 2100 such that the cutting opening CO is presented to foliage to be trimmed, the vacuum pressure condition VPCCO at the cutting opening CO causes the foliage to be drawn into the cutting opening CO where it is cut by the overlapping cutting regions rotating rotary knife blade 2500 and the stationary trim guide 2700. Stated another way, the blower fan 3460, being rotated by the motor driveshaft 3400, generates a flow of air through the interior region of the inlet duct side of the blower duct toward the fan 3460, this, in turn causes a flow of air within an interior region 2992 of the vacuum hose 2990 and through a region COR of the central cutting opening CO of the head assembly 2300 in a proximal or rearward direction toward the inlet duct side 3472 and toward the fan 3460. Thus, when the operator manipulates the power operated rotary knife 2100 such that the cutting opening CO is presented to foliage to be trimmed, the flow of air into the region COR of the cutting opening CO causes foliage to be drawn into the cutting opening CO where it is cut by the overlapping cutting regions rotating rotary knife blade 2500 and the stationary trim guide 2700. The flow of air cause the trimmed foliage material to move within the aligned interior regions 2992, 3476 of the vacuum hose 2990 and the blower inlet duct side 3472 and ultimately be blown out of an outlet duct side 3482 of the blower duct 3470.

Speed Control Assembly 3950

Advantageously, the drive motor assembly 3300 includes a speed control assembly 3950, best seen in FIGS. 45-46 and 51-53, which allows the operator to easily control both the rotational speed of the rotary knife blade 2500 and the vacuum pressure drawn in the vacuum hose 2990, including the vacuum pressure present in the region of the cutting opening CO. In one exemplary embodiment, the speed control assembly 3950 includes a finger operated throttle or speed control trigger 3952. By depressing or releasing the speed control trigger 3952 appropriately, the operator controls the rotational speed of the driveshaft 3400 of the engine 3310 of the drive motor assembly 3300. That is, the speed control assembly 3950 includes a speed control cable 3960 operatively coupled between the speed control trigger 3952 and a carburetor 3312 of the drive motor assembly 3300. In one exemplary embodiment, the speed control assembly 3950 includes a mechanical connection between the trigger 3952 and the motor carburetor 3312, however, one of skill in the art would recognize that the speed control assembly 3950 could be modified to utilize electronic, as opposed to mechanical controls and it is within the contemplation of the present disclosure to include non-mechanical speed control assemblies.

By depressing and releasing finger pressure applied to the speed control trigger 3952, a position of the trigger 3952 changes with respect to the handle extension 3910 and the rotational speed of the driveshaft 3400 changes with the position of the trigger 3952. As previously explained, the rotational speed of the driveshaft 3400 is proportional to and determines the magnitude of the rotational speed of the rotary knife blade 2500 and the magnitude of the vacuum drawn in the vacuum hose 2990 and the vacuum connector 2910 of the vacuum assembly 2900. Advantageously, for ergonomics and ease of operator use, the speed control assembly 3950 is integral with the handle extension 3910 of a handle extension assembly 3900, that is, the trigger 3952 is positioned to protrude forwardly in a direction generally aligned with and parallel to the handle assembly longitudinal axis and toward the rotary knife blade central axis of rotation R. The trigger 3952 is pivotally mounted just below an upper bulbous or enlarged portion 3914 of the handle extension 3910 which is configured to be used as a thumb rest by the operator during cutting and trimming operations and in proximity to an upper end 3913 of a central, generally cylindrical, finger gripping portion 3912 of the handle extension 3910. The position of the trigger 3952 permits actuation of the trigger with the operator's index finger which provides for accurate control of the trigger 3952 while providing for a firm grip by the remainder of the operator's hand on the cylindrical gripping region 3912 and the overlaying of the operator's thumb on the upper bulbous thumb rest portion 3914.

Additionally and advantageously, the speed control assembly 3950 includes a second, thumb controlled multi-position switch 3955 that is mounted to a generally planar side 3915 of the upper bulbous-shaped thumb rest portion 3914. The second thumb switch 3955 of the speed control assembly 3950 advantageously functions, in one position, as a kill switch to turn off the engine 3310, as desired by the operator. In a second position, the thumb switch 3955 functions as a trigger position lock wherein a specific trigger position of the finger trigger 3750 is locked in by moving the thumb switch 3955 to the second position. In the second position. i.e., the trigger position lock position, advantageously, the operator does not have to maintain constant pressure of his or her index finger on the trigger during, for example, long periods of cutting or trimming operations. This allows the operator to rest his or her index finger and to change gripping positions on the handle extension 3910 to mitigate hand fatigue.

The speed control assembly 3950 additionally includes the speed control cable 3960 that operatively couples the finger trigger 3750 and thumb switch 3955 to the carburetor 3312 of the engine 3310 allowing throttle control of the engine 3310 via the position of the finger trigger 3750 and, therefore, control of the rotational speed of the driveshaft 3400. Advantageously, the operator, via the finger operated speed control trigger 3750 can control the speed of rotation (RPM) of the rotary knife blade 2500. For example, the operator releases the speed control trigger 3750 when, for example, the operator is walking between rows of plants or otherwise not engaged in cutting or trimming operations with the power operated rotary knife 2100. Thus, the rotation of the rotary knife blade 2500 is at a reduced rotational speed, i.e., at an idle rotational speed. By contrast, when cutting and trimming operations are being performed, the operator fully depresses the trigger 3750 so that the rotary knife blade 2500 is rotating at full rotational speed for ease of cutting. Similarly and advantageously, because the finger operated speed control trigger 3750 is essentially a throttle control trigger for the drive motor assembly 3300, the further the trigger 3750 is depressed by the operator, the faster the driveshaft 3400 of the drive motor assembly 3300 rotates and the faster the centrifugal fan 3460 rotates. A magnitude of the vacuum pressure drawn or generated within the vacuum hose interior region 2992 is directly proportional to the rotational speed of centrifugal fan 3460 and therefore directly proportional to the rotational speed of the driveshaft 3400. Thus, advantageously, the operator can control both the speed of rotation of the rotary knife blade 2500 and the vacuum pressure drawn in the vacuum hose interior region 2992 by the speed control trigger 3750.

Handle Extension Assembly 3900

Figure 43:
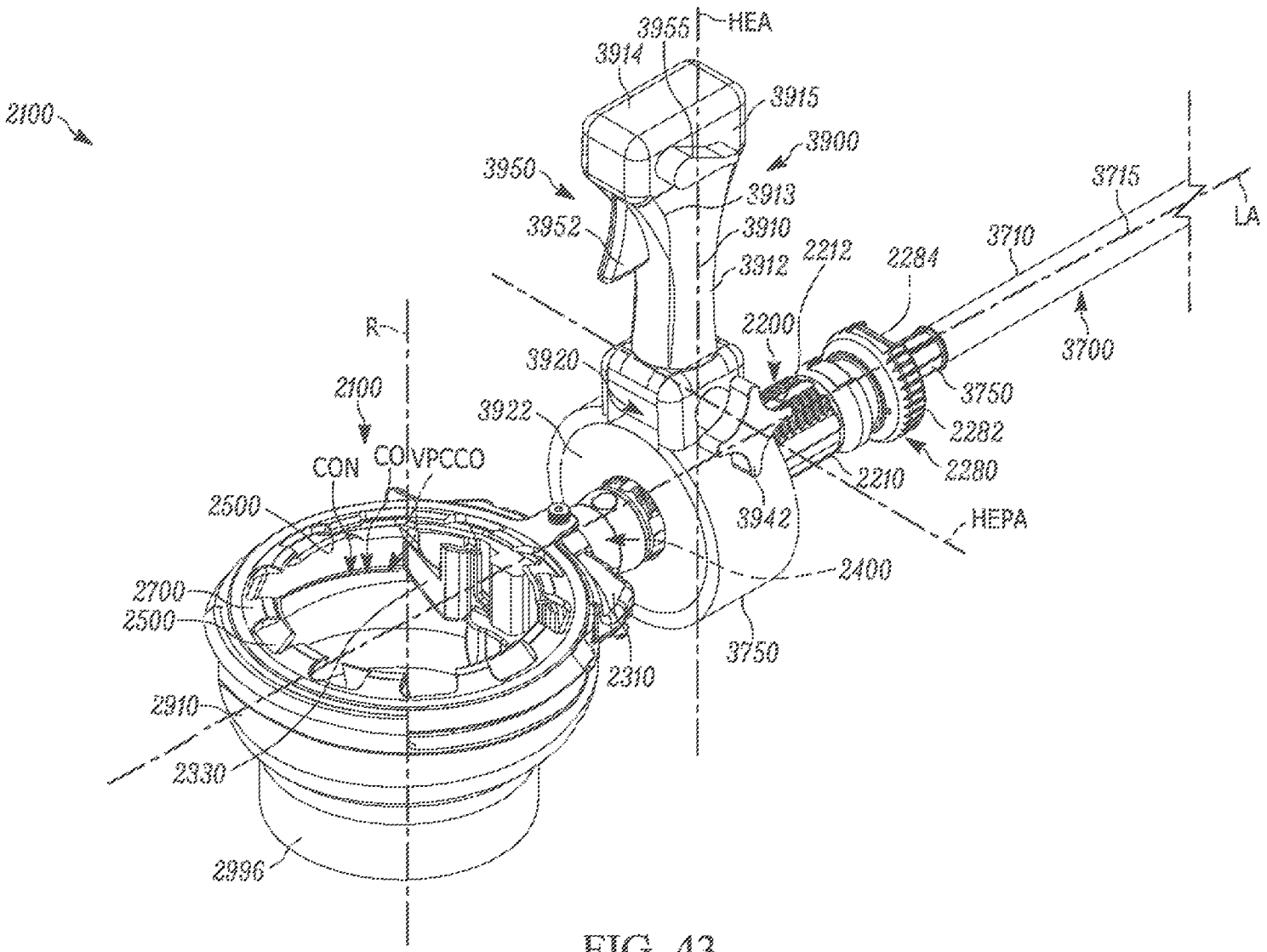
FIG. 43 is a schematic side perspective view of a distal portion of the power operated rotary knife assembly of FIG. 41 including the power operated rotary knife, a distal portion of the vacuum assembly and a rotational speed control/handle assembly, a vacuum hose of the vacuum assembly removed for clarity.
Figure 44:
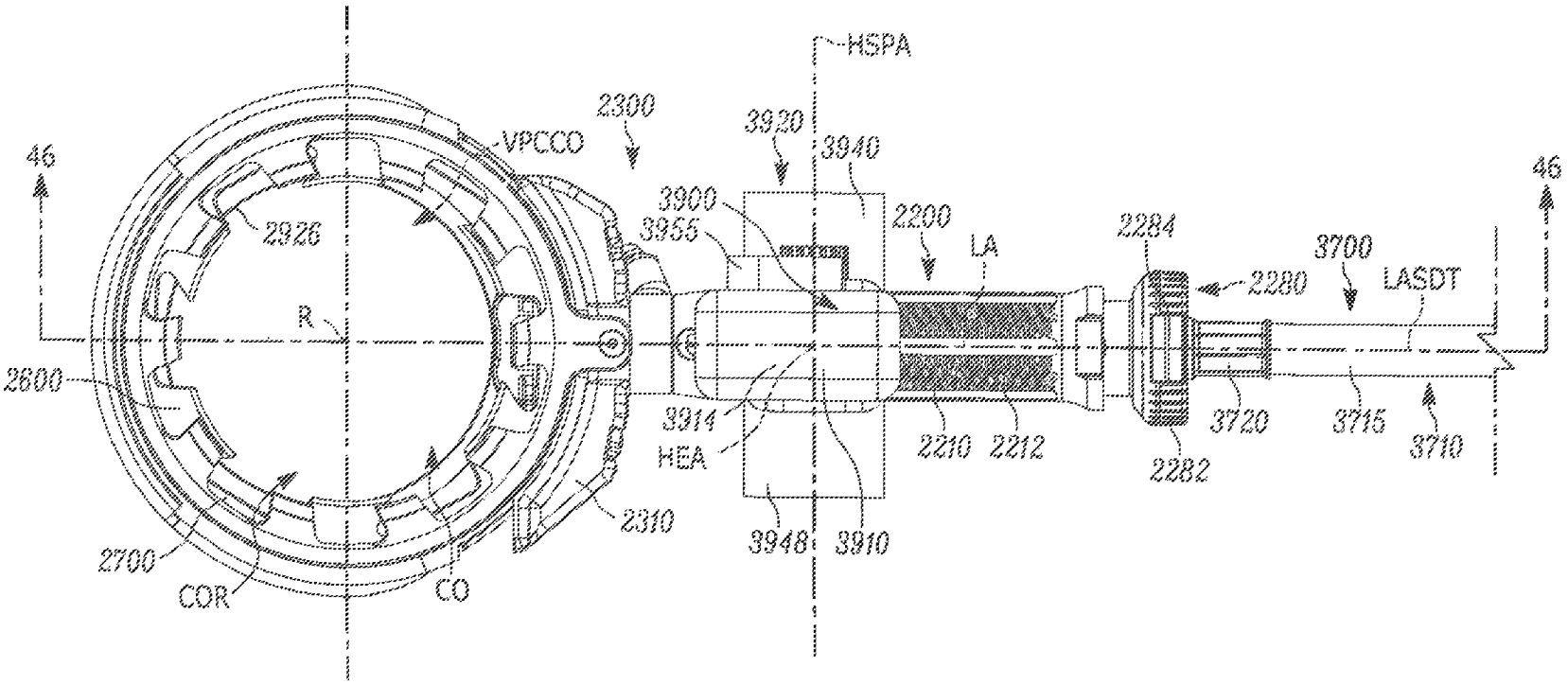
FIG. 44 is a schematic top plan view of the distal portion of the power operated rotary knife assembly of FIG. 43.
Figure 52:
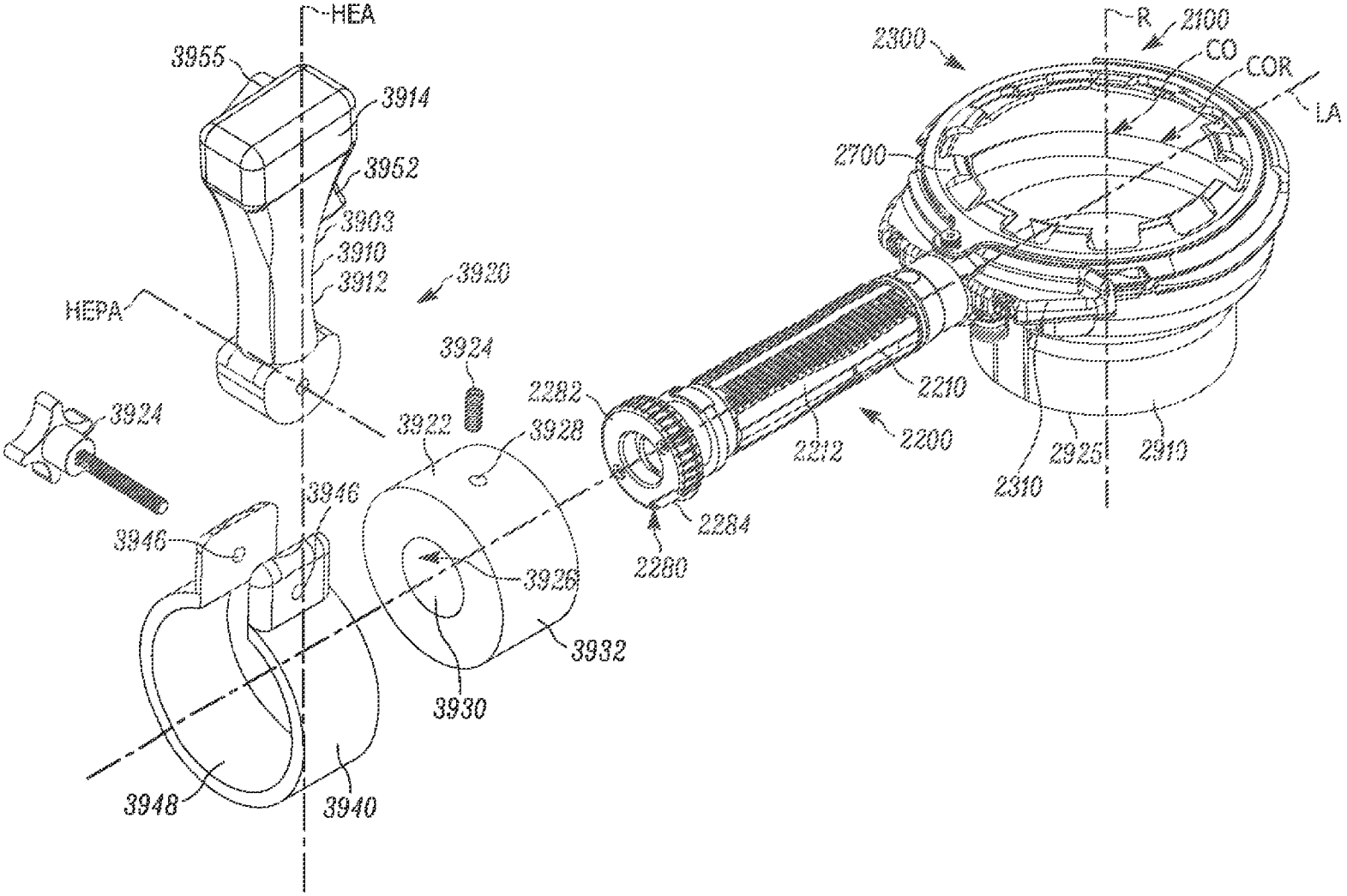
FIG. 52 is a schematic exploded rear perspective view of portions of the power operated rotary knife, the vacuum assembly, the flexible shaft drive transmission, the speed control assembly, and the handle extension assembly of the power operated rotary knife assembly of FIG. 41.
Figure 53:
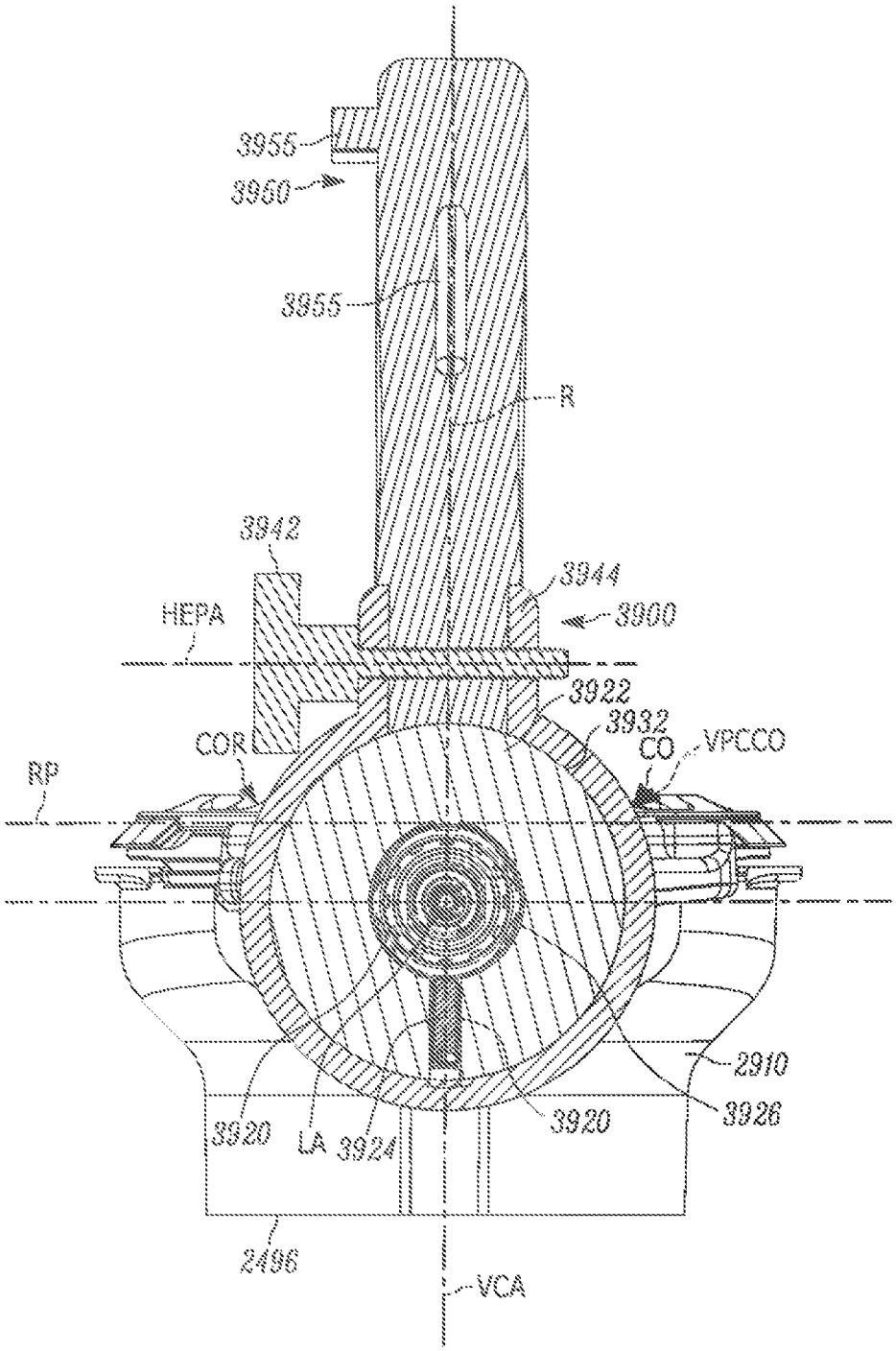
FIG. 53 is a schematic section view of the distal portion of the power operated rotary knife assembly of FIG. 43, as seen from a plane indicated by the line 53-53 in FIG. 46.

The handle extension assembly 3900 includes the handle extension 3910, as described above. Additionally, as best seen in FIGS. 52 and 53, the handle extension assembly 3900 provides a mounting structure 3920 to mount the handle extension 3910 such that it extends from the hand piece 2210 of the handle assembly 2200. The handle extension 3910 extends along a handle extension axis HEA. Advantageously, the handle extension 3910 may be positioned with respect to the hand piece 2210 such that the handle extension axis HEA intersects and extends orthogonally with respect to the handle assembly longitudinal axis LA and is substantially parallel to the rotary knife blade central axis of rotation R. The mounting structure 3920 advantageously allows the operator to position and orient the handle extension 3910 in a comfortable and ergonomically beneficial position for the operator such that as the power operated rotary knife 2100 is positioned and manipulated by the operator to move in a natural upward, arcuate sweeping motion by bending his or her arm at the elbow while gripping the cylindrical finger gripping portion 3912 of the handle extension 3910. For cutting/trimming operations on grape vines in an upward, arcuate sweeping motion, the power operated rotary knife 2001 will be positioned for use as shown in FIGS. 41-43, that is, the knife 2001 is oriented for use such that the vacuum connector 2910 is positioned below (in the direction B as shown in FIG. 45) the head assembly 2300 and the rotational plane RP of the rotary knife blade 2500 and the handle assembly longitudinal axis LA. Stated another way, the orientation of the power operated rotary knife 2100 will be opposite of the orientation of the power operated rotary knife 1100, as shown in FIG. 21. Similarly, the handle extension 3910 is mounted to the handle assembly hand piece 2210 such that it extends above the rotational plane RP of the knife blade and the handle assembly longitudinal axis LA.

To securely affix the handle extension 3910 to the handle assembly hand piece 2210 in the desired orientation and position, the handle extension assembly 3900 further includes a mounting structure 3920 which couples a lower, mounting or base portion 3918 of the handle extension 3910 to the handle assembly hand piece 2210. In one exemplary embodiment, the mounting structure 3910 includes an annular collar 3922 having a central throughbore 3926 defined by a cylindrical inner surface 3930 of the collar 3922. As best seen in FIG. 43, the diameter of the central throughbore 3926 of the collar 3922 is sized to snuggly overlie a portion 2213 of an exterior surface 2212 of the hand piece 2210. The latching knob 2282 of the handle assembly 2200 must be removed to slide the collar 3922 over the hand piece 2210. The collar 3922 includes a threaded opening 3928 extending radially between the cylindrical inner surface 3930 and a cylindrical outer surface 3932 of the collar 3922. A set screw 3924 is threaded into the opening 3928 and bears against the exterior surface 2212 of the hand piece 2210 to secure the collar 3922 and therefore the handle extension 3910 in the desired rotational position with respect to the cutting opening CO of the head assembly 2300 of the power operated rotary knife 2100.

The mounting structure 3920 further includes a c-shaped clamp 3940 which wraps around and overlies the cylindrical outer surface 3932 of the collar 3922 and includes a pair of spaced apart uprights 3944, defining a pair of aligned threaded openings 3946. The base portion 3918 of the handle extension 3910 also includes a threaded aperture 3918. A threaded fastener 3924 is threaded through the pair of aligned threaded openings 3946 of the clamp uprights 3944 and through the handle extension threaded aperture 3918. Prior to tightening the threaded fastener 3924, the handle extension 3910 may be pivoted about a handle extension pivot axis HEPA. Thus, the operator may pivot the handle extension 3910 to find a pivot position of the handle extension 3910 that is most comfortable for the operator. As the threaded fastener 3924 is tightened, the uprights 3944 of the flexible clamp 3940 tighten around and secure the handle extension 3910 in place and a body 3948 tightens around the outer surface 3932 of the collar 3922 to securely couple the handle extension 3910 to the collar 3922. The handle extension pivot axis HEPA is intersected by the handle extension axis HEA and is offset from and transverse to the handle assembly longitudinal axis LA and the rotary knife blade axis of rotation R. However, advantageously, in any rotational position and in any pivot position of the handle extension 3910, the handle extension axis HEA intersects handle assembly longitudinal axis LA thereby making is easy for the operator to manipulate the power operated rotary knife 2100 for cutting and trimming operations.

As used herein, terms of orientation and/or direction such as front, rear, forward, rearward, distal, proximal, distally, proximally, upper, lower, inward, outward, inwardly, outwardly, upwardly, downwardly, horizontal, horizontally, vertical, vertically, axial, radial, longitudinal, axially, radially, longitudinally, etc., are provided for convenience purposes and relate generally to the orientation shown in the Figures and/or discussed in the Detailed Description. Such orientation/direction terms are not intended to limit the scope of the present disclosure, this application, and/or the invention or inventions described therein, and/or any of the claims appended hereto. Further, as used herein, the terms comprise, comprises, and comprising are taken to specify the presence of stated features, elements, integers, steps or components, but do not preclude the presence or addition of one or more other features, elements, integers, steps or components.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A power operated rotary knife assembly comprising:

a) a hand-held power operated rotary knife including a head assembly and an elongated handle assembly extending from the head assembly along a longitudinal axis, the head assembly including:

i) an annular rotary knife blade supported for rotation about a central axis of rotation in a direction of rotation, the annular rotary knife blade including a blade section including a central opening and a plurality of circumferentially spaced apart notches extending from a lower end of the blade section, each of the plurality of notches including an opening at the lower end and a central open portion defined by a peripheral wall, the peripheral wall including a cutting portion, the cutting portion of each of the plurality of circumferentially spaced apart notches defining a cutting edge of the rotary knife blade;

ii) a trim guide including a central opening and a plurality of circumferentially spaced apart notches extending from a lower end of the trim guide, each of the plurality of notches including an opening at the lower end and a central open portion defined by a peripheral wall, the peripheral wall including a shearing portion, the shearing portions in overlapping axial alignment with the cutting portions of the plurality of notches of the blade section of the annular rotary knife blade as the annular rotary blade rotates about the central axis of rotation, overlapping central openings of the annular rotary knife blade and of the trim guide defining a central cutting opening of the head assembly; and iii) a frame body supporting a drive mechanism including a gear member engaging and rotating the annular rotary knife blade;

b) a portable power unit including a drive motor assembly and a blower assembly, the drive motor assembly including a driveshaft assembly rotating about a driveshaft central axis of rotation, the blower assembly including a fan and a duct, the fan operatively coupled to the driveshaft assembly for rotation, rotation of the fan causing a vacuum pressure condition within an interior region of an inlet duct side of the duct;

c) a flexible shaft drive transmission including a rotating flex shaft assembly operatively coupled between the driveshaft assembly of the portable power unit and the drive mechanism of the head assembly of the power operated rotary knife, rotation of the driveshaft assembly about the driveshaft central axis of rotation causing rotation of the flex shaft assembly and rotation of the gear member of the drive mechanism to rotate the annular rotary knife blade; and d) a vacuum assembly including a vacuum hose coupled between the head assembly and the inlet duct side of the duct of the blower assembly, the interior region of the inlet duct side in fluid communication with an interior region of the vacuum hose and a region of the central cutting opening of the head assembly.

2. The power operated rotary knife assembly of claim 1 wherein the longitudinal axis of the handle assembly of the power operated rotary knife is orthogonal to the central axis of rotation of the annular rotary knife blade and wherein the power operated rotary knife further includes a handle extension assembly including an handle extension extending along a handle extension axis and coupled to a hand piece of the handle assembly, the handle extension extending transversely from the hand piece, the portable power unit further including a speed control assembly operatively coupled to the drive motor assembly for controlling a rotational speed of the driveshaft assembly, the speed control assembly including a speed control trigger mounted on the handle extension.

3. The power operated rotary knife assembly of claim 2 wherein the handle extension assembly further includes a mounting structure for coupling the handle extension to the hand piece of the handle assembly, the mounting structure including a collar having a central opening defined by a inner surface and a radially space apart outer surface, the collar positioned on the hand piece of the handle assembly to surround and overlie a longitudinally extending portion of the hand piece, the mounting structure further including an annular clamp overlying the outer surface of the collar and having a pair of spaced apart uprights, a lower mounting portion of the handle extension received and secured between the spaced apart uprights, the handle extension axis intersecting the longitudinal axis of the handle assembly.

4. The power operated rotary knife assembly of claim 3 wherein the handle extension assembly including a fastener that extends through aligned openings of the pair of spaced apart uprights of the annular clamp and an aperture through the lower mounting portion of the handle extension, the fastener securing the mounting portion of the handle extension to the annular clamp and defining a pivot axis for the handle extension, the pivot axis of the handle extension being transverse to and spaced apart from the longitudinal axis of the handle assembly and the central axis of rotation of the annular rotary knife blade.

5. The power operated rotary knife assembly of claim 1 wherein the vacuum assembly includes a vacuum connector coupled between the head assembly of the power operated rotary knife and a first end of the vacuum hose providing fluid communication between the central cutting opening of the head assembly and the interior region of the vacuum hose and a vacuum adapter coupled between a peripheral end portion of the inlet duct side of the blower assembly and a second end of the vacuum hose providing fluid communication between the interior region of the vacuum hose and the interior region of the inlet duct side of the blower assembly.

6. The power operated rotary knife assembly of claim 1 wherein the motor assembly includes a motor case in which a driveshaft of the driveshaft assembly is disposed and a drive motor coupling assembly coupled to the motor case, the drive motor coupling assembly including a pedestal affixed to a first side of the motor case and a drive motor coupling affixed to the pedestal and including a central opening, the driveshaft assembly extending though an opening in the first side of the motor case and including a multi-engagement face drive fitting at a distal end of the driveshaft assembly, the drive fitting rotating about the driveshaft central axis of rotation.

7. The power operated rotary knife assembly of claim 6 wherein the flexible shaft drive transmission includes an outer casing assembly comprising an outer casing overlying a flex shaft of the rotating flex shaft assembly, a motor end coupling at a proximal end of the outer casing including a coupling body received in the central opening of the drive motor coupling and releasably affixed to the drive motor coupling, the flex shaft assembly including a multi-engagement face driven fitting at a proximal end of the flex shaft, the multi-engagement face driven fitting engaging and being rotated by the multi-engagement face drive fitting of the driveshaft assembly when the motor end coupling of the outer casing assembly is affixed to the drive motor coupling of the drive motor coupling assembly.

8. The power operated rotary knife assembly of claim 7 wherein the outer casing assembly of the flexible shaft drive transmission further includes a handle assembly coupling at a distal end of the outer casing, the handle assembly coupling releasable affixed to the handle assembly of the power operated rotary knife, the flex shaft assembly including a male drive fitting at a distal end of the flex shaft, the male drive fitting engaging and rotating the gear member of the drive mechanism of the power operated rotary knife.

9. The power operated rotary knife assembly of claim 8 wherein the handle assembly coupling includes a driver, assembly extending into a central longitudinal opening of the handle assembly and secured to handle assembly by a latching assembly disposed at a proximal end of the handle assembly.

10. The power operated rotary knife assembly of claim 6 wherein the driveshaft assembly further includes an extending coupler affixed to a distal end portion of the driveshaft, the multi-engagement face drive fitting being affixed to distal end of the extending coupler and the extending coupler extending though the opening in the first side of the motor ease driveshaft assembly.

11. The power operated rotary knife assembly of claim 6 wherein the fan of the blower assembly is affixed to a proximal end portion of the driveshaft and is positioned in the duct.

12. The power operated rotary knife assembly of claim 1 wherein the portable power unit is supported on a support frame including a plurality of shoulder straps for carrying by an operator.

13. The power operated rotary knife assembly of claim 1 wherein the fan rotates about the driveshaft central axis of rotation.

14. The power operated rotary knife assembly of claim 1 wherein the duct includes the inlet duct side on one side of the fan and an outlet duct side on an opposite side of the fan.

15. The power operated rotary knife assembly of claim 1 wherein the vacuum pressure condition within the interior region of the inlet duct side causes a vacuum pressure condition within the interior region of the vacuum hose and a vacuum condition in a region of the central cutting opening of the head assembly.

16. A power operated rotary knife assembly comprising:

a) a hand-held power operated rotary knife including a head assembly including:

i) an annular rotary knife blade supported for rotation about a central axis of rotation in a direction of rotation, the annular rotary knife blade including a blade section, a lower end of the blade section including a plurality of circumferentially spaced apart notches, each of the plurality of circumferentially spaced apart notches including a cutting portion;

ii) a trim guide including a guide section, a lower end of the guide section including a plurality of circumferentially spaced apart notches, each of the plurality of notches including a shearing portion, the shearing portions of the plurality of circumferentially spaced apart notches of the guide section of the trim guide in overlapping axial alignment with the cutting portions of the plurality of circumferentially spaced apart notches of the annular rotary knife blade as the annular rotary knife blade rotates about the central axis of rotation;

b) a portable power unit including a drive motor assembly and a blower assembly, the drive motor assembly including a driveshaft assembly rotating about a driveshaft central axis of rotation, the blower assembly including a fan and a duct, the fan operatively coupled to the driveshaft assembly for rotation, rotation of the fan causing a vacuum pressure condition within an interior region of an inlet duct side of the duct;

c) a flexible shaft drive transmission including a rotating flex shaft assembly operatively coupled between the driveshaft assembly of the portable power unit and the head assembly of the power operated rotary knife to rotate the-annular rotary knife blade; and d) a vacuum assembly including a vacuum hose coupled between the head assembly and the inlet duct side of the duct of the blower assembly.

17. The power operated rotary knife assembly of claim 16 wherein the lower end of the blade section defines a central opening of the annular rotary knife blade, the blade section of the annular rotary knife blade includes a blade frustoconical wall extending between an upper end of the blade section and a lower end of the blade section, the lower end of the blade section spaced radially inwardly from and axially below the upper end, the plurality of circumferentially spaced apart notches extending from the lower end of the blade section into the blade frustoconical wall, each of the plurality of notches including a peripheral wall surrounding a central open portion, the peripheral wall including a leading portion, a central portion and a U-shaped trailing portion, the leading portion and the U-shaped trailing portion being circumferentially spaced apart by the central portion, the U-shaped trailing portion including a cutting portion, the cutting portion of each of the plurality of circumferentially spaced apart notches defining a cutting edge of the rotary knife blade.

18. The power operated rotary knife assembly of claim 16 wherein the trim guide includes a base and the guide section extending from the base, the lower end of the guide section defining a central opening of the trim guide, the guide section including a guide frustoconical wall extending between an upper end of the guide section and the lower end of the guide section, the lower end of the guide section spaced radially inwardly from the upper end of the guide section, the guide section including the plurality of circumferentially spaced apart notches extending from the lower end of the guide section into the guide frustoconical wall, each of the plurality of notches including a peripheral wall surrounding a central open portion.

19. The power operated rotary knife assembly of claim 16 wherein the hand-held power operated rotary knife further includes an elongated handle assembly extending from the head assembly along a longitudinal axis orthogonal to the central axis of rotation of the annular rotary knife blade and wherein the power operated rotary knife further includes a handle extension assembly including an handle extension extending along a handle extension axis and coupled to a hand piece of the handle assembly, the handle extension extending transversely from the hand piece, the portable power unit further including a speed control assembly operatively coupled to the drive motor assembly for controlling a rotational speed of the driveshaft assembly, the speed control assembly including a speed control trigger mounted on the handle extension.

20. The power operated rotary knife assembly of claim 19 wherein the handle extension assembly further includes a mounting structure for coupling the handle extension to the hand piece of the handle assembly, the mounting structure including a collar having a central opening defined by an inner surface and a radially spaced apart outer surface, the collar positioned on the hand piece of the handle assembly to surround and overlie a longitudinally extending portion of the hand piece, the mounting structure further including an annular clamp overlying the outer surface of the collar and having a pair of spaced apart uprights, a lower mounting portion of the handle extension received and secured between the spaced apart uprights, the handle extension axis intersecting the longitudinal axis of the handle assembly.

21. A power operated rotary knife assembly comprising:

a) a hand-held power operated rotary knife including a head assembly including:

i) an annular rotary knife blade supported for rotation about a central axis of rotation, the annular rotary knife blade including a blade section, a lower end of the blade section including a plurality of circumferentially spaced apart notches, each of the plurality of circumferentially spaced apart notches including a cutting portion;

ii) a trim guide including a guide section, a lower end of the guide section including a plurality of circumferentially spaced apart notches, each of the plurality of notches including a shearing portion; and iii) an annular blade housing including a blade support section supporting the annular rotary knife blade for rotation about the central axis of rotation, at least a portion of the blade support section of the blade housing positioned between the annular rotary knife blade and the trim guide;

b) a portable power unit including a drive motor assembly and a blower assembly, the drive motor assembly including a driveshaft assembly rotating about a driveshaft central axis of rotation, the blower assembly including a fan and a duct, the fan operatively coupled to the driveshaft assembly for rotation, rotation of the fan causing a vacuum pressure condition within an interior region of the duct;

c) a flexible shaft drive transmission including a rotating flex shaft assembly operatively coupled between the driveshaft assembly of the portable power unit and the head assembly of the power operated rotary knife to rotate the-annular rotary knife blade; and d) a vacuum assembly including a vacuum hose coupled between the head assembly and an inlet side of the duct of the blower assembly.

22. The power operated rotary knife assembly of claim 21 wherein the shearing portions of the plurality of circumferentially spaced apart notches of the guide section of the trim guide are in overlapping axial alignment with the cutting portions of the plurality of circumferentially spaced apart notches of the annular rotary knife blade as the annular rotary knife blade rotates about the central axis of rotation.

23. The power operated rotary knife blade assembly of claim 21 wherein the annular rotary knife blade includes the blade section extending an annular body, at least a portion of the blade support section of the blade housing positioned axially between at least a portion of the annular body of the annular rotary knife blade and the trim guide.

24. The power operated rotary knife assembly of claim 21 wherein the hand-held power operated rotary knife further includes an elongated handle assembly extending from the head assembly along a longitudinal axis orthogonal to the central axis of rotation of the annular rotary knife blade and wherein the power operated rotary knife further includes a handle extension assembly including an handle extension extending along a handle extension axis and coupled to a hand piece of the handle assembly, the handle extension extending transversely from the hand piece, the portable power unit further including a speed control assembly operatively coupled to the drive motor assembly for controlling a rotational speed of the driveshaft assembly, the speed control assembly including a speed control trigger mounted on the handle extension.

25. The power operated rotary knife assembly of claim 24 wherein the handle extension assembly further includes a mounting structure for coupling the handle extension to the hand piece of the handle assembly, the mounting structure including a collar having a central opening defined by an inner surface and a radially spaced apart outer surface, the collar positioned on the hand piece of the handle assembly to surround and overlie a longitudinally extending portion of the hand piece, the mounting structure further including an annular clamp overlying the outer surface of the collar and having a pair of spaced apart uprights, a lower mounting portion of the handle extension received and secured between the spaced apart uprights, the handle extension axis intersecting the longitudinal axis of the handle assembly.

* * * * *